US008262498B2

(12) United States Patent
Beach et al.

(10) Patent No.: US 8,262,498 B2
(45) **Date of Patent: *Sep. 11, 2012**

(54) GOLF CLUB

(75) Inventors: Todd P. Beach, San Diego, CA (US); Mark V. Greaney, Vista, CA (US); Ian C. Wright, Carlsbad, CA (US); Kraig A. Willett, Fallbrook, CA (US); Nathan T. Sargent, San Marcos, CA (US); Matthew D. Johnson, Carlsbad, CA (US); Gery M. Zimmerman, Fallbrook, CA (US); Kevin R. Harper, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/986,030

(22) Filed: Jan. 6, 2011

(65) Prior Publication Data

US 2011/0105242 A1 May 5, 2011

Related U.S. Application Data

(62) Division of application No. 12/346,747, filed on Dec. 30, 2008, now Pat. No. 7,887,431.

(60) Provisional application No. 61/054,085, filed on May 16, 2008.

(51) Int. Cl.
*A63B 53/02* (2006.01)

(52) U.S. Cl. ..... 473/307; 473/309

(58) Field of Classification Search ..... 473/307, 473/309, 288, 314, 315, 296, 298, 299, 244–246, 473/248

See application file for complete search history.

(56) References Cited

U.S. PATENT DOCUMENTS

| | | | |
|---|---|---|---|
| 782,955 | A | 2/1905 | Emens |
| 796,802 | A | 8/1905 | Brown |
| 1,454,267 | A | 5/1923 | Challis et al. |
| D63,284 | S | 11/1923 | Challis |
| 1,623,523 | A | 4/1927 | Bourke |
| 1,650,183 | A | 11/1927 | Brooks |
| 1,890,538 | A | 12/1932 | Hadden |
| 1,895,417 | A | 1/1933 | Lard |

(Continued)

FOREIGN PATENT DOCUMENTS

| | | |
|---|---|---|
| GB | 2207358 | 2/1989 |

(Continued)

OTHER PUBLICATIONS

Machine Translation into English of JP 2008029691, Feb. 14, 2008, Suzuki.*

(Continued)

*Primary Examiner* — Stephen L. Blau
(74) *Attorney, Agent, or Firm* — Klarquist Sparkman, LLP

(57) ABSTRACT

A golf club comprises a shaft, a club head, and a connection assembly that allows the shaft to be easily disconnected from the club head. In particular embodiments, the connection assembly includes a removable hosel sleeve that allows a shaft to be supported a desired predetermined orientation relative to the club head. In this manner, the shaft loft and/or lie angle of the club can be adjusted without resorting to traditional bending of the shaft. In another embodiment, the club head has an adjustable sole that can be adjusted upwardly and downwardly relative to the strike face of the club head, which is effective to adjust the face angle of the club head.

9 Claims, 27 Drawing Sheets

U.S. PATENT DOCUMENTS 1,946,134 A 2/1934 Dyce
2,020,679 A 11/1935 Fitzpatrick
2,067,556 A * 1/1937 Wettlaufer ..... 473/308
2,219,670 A 10/1940 Wettlaufer
2,225,931 A 12/1940 Sexton
2,464,850 A 3/1949 Crawshaw
3,424,459 A 1/1969 Evancho
3,524,646 A 8/1970 Wheeler
3,742,533 A 7/1973 Brunette
3,829,092 A 8/1974 Arkin
3,840,231 A 10/1974 Moore
3,848,737 A 11/1974 Kenon
3,891,212 A 6/1975 Hill
3,893,670 A 7/1975 Franchi
4,253,666 A 3/1981 Murphy
4,306,721 A 12/1981 Doyle
4,340,227 A 7/1982 Dopkowski
4,498,673 A 2/1985 Swanson
4,506,888 A 3/1985 Nardozzi, Jr.
4,664,382 A 5/1987 Palmer et al.
4,852,782 A 8/1989 Wu et al.
4,854,582 A 8/1989 Yamada
4,895,368 A 1/1990 Geiger
4,943,059 A 7/1990 Morell
4,948,132 A 8/1990 Wharton
5,039,098 A 8/1991 Pelz
5,133,553 A 7/1992 Divnick
5,178,394 A 1/1993 Tanampai
5,184,819 A 2/1993 Desbiolles
5,255,914 A 10/1993 Schroder
5,275,408 A 1/1994 Desbiolles et al.
5,280,923 A 1/1994 Lu
5,365,811 A 11/1994 Chi
5,433,442 A 7/1995 Walker
5,513,844 A 5/1996 Ashcraft et al.
5,533,725 A 7/1996 Reynolds, Jr.
5,540,435 A 7/1996 Kawasaki
5,542,666 A 8/1996 Chou
5,588,921 A 12/1996 Parsick
5,601,149 A 2/1997 Kawasaki et al.
5,626,528 A 5/1997 Toulon
5,645,500 A 7/1997 Borden
5,653,645 A 8/1997 Baumann
5,688,188 A 11/1997 Chappell
5,702,310 A 12/1997 Wozny
5,722,901 A 3/1998 Barron et al.
5,749,790 A 5/1998 Van Alen, II et al.
5,807,186 A 9/1998 Chen
5,839,973 A 11/1998 Jackson
5,851,155 A 12/1998 Wood et al.
5,863,260 A 1/1999 Butler, Jr. et al.
5,906,549 A 5/1999 Kubica
5,931,742 A 8/1999 Nishimura et al.
5,951,411 A 9/1999 Wood et al.
6,039,659 A 3/2000 Hamm
6,110,055 A 8/2000 Wilson
6,120,384 A 9/2000 Drake
6,149,533 A 11/2000 Finn
6,251,028 B1 6/2001 Jackson
6,270,425 B1 8/2001 Dyer
6,273,828 B1 8/2001 Wood et al.
6,287,214 B1 9/2001 Satoh
6,352,483 B1 3/2002 Okoshi
6,368,230 B1 4/2002 Helmstetter et al.
6,371,865 B1 4/2002 Magliulo
6,371,866 B1 4/2002 Rivera
6,447,404 B1 9/2002 Wilbur
6,475,100 B1 11/2002 Helmstetter et al.
6,478,691 B2 11/2002 Okoshi
6,514,154 B1 2/2003 Finn
6,547,673 B2 4/2003 Roark
6,569,029 B1 5/2003 Hamburger
6,575,843 B2 6/2003 McCabe
6,620,053 B2 9/2003 Tseng
6,634,957 B2 10/2003 Tseng
6,669,573 B2 12/2003 Wood et al.
6,746,341 B1 6/2004 Hamric, Jr. et al.
6,764,413 B2 7/2004 Ho
6,769,994 B2 8/2004 Boone
6,769,996 B2 8/2004 Tseng
RE38,605 E 9/2004 Kubica et al.
6,789,304 B2 9/2004 Kouno
6,849,002 B2 2/2005 Rice
6,857,969 B2 2/2005 Rice
6,890,269 B2 5/2005 Burrows
6,899,636 B2 5/2005 Finn
6,926,616 B1 8/2005 Kusumoto et al.
6,966,847 B2 11/2005 Lenhof et al.
6,997,818 B2 2/2006 Kouno
7,014,569 B1 3/2006 Figgers
7,083,529 B2 8/2006 Cackett et al.
7,115,046 B1 10/2006 Evans
D537,896 S * 3/2007 Holt et al. ..... D21/759
7,241,229 B2 7/2007 Poynor
7,300,359 B2 11/2007 Hocknell et al.
7,316,622 B1 1/2008 Lucas
7,326,126 B2 2/2008 Holt et al.
7,335,113 B2 2/2008 Hocknell et al.
7,344,449 B2 3/2008 Hocknell et al.
7,354,353 B2 4/2008 Hocknell et al.
7,387,577 B2 6/2008 Murphy et al.
7,410,426 B2 8/2008 Willett et al.
7,427,239 B2 9/2008 Hocknell et al.
7,465,239 B2 12/2008 Hocknell et al.
7,476,160 B2 1/2009 Hocknell et al.
D588,661 S 3/2009 Lee
D588,662 S 3/2009 Lee
D588,663 S * 3/2009 Lee ..... D21/759
D588,664 S * 3/2009 Lee ..... D21/759
7,699,717 B2 4/2010 Morris et al.
7,704,155 B2 4/2010 Bennett et al.
7,789,769 B2 9/2010 Sugimoto
7,846,041 B2 12/2010 Beach et al.
7,874,934 B2 1/2011 Soracco et al.
7,878,921 B2 2/2011 Bennett et al.
7,887,431 B2 2/2011 Beach et al.
7,922,599 B2 4/2011 Yamamoto
8,025,587 B2 9/2011 Beach et al.
2001/0007835 A1 7/2001 Baron
2002/0037773 A1 3/2002 Wood et al.
2003/0008723 A1 1/2003 Goodman
2004/0018886 A1 1/2004 Burrows
2004/0018887 A1 1/2004 Burrows
2004/0063515 A1 4/2004 Boone
2005/0049067 A1 3/2005 Hsu
2005/0049072 A1 3/2005 Burrows
2005/0079923 A1 4/2005 Droppleman
2006/0105855 A1 5/2006 Cackett et al.
2006/0287125 A1 12/2006 Hocknell et al.
2007/0078026 A1 4/2007 Holt et al.
2007/0099719 A1 5/2007 Halleck et al.
2007/0105655 A1 5/2007 Beach et al.
2007/0117645 A1* 5/2007 Nakashima ..... 473/288
2007/0254746 A1 11/2007 Poynor
2007/0265106 A1 11/2007 Burrows
2008/0058114 A1* 3/2008 Hocknell et al. ..... 473/309
2008/0076590 A1 3/2008 Hsu
2008/0102982 A1 5/2008 Wahl et al.
2008/0119301 A1 5/2008 Holt et al.
2008/0254908 A1 10/2008 Bennett et al.
2008/0254909 A1 10/2008 Callinan et al.
2008/0280693 A1 11/2008 Chai
2009/0011848 A1 1/2009 Thomas et al.
2009/0011849 A1 1/2009 Thomas et al.
2009/0011850 A1 1/2009 Stites et al.
2009/0062029 A1 3/2009 Stites et al.
2009/0075749 A1 3/2009 De La Cruz et al.
2009/0118034 A1 5/2009 Yokota
2009/0143167 A1 6/2009 Evans
2009/0197699 A1 8/2009 Morris et al.
2009/0221381 A1 9/2009 Breier et al.
2009/0239676 A1 9/2009 Bennett et al.
2009/0239677 A1 9/2009 Deshiell et al.
2009/0247316 A1 10/2009 De La Cruz et al.
2010/0197422 A1 8/2010 Thomas et al.

| | | | |
|---|---|---|---|
| 2010/0261543 | A1 | 10/2010 | Breier et al. |
| 2010/0292018 | A1 | 11/2010 | Cackett et al. |
| 2011/0118046 | A1 | 5/2011 | Bennett et al. |

FOREIGN PATENT DOCUMENTS

| | | | | |
|---|---|---|---|---|
| GB | 2225725 | | | 6/1990 |
| GB | 2241173 | | | 8/1991 |
| JP | SHO 51/057768 | | | 10/1974 |
| JP | 3-13175 | | | 3/1991 |
| JP | 4156869 | | | 5/1992 |
| JP | 6-41566 | | | 6/1994 |
| JP | 7-237152 | | | 9/1995 |
| JP | 8318008 | | | 12/1996 |
| JP | 9164227 | | | 6/1997 |
| JP | 9-108387 | | | 9/1997 |
| JP | 11-337453 | | | 12/1999 |
| JP | 2000005349 | | | 1/2000 |
| JP | 2003-062131 | | | 3/2003 |
| JP | 2003-70940 | | | 3/2003 |
| JP | 2003-245866 | | | 9/2003 |
| JP | 2005-533626 | A | | 11/2005 |
| JP | 2006-034906 | | | 2/2006 |
| JP | 2006-042951 | | | 2/2006 |
| JP | 2008029691 | A | * | 2/2008 |
| JP | 4177414 | B | | 8/2008 |
| JP | 2008-272274 | A | | 11/2008 |
| JP | 2008-272496 | A | | 11/2008 |
| JP | 2009112800 | A | | 5/2009 |
| JP | 2009-136608 | A | | 6/2009 |
| TW | 139608 | | | 8/1990 |
| WO | WO2004/009186 | | | 1/2004 |
| WO | WO2006/018929 | | | 2/2006 |
| WO | WO2006/055386 | | | 5/2006 |
| WO | WO 2009/035345 | | | 3/2009 |

OTHER PUBLICATIONS

"Mickey Finn T-Bar Putter—The Mickey Finn Golf Putter," Oct. 20, 2004 (http://www.mickeyfinngolf.com/Default/asp) (1 page).

"Charles A. "Mickey" Finn, Mickey Finn Tom Clancy the Cardinal of the Kremlin," Oct. 20, 2004 (http://www.mickeyfinngolf.com/mickeyfinngolf.asp) (2 pages).

"Mickey Finn M-2 T-Bar Putter & Mickey Finn M-3 T-Bar Putter," Oct. 20, 2004 (http://www.mickeyfinngolf.com/putters.asp) (3 pages).

Photographs of S-God Fairway Club (3 pages).

Office Action from the United States Patent & Trademark Office in co-pending U.S. Appl. No. 12/346,752, dated Feb. 7, 2011.

Notice of Allowance from the United States Patent & Trademark Office in co-pending U.S. Appl. No. 12/346,752 dated May 25, 2011.

Notice of Allowance from the United States Patent & Trademark Office in co-pending U.S. Appl. No. 12/346,747 dated Oct. 6, 2010.

Screen Shots from website www.plazagolf.net, printed on May 9, 2011 (5 pages).

Office Action from the United States Patent & Trademark Office in pending U.S. Appl. No. 12/474,973, dated Oct. 26, 2011.

Office Action from the United States Patent & Trademark Office in pending U.S. Appl. No. 13/224,222, dated Dec. 6, 2011.

Third Party Comments filed with Japanese Patent Office in Japanese Appl. No. JP2009-114623 on Oct. 31, 2011 (2 pages).

English translation of Office Action from the Japanese Patent Office in pending Japanese Appl No. JP2009-114623, Aug. 30, 2011 (4 pages).

English translation of Third Party Comments filed with Japanese Patent Office in Japanese Appl. No. JP2009-114623 on Oct. 31, 2011 (3 pages).

Notice of Allowance from the United States Patent & Trademark Office in co-pending U.S. Appl. No. 13/077,825 dated Dec. 21, 2011.

Office Action from the United States Patent & Trademark Office in pending U.S. Appl. No. 13/305,514, dated Jan. 20, 2012.

Office Action from the United States Patent & Trademark Office in pending U.S. Appl. No. 12/474,973, dated Feb. 28, 2012.

Office Action from the United States Patent & Trademark Office in pending U.S. Appl. No. 12/687,003, dated Mar. 6, 2012.

Notice of Allowance from the United States Patent & Trademark Office in co-pending U.S. Appl. No. 13/224,222 dated Mar. 20, 2012.

Notice of Allowance from the United States Patent & Trademark Office in co-pending U.S. Appl. No. 13/305,514 dated Mar. 27, 2012.

English translation of Office Action from the Japanese Patent Office in pending Japanese Appl. No. 2009-114623 from Apr. 23, 2012 (9 pages).

Notice of Allowance from the United States Patent & Trademark Office in co-pending U.S. Appl. No. 12/687,003, dated Jun. 27, 2012.

* cited by examiner

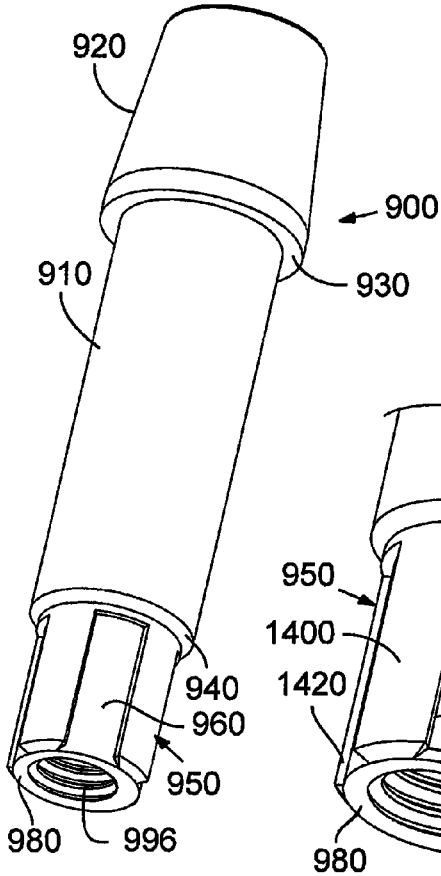
FIG. 21
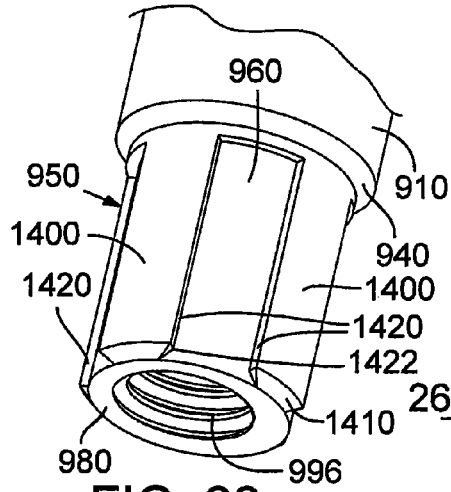
FIG. 22
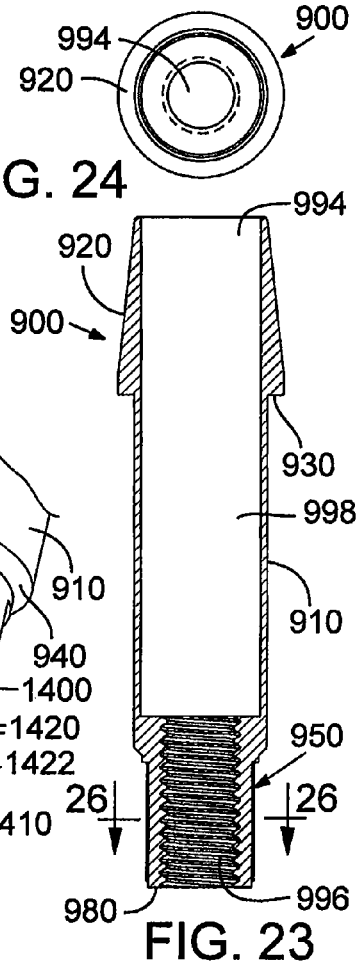
FIG. 23
FIG. 24
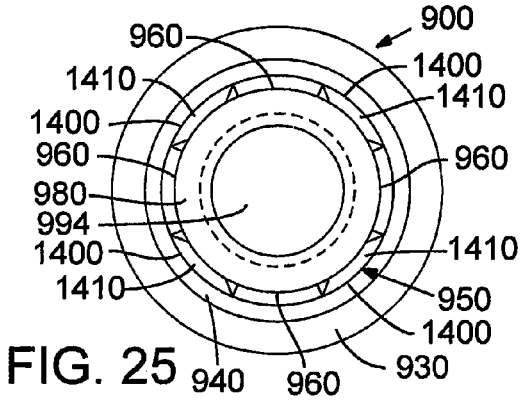
FIG. 25
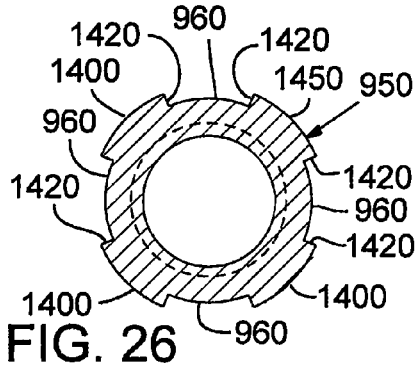
FIG. 26

GOLF CLUB

CROSS-REFERENCE TO RELATED APPLICATIONS

The present application is a divisional application of U.S. application Ser. No. 12/346,747, filed Dec. 30, 2008, now U.S. Pat. No. 7,887,431, which claims the benefit of U.S. Provisional Application No. 61/054,085, filed on May 16, 2008, both of which applications are incorporated herein by reference.

FIELD

The present application is directed to embodiments of a golf club, particularly a golf club head that is removably attachable to a golf club shaft.

BACKGROUND

For a given type of golf club (e.g., driver, iron, putter, wedge), the golfing consumer has a wide variety of variations to choose from. This variety is driven, in part, by the wide range in physical characteristics and golfing skill among golfers and by the broad spectrum of playing conditions that a golfer may encounter. For example, taller golfers require clubs with longer shafts; more powerful golfers or golfers playing in windy conditions or on a course with firm fairways may desire clubs having less shaft flex (greater stiffness); and a golfer may desire a club with certain playing characteristics to overcome a tendency in their swing (e.g., a golfer who has a tendency to hit low-trajectory shots may want to purchase a club with a greater loft angle). Variations in shaft flex, loft angle and handedness (i.e., left or right) alone account for 24 variations of the TaylorMade r7 460 driver.

Having such a large number of variations available for a single golf club, golfing consumers can purchase clubs with club head-shaft combinations that suit their needs. However, shafts and club heads are generally manufactured separately, and once a shaft is attached to a club head, usually by an adhesive, replacing either the club head or shaft is not easily done by the consumer. Motivations for modifying a club include a change in a golfer's physical condition (e.g., a younger golfer has grown taller), an increase the golfer's skill or to adjust to playing conditions. Typically, these modifications must be made by a technician at a pro shop. The attendant cost and time spent without clubs may dissuade golfers from modifying their clubs as often as they would like, resulting in a less-than-optimal golfing experience. Thus, there has been effort to provide golf clubs that are capable of being assembled and disassembled by the golfing consumer.

To that end, golf clubs having club heads that are removably attached to a shaft by a mechanical fastener are known in the art. For example, U.S. Pat. No. 7,083,529 to Cackett et al. (hereinafter, "Cackett") discloses a golf club with interchangeable head-shaft connections. The connection includes a tube, a sleeve and a mechanical fastener. The sleeve is mounted on a tip end of the shaft. The shaft with the sleeve mounted thereon is then inserted in the tube, which is mounted in the club head. The mechanical fastener secures the sleeve to the tube to retain the shaft in connection with the club head. The sleeve has a lower section that includes a keyed portion which has a configuration that is complementary to the keyway defined by a rotation prevention portion of the tube. The keyway has a non-circular cross-section to prevent rotation of the sleeve relative to the tube. The keyway may have a plurality of splines, or a rectangular or hexagonal cross-section.

While removably attachable golf club heads of the type represented by Cackett provide golfers with the ability to disassemble a club head from a shaft, it is necessary that they also provide club head-shaft interconnections that have the integrity and rigidity of conventional club head-shaft interconnection. For example, the manner in which rotational movement between the constituent components of a club head—shaft interconnection is restricted must have sufficient load-bearing areas and resistance to stripping. Consequently, there is room for improvement in the art.

SUMMARY

In a representative embodiment, a golf club shaft assembly for attaching to a club head comprises a shaft having a lower end portion and a sleeve mounted on the lower end portion of the shaft. The sleeve can be configured to be inserted into a hosel opening of the club head. The sleeve has an upper portion defining an upper opening that receives the lower end portion of the shaft and a lower portion having eight, longitudinally extending, angularly spaced external splines located below the shaft and adapted to mate with complimentary splines in the hosel opening. The lower portion defines a longitudinally extending, internally threaded opening adapted to receive a screw for securing the shaft assembly to the club head when the sleeve is inserted in the hosel opening.

In another representative embodiment, a method of assembling a golf club shaft and a golf club head is provided. The method comprises mounting a sleeve onto a tip end portion of the shaft, the sleeve having a lower portion having eight external splines protruding from an external surface and located below a lower end of the shaft, the external splines having a configuration complementary to internal splines located in a hosel opening in the club head. The method further comprises inserting the sleeve into the hosel opening so that the external splines of the sleeve lower portion engage the internal splines of the hosel opening, and inserting a screw through an opening in the sole of the club head and into a threaded opening in the sleeve and tightening the screw to secure the shaft to the club head.

In another representative embodiment, a removable shaft assembly for a golf club having a hosel defining a hosel opening comprises a shaft having a lower end portion. A sleeve can be mounted on the lower end portion of the shaft and can be configured to be inserted into the hosel opening of the club head. The sleeve has an upper portion defining an upper opening that receives the lower end portion of the shaft and a lower portion having a plurality of longitudinally extending, angularly spaced external splines located below the shaft and adapted to mate with complimentary splines in the hosel opening. The lower portion defines a longitudinally extending, internally threaded opening adapted to receive a screw for securing the shaft assembly to the club head when the sleeve is inserted in the hosel opening. The upper portion of the sleeve has an upper thrust surface that is adapted to engage the hosel of the club head when the sleeve is inserted into the hosel opening, and the sleeve and the shaft have a combined axial stiffness from the upper thrust surface to a lower end of the sleeve of less than about $1.87\times10^8$ N/m.

In another representative embodiment, a golf club assembly comprises a club head having a hosel defining an opening having a non-circular inner surface, the hosel defining a longitudinal axis. A removable adapter sleeve is configured to be received in the hosel opening, the sleeve having a non-circular outer surface adapted to mate with the non-circular inner surface of the hosel to restrict relative rotation between the adapter sleeve and the hosel. The adapter sleeve has a longitudinally extending opening and a non-circular inner surface in the opening, the adapter sleeve also having a longitudinal axis that is angled relative to the longitudinal axis of the hosel at a predetermined, non-zero angle. The golf club assembly also comprises a shaft having a lower end portion and a shaft sleeve mounted on the lower end portion of the shaft and adapted to be received in the opening of the adapter sleeve. The shaft sleeve has a non-circular outer surface adapted to mate with the non-circular inner surface of the adapter sleeve to restrict relative rotation between the shaft sleeve and the adapter sleeve. The shaft sleeve defines a longitudinal axis that is aligned with the longitudinal axis of the adapter sleeve such that the shaft sleeve and the shaft are supported at the predetermined angle relative to the longitudinal axis of the hosel.

In another representative embodiment, a golf club assembly comprises a club head having a hosel defining an opening housing a rotation prevention portion, the hosel defining a longitudinal axis. The assembly also comprises a plurality of removable adapter sleeves each configured to be received in the hosel opening, each sleeve having a first rotation prevention portion adapted to mate with the rotation prevention portion of the hosel to restrict relative rotation between the adapter sleeve and the hosel. Each adapter sleeve has a longitudinally extending opening and a second rotation prevention portion in the opening, wherein each adapter sleeve has a longitudinal axis that is angled relative to the longitudinal axis of the hosel at a different predetermined angle. The assembly further comprises a shaft having a lower end portion and a shaft sleeve mounted on the lower end portion of the shaft and adapted to be received in the opening of each adapter sleeve. The shaft sleeve has a respective rotation prevention portion adapted to mate with the second rotation prevention portion of each adapter sleeve to restrict relative rotation between the shaft sleeve and the adapter sleeve in which the shaft sleeve is in inserted. The shaft sleeve defines a longitudinal axis and is adapted to be received in each adapter sleeve such that the longitudinal axis of the shaft sleeve becomes aligned with the longitudinal axis of the adapter sleeve in which it is inserted.

In another representative embodiment, a method of assembling a golf shaft and golf club head having a hosel opening defining a longitudinal axis is provided. The method comprises selecting an adapter sleeve from among a plurality of adapter sleeves, each having an opening adapted to receive a shaft sleeve mounted on the lower end portion of the shaft, wherein each adapter sleeve is configured to support the shaft at a different predetermined orientation relative to the longitudinal axis of the hosel opening. The method further comprises inserting the shaft sleeve into the selected adapter sleeve, inserting the selected adapter sleeve into the hosel opening of the club head, and securing the shaft sleeve, and therefore the shaft, to the club head with the selected adapter sleeve disposed on the shaft sleeve.

In yet another representative embodiment, a golf club head comprises a body having a striking face defining a forward end of the club head, the body also having a read end opposite the forward end. The body also comprises an adjustable sole portion having a rear end and a forward end pivotably connected to the body at a pivot axis, the sole portion being pivotable about the pivot axis to adjust the position of the sole portion relative to the body.

In still another representative embodiment, a golf club assembly comprises a golf club head comprising a body having a striking face defining a forward end of the club head. The body also has a read end opposite the forward end, and a hosel having a hosel opening. The body further comprises an adjustable sole portion having a rear end and a forward end pivotably connected to the body at a pivot axis. The sole portion is pivotable about the pivot axis to adjust the position of the sole portion relative to the body. The assembly further comprises a removable shaft and a removable sleeve adapted to be received in the hosel opening and having a respective opening adapted to receive a lower end portion of the shaft and support the shaft relative to the club head at a desired orientation. A mechanical fastener is adapted to releasably secure the shaft and the sleeve to the club head.

In another representative embodiment, a method of adjusting playing characteristics of a golf club comprises adjusting the square loft of the club by adjusting the orientation of a shaft of the club relative to a club head of the club, and adjusting the face angle of the club by adjusting the position of a sole of the club head relative to the club head body.

The foregoing and other features and advantages of the invention will become more apparent from the following detailed description, which proceeds with reference to the accompanying figures.

BRIEF DESCRIPTION OF THE DRAWINGS

FIG. 21 is a perspective view of the shaft sleeve of the connection assembly shown in FIG. 18.

FIG. 22 is an enlarged perspective view of the lower portion of the shaft sleeve of FIG. 21.

FIG. 23 is a cross-sectional view of the shaft sleeve of FIG. 21.

FIG. 24 is a top plan view of the shaft sleeve of FIG. 21.

FIG. 25 is a bottom plan view of the shaft sleeve of FIG. 21.

FIG. 26 is a cross-sectional view of the shaft sleeve, taken along line 26-26 of FIG. 23.

DETAILED DESCRIPTION

Figure 1A:
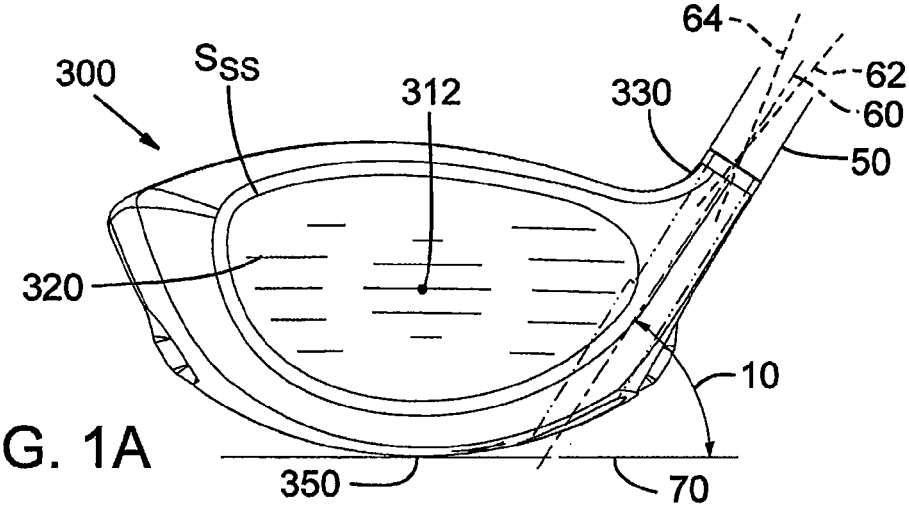
FIG. 1A is a front elevational view of a golf club head in accordance with one embodiment.

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

Referring first to FIGS. 1A-1D, there is shown characteristic angles of golf clubs by way of reference to a golf club head 300 having a removable shaft 50, according to one embodiment. The club head 300 comprises a centerface, or striking face, 310, scorelines 320, a hosel 330 having a hosel opening 340, and a sole 350. The hosel 330 has a hosel longitudinal axis 60 and the shaft 50 has a shaft longitudinal axis. In the illustrated embodiment, the ideal impact location 312 of the golf club head 300 is disposed at the geometric center of the striking surface 310 (see FIG. 1A). The ideal impact location 312 is typically defined as the intersection of the midpoints of a height ($H_{ss}$) and width ($W_{ss}$) of the striking surface 310.

Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body (see e.g., FIG. 1). In the illustrated example, $H_{ss}$ is the distance from the periphery proximate the sole portion of $S_{ss}$ to the perhiphery proximate the crown portion of $S_{ss}$ measured in a vertical plane (perpendicular to ground) that extends through the geometric center of the face. Similarly, $W_{ss}$ is the distance from the periphery proximate the heel portion of $S_{ss}$ to the periphery proximate the toe portion of $S_{ss}$ measured in a horizontal plane (e.g., substantially parallel to ground) that extends through the geometric center of the face. See USGA "Procedure for Measuring the Flexibility of a Golf Clubhead," Revision 2.0 for the methodology to measure the geometric center of the striking face.

As shown in FIG. 1A, a lie angle 10 (also referred to as the "scoreline lie angle") is defined as the angle between the hosel longitudinal axis 60 and a playing surface 70 when the club is in the grounded address position. The grounded address position is defined as the resting position of the head on the playing surface when the shaft is supported at the grip (free to rotate about its axis) and the shaft is held at an angle to the ground such that the scorelines 320 are horizontal (if the club does not have scorelines, then the lie shall be set at 60-degrees). The centerface target line vector is defined as a horizontal vector which is perpendicular to the shaft when the club is in the address position and points outward from the centerface point. The target line plane is defined as a vertical plane which contains the centerface target line vector. The square face address position is defined as the head position when the sole is lifted off the ground, and the shaft is held (both positionally and rotationally) such that the scorelines are horizontal and the centerface normal vector completely lies in the target line plane (if the head has no scorelines, then the shaft shall be held at 60-degrees relative to ground and then the head rotated about the shaft axis until the centerface normal vector completely lies in the target line plane). The actual, or measured, lie angle can be defined as the angle 10 between the hosel longitudinal axis 60 and the playing surface 70, whether or not the club is held in the grounded address position with the scorelines horizontal. Studies have shown that most golfers address the ball with actual lie angle that is 10 to 20 degrees less than the intended scoreline lie angle 10 of the club. The studies have also shown that for most golfers the actual lie angle at impact is between 0 and 10 degrees less than the intended scoreline lie angle 10 of the club.

Figure 1B:
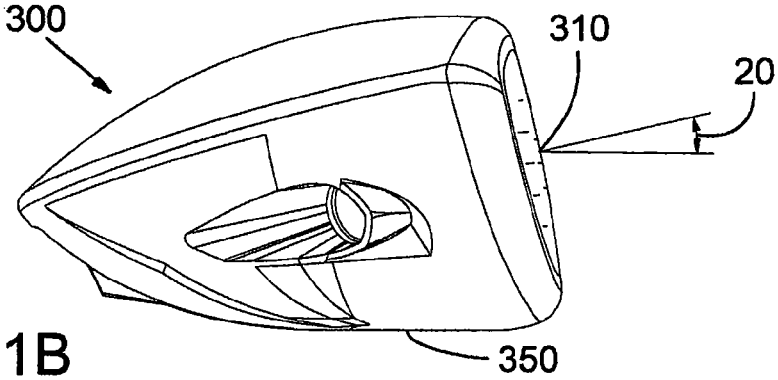
FIG. 1B is a side elevational view of the golf club head of FIG. 1A.

As shown in FIG. 1B, a loft angle 20 of the club head (referred to as "square loft") is defined as the angle between the centerface normal vector and the ground plane when the head is in the square face address position. As shown in FIG. 1D, a hosel loft angle 72 is defined as the angle between the hosel longitudinal axis 60 projected onto the target line plane and a plane 74 that is tangent to the center of the centerface. The shaft loft angle is the angle between plane 74 and the longitudinal axis of the shaft 50 projected onto the target line plane. The "grounded loft" 80 of the club head is the vertical angle of the centerface normal vector when the club is in the grounded address position (i.e., when the sole 350 is resting on the ground), or stated differently, the angle between the plane 74 of the centerface and a vertical plane when the club is in the grounded address position.

Figure 1C:
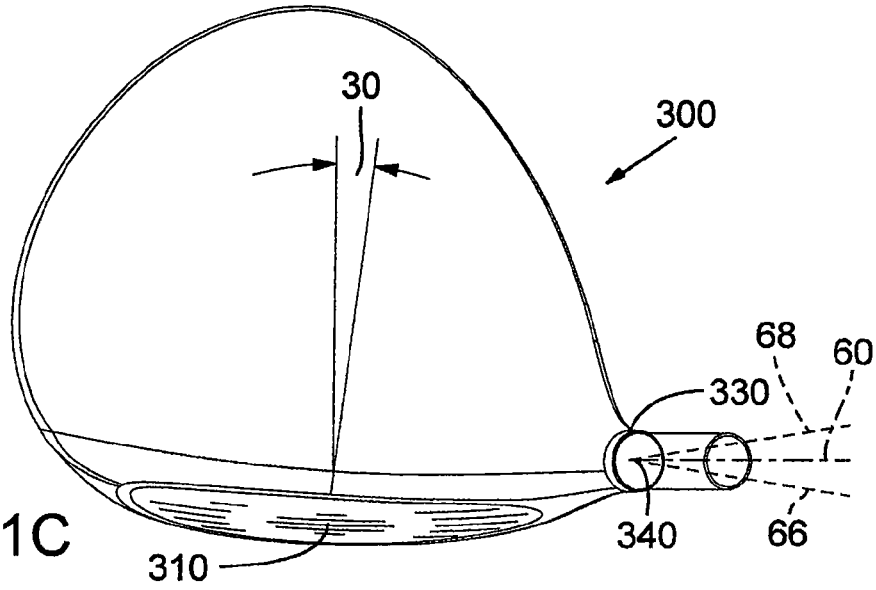
FIG. 1C is a top plan view of the golf club head of FIG. 1A.
Figure 1D:
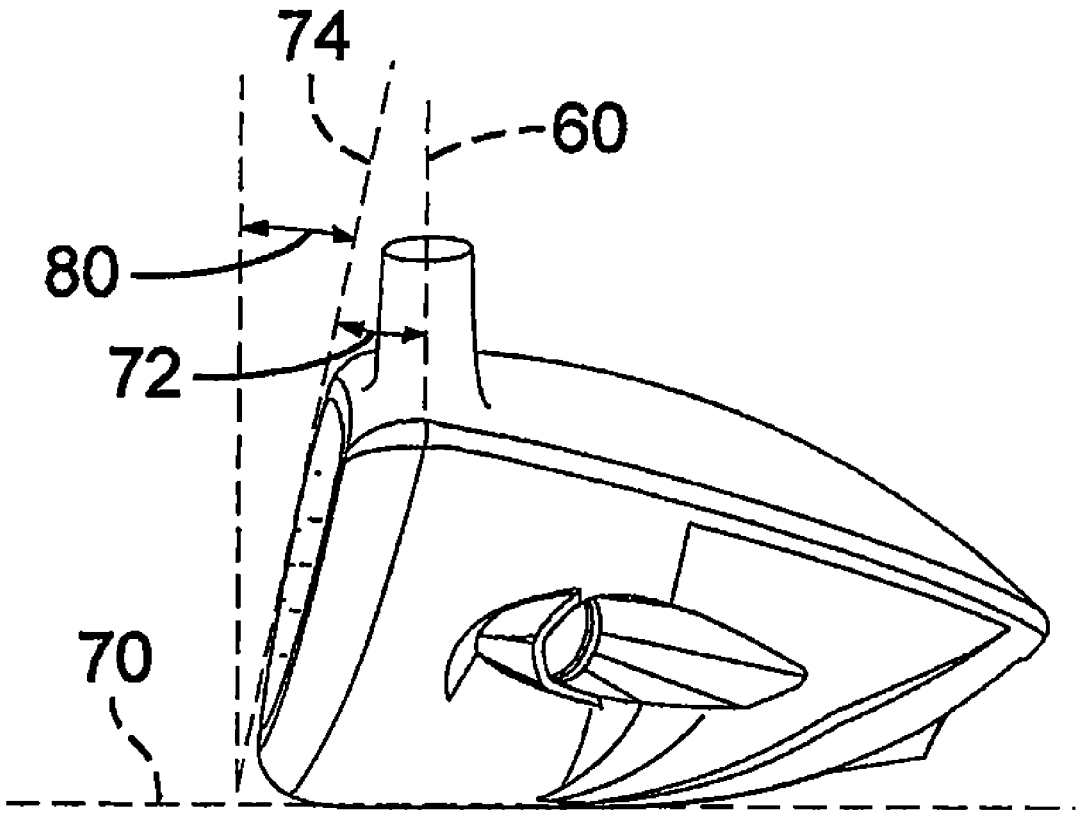
FIG. 1D is a side elevational view of the golf club head of FIG. 1A.

As shown in FIG. 1C, a face angle 30 is defined by the horizontal component of the centerface normal vector and a vertical plane ("target line plane") that is normal to the vertical plane which contains the shaft longitudinal axis when the shaft 50 is in the correct lie (i.e., typically 60 degrees+/−5 degrees) and the sole 350 is resting on the playing surface 70 (the club is in the grounded address position).

The lie angle 10 and/or the shaft loft can be modified by adjusting the position of the shaft 50 relative to the club head. Traditionally, adjusting the position of the shaft has been accomplished by bending the shaft and the hosel relative to the club head. As shown in FIG. 1A, the lie angle 10 can be increased by bending the shaft and the hosel inward toward the club head 300, as depicted by shaft longitudinal axis 64. The lie angle 10 can be decreased by bending the shaft and the hosel outward from the club head 300, as depicted by shaft longitudinal axis 62. As shown in FIG. 1C, bending the shaft and the hosel forward toward the striking face 310, as depicted by shaft longitudinal axis 66, increases the shaft loft. Bending the shaft and the hosel rearward toward the rear of the club head, as depicted by shaft longitudinal axis 68, decreases the shaft loft. It should be noted that in a conventional club the shaft loft typically is the same as the hosel loft because both the shaft and the hosel are bent relative to the club head. In certain embodiments disclosed herein, the position of the shaft can be adjusted relative to the hosel to adjust shaft loft. In such cases, the shaft loft of the club is adjusted while the hosel loft is unchanged.

Adjusting the shaft loft is effective to adjust the square loft of the club by the same amount. Similarly, when shaft loft is adjusted and the club head is placed in the address position, the face angle of the club head increases or decreases in proportion to the change in shaft loft. Hence, shaft loft is adjusted to effect changes in square loft and face angle. In addition, the shaft and the hosel can be bent to adjust the lie angle and the shaft loft (and therefore the square loft and the face angle) by bending the shaft and the hosel in a first direction inward or outward relative to the club head to adjust the lie angle and in a second direction forward or rearward relative to the club head to adjust the shaft loft.

Head-Shaft Connection Assembly

Figure 2:
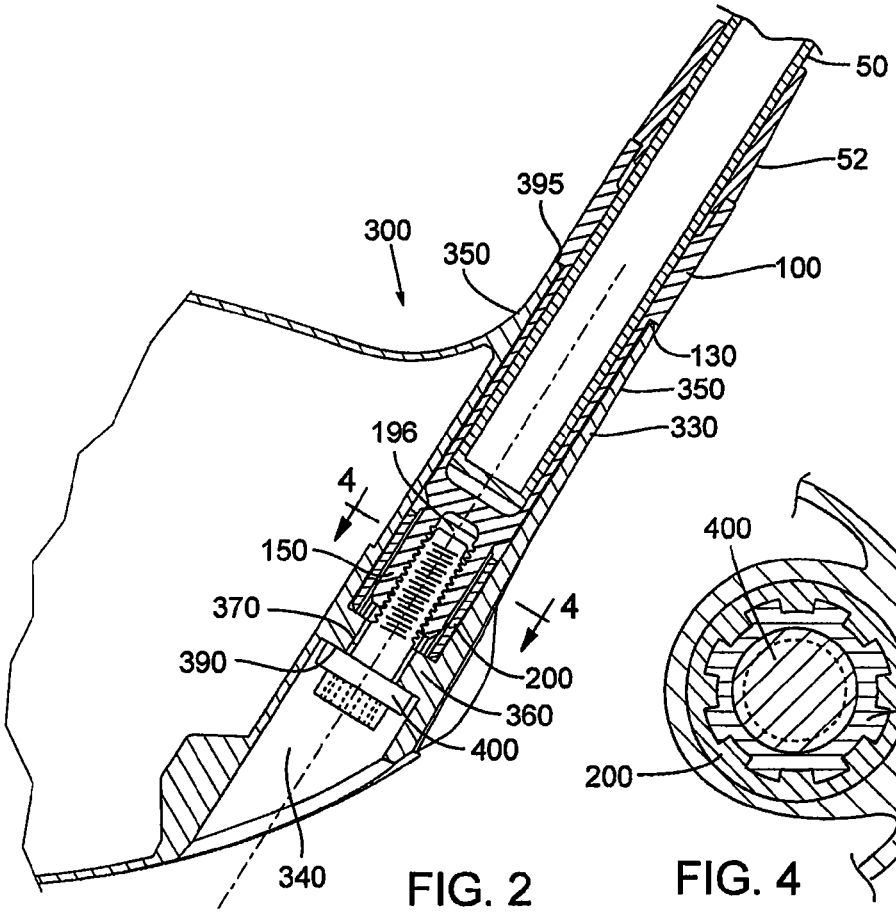
FIG. 2 is a cross-sectional view of a golf club head having a removable shaft, in accordance with one embodiment.
Figure 4:
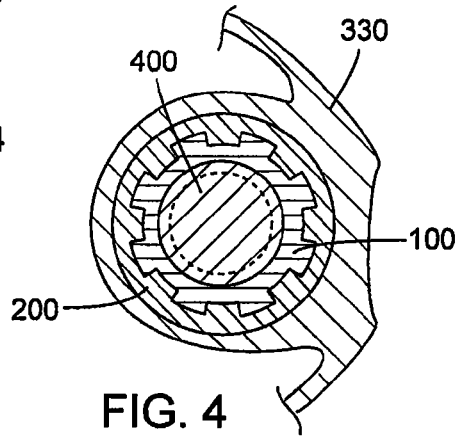
FIG. 4 is a cross-sectional view of the golf club head of FIG. 2, taken along the line 4-4 of FIG. 2.
Figure 3:
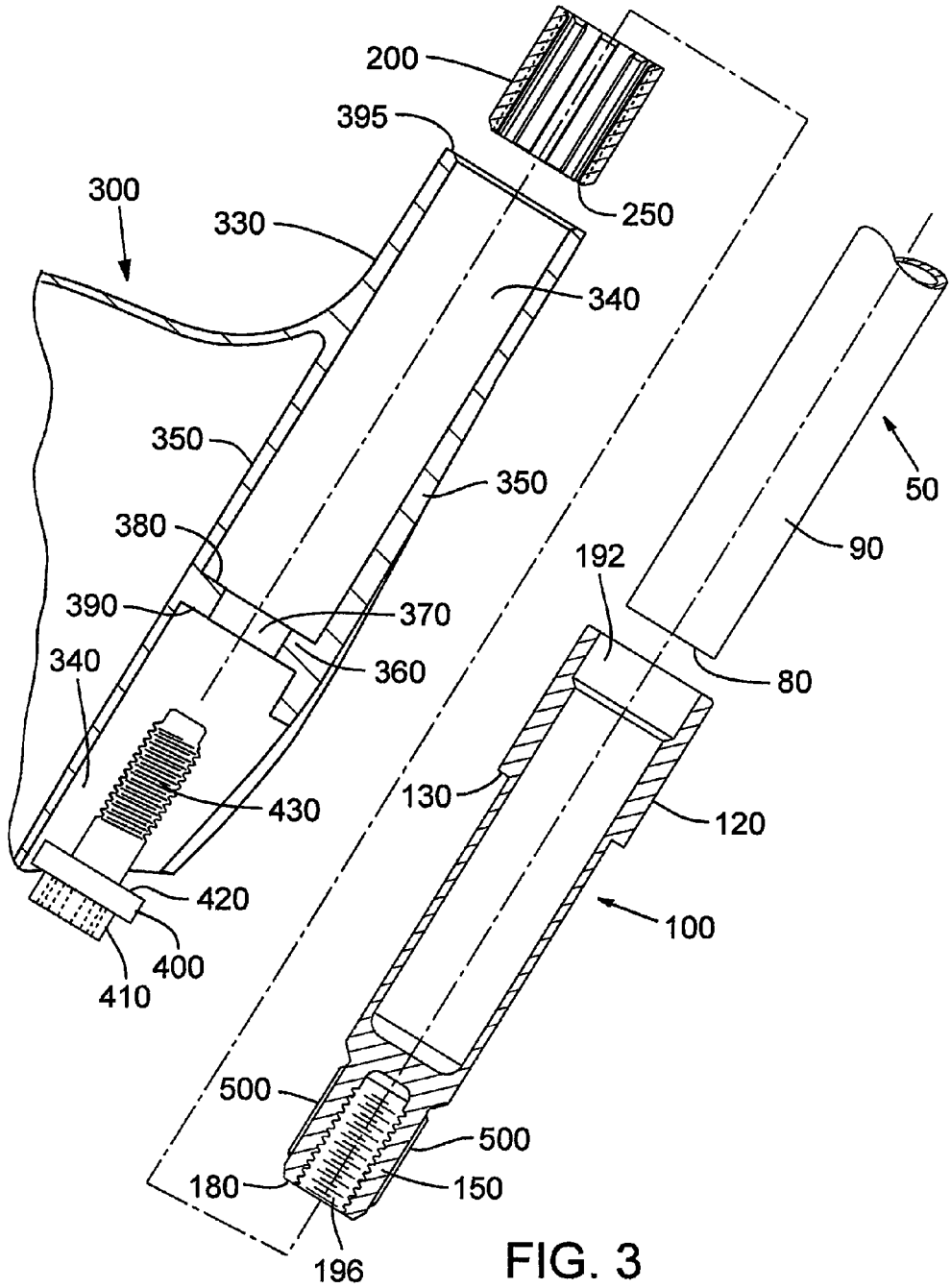
FIG. 3 is an exploded cross-sectional view of the shaft-club head connection assembly of FIG. 2.

Now with reference to FIGS. 2-4, there is shown a golf club comprising a golf club head 300 attached to a golf club shaft 50 via a removable head-shaft connection assembly, which generally comprises in the illustrated embodiment a shaft sleeve 100, a hosel insert 200 and a screw 400. The club head 300 is formed with a hosel opening, or passageway, 340 that extends from the hosel 330 through the club head and opens at the sole, or bottom surface, of the club head. Generally, the club head 300 is removably attached to the shaft 50 by the sleeve 100 (which is mounted to the lower end portion of the shaft 50) by inserting the sleeve 100 into the hosel opening 340 and the hosel insert 200 (which is mounted inside the hosel opening 340), and inserting the screw 400 upwardly through the opening in the sole and tightening the screw into a threaded opening of the sleeve, thereby securing the club head 300 to the sleeve 100.

By way of example, the club head 300 comprises the head of a "wood-type" golf club. All of the embodiments disclosed in the present specification can be implemented in all types of golf clubs, including but not limited to, drivers, fairway woods, utility clubs, putters, wedges, etc.

As used herein, a shaft that is "removably attached" to a club head means that the shaft can be connected to the club head using one or more mechanical fasteners, such as a screw or threaded ferrule, without an adhesive, and the shaft can be disconnected and separated from the head by loosening or removing the one or more mechanical fasteners without the need to break an adhesive bond between two components.

The sleeve 100 is mounted to a lower, or tip end portion 90 of the shaft 50. The sleeve 100 can be adhesively bonded, welded or secured in equivalent fashion to the lower end portion of the shaft 50. In other embodiments, the sleeve 100 may be integrally formed as part of the shaft 50. As shown in FIG. 2, a ferrule 52 can be mounted to the end portion 90 of the shaft just above shaft sleeve 100 to provide a smooth transition between the shaft sleeve and the shaft and to conceal the glue line between the shaft and the sleeve. The ferrule also helps minimize tip breakage of the shaft.

As best shown in FIG. 3, the hosel opening 340 extends through the club head 300 and has hosel sidewalls 350. A flange 360 extends radially inward from the hosel sidewalls 350 and forms the bottom wall of the hosel opening. The flange defines a passageway 370, a flange upper surface 380 and a flange lower surface 390. The hosel insert 200 can be mounted within the hosel opening 340 with a bottom surface 250 of the insert contacting the flange upper surface 380. The hosel insert 200 can be adhesively bonded, welded, brazed or secured in another equivalent fashion to the hosel sidewalls 350 and/or the flange to secure the insert 200 in place. In other embodiments, the hosel insert 200 can be formed integrally with the club head 300 (e.g., the insert can be formed and/or machined directly in the hosel opening).

Figure 5:
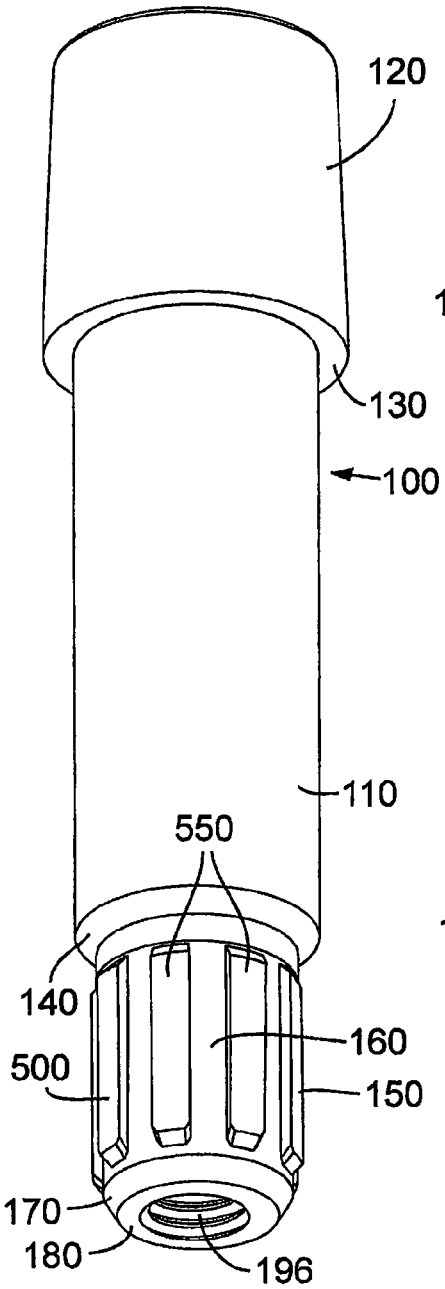
FIG. 5 is a perspective view of the shaft sleeve of the connection assembly shown in FIG. 2.
Figure 6:
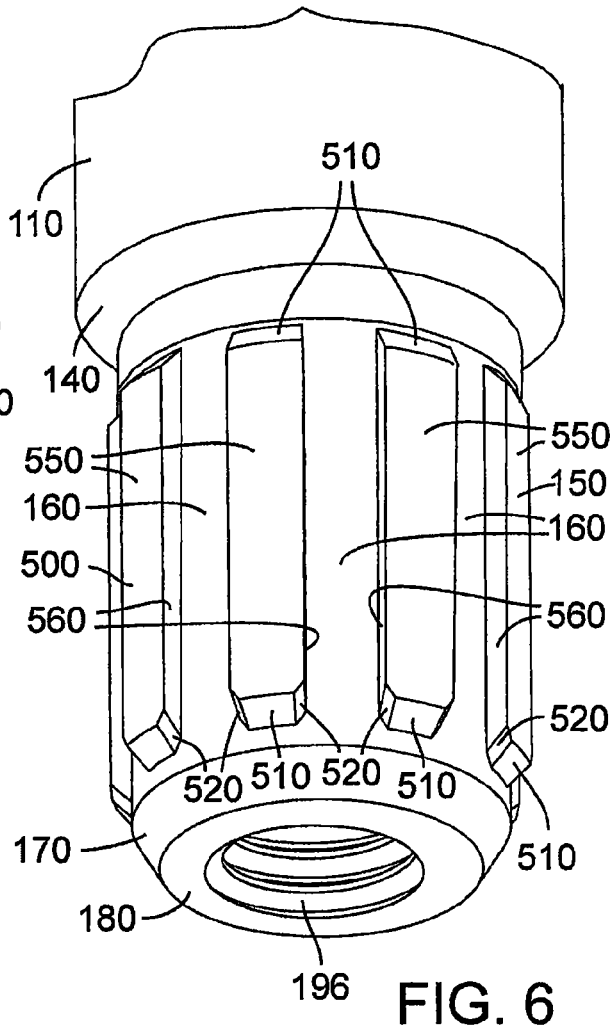
FIG. 6 is an enlarged perspective view of the lower portion of the sleeve of FIG. 5.
Figure 8:
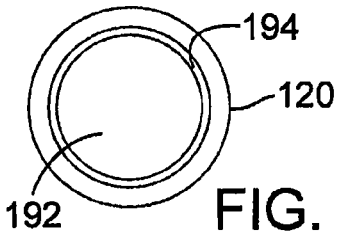
FIG. 8 is a top plan view of the sleeve of FIG. 5.

To restrict rotational movement of the shaft 50 relative to the head 300 when the club head 300 is attached to the shaft 50, the sleeve 100 has a rotation prevention portion that mates with a complementary rotation prevention portion of the insert 200. In the illustrated embodiment, for example, the shaft sleeve has a lower portion 150 having a non-circular configuration complementary to a non-circular configuration of the hosel insert 200. In this way, the sleeve lower portion 150 defines a keyed portion that is received by a keyway defined by the hosel insert 200. In particular embodiments, the rotational prevention portion of the sleeve comprises longitudinally extending external splines 500 formed on an external surface 160 of the sleeve lower portion 150, as illustrated in FIGS. 5-6 and the rotation prevention portion of the insert comprises complementary-configured internal splines 240, formed on an inner surface 250 of the hosel insert 200, as illustrated in FIGS. 11-14. In alternative embodiments, the rotation prevention portions can be elliptical, rectangular, hexagonal or various other non-circular configurations of the sleeve external surface 160 and a complementary non-circular configuration of the hosel insert inner surface 250.

In the illustrated embodiment of FIG. 3, the screw 400 comprises a head 410 having a surface 420, and threads 430. The screw 400 is used to secure the club head 300 to the shaft 50 by inserting the screw through passageway 370 and tightening the screw into a threaded bottom opening 196 in the sleeve 100. In other embodiments, the club head 300 can be secured to the shaft 50 by other mechanical fasteners. When the screw 400 is fully engaged with the sleeve 100, the head surface 420 contacts the flange lower surface 390 and an annular thrust surface 130 of the sleeve 100 contacts a hosel upper surface 395 (FIG. 2). The sleeve 100, the hosel insert 200, the sleeve lower opening 196, the hosel opening 340 and the screw 400 in the illustrated example are co-axially aligned.

It is desirable that a golf club employing a removable club head-shaft connection assembly as described in the present application have substantially similar weight and distribution of mass as an equivalent conventional golf club so that the golf club employing a removable shaft has the same "feel" as the conventional club. Thus, it is desired that the various components of the connection assembly (e.g., the sleeve 100, the hosel insert 200 and the screw 400) are constructed from light-weight, high-strength metals and/or alloys (e.g., T6 temper aluminum alloy 7075, grade 5 6Al-4V titanium alloy, etc.) and designed with an eye towards conserving mass that can be used elsewhere in the golf club to enhance desirable golf club characteristics (e.g., increasing the size of the "sweet spot" of the club head or shifting the center of gravity to optimize launch conditions).

The golf club having an interchangeable shaft and club head as described in the present application provides a golfer with a club that can be easily modified to suit the particular needs or playing style of the golfer. A golfer can replace the club head 300 with another club head having desired characteristics (e.g., different loft angle, larger face area, etc.) by simply unscrewing the screw 400 from the sleeve 100, replacing the club head and then screwing the screw 400 back into the sleeve 100. The shaft 50 similarly can be exchanged. In some embodiments, the sleeve 100 can be removed from the shaft 50 and mounted on the new shaft, or the new shaft can have another sleeve already mounted on or formed integral to the end of the shaft.

In particular embodiments, any number of shafts are provided with the same sleeve and any number of club heads is provided with the same hosel configuration and hosel insert 200 to receive any of the shafts. In this manner, a pro shop or retailer can stock a variety of different shafts and club heads that are interchangeable. A club or a set of clubs that is customized to suit the needs of a consumer can be immediately assembled at the retail location.

With reference now to FIGS. 5-10, there is shown the sleeve 100 of the club head—shaft connection assembly of FIGS. 2-4. The sleeve 100 in the illustrated embodiment is substantially cylindrical and desirably is made from a light-weight, high-strength material (e.g., T6 temper aluminum alloy 7075). The sleeve 100 includes a middle portion 110, an upper portion 120 and a lower portion 150. The upper portion 120 can have a wider thickness than the remainder of the sleeve as shown to provide, for example, additional mechanical integrity to the connection between the shaft 50 and the sleeve 100. In other embodiments, the upper portion 120 may have a flared or frustroconical shape, to provide, for example, a more streamlined transition between the shaft 50 and club head 300. The boundary between the upper portion 120 and the middle portion 110 comprises an upper annular thrust surface 130 and the boundary between the middle portion 110 and the lower portion 150 comprises a lower annular surface 140. In the illustrated embodiment, the annular surface 130 is perpendicular to the external surface of the middle portion 110. In other embodiments, the annular surface 130 may be frustroconical or otherwise taper from the upper portion 120 to the middle portion 110. The annular surface 130 bears against the hosel upper surface 395 when the shaft 50 is secured to the club head 300.

Figure 7:
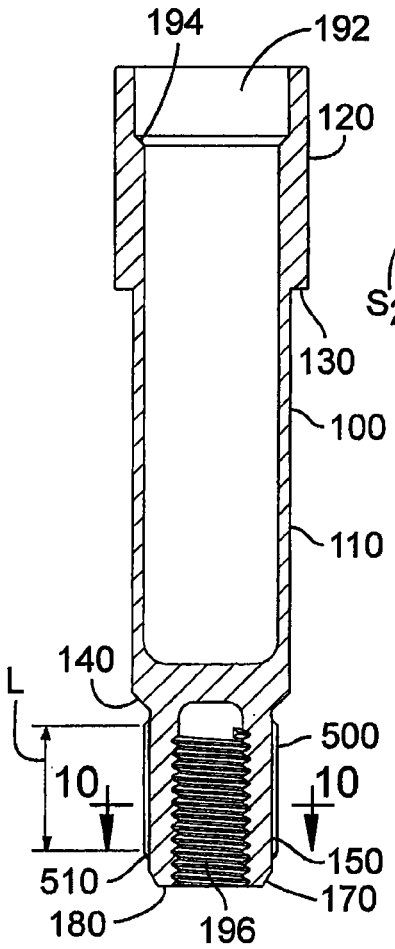
FIG. 7 is a cross-sectional view of the sleeve of FIG. 5.
Figure 9:
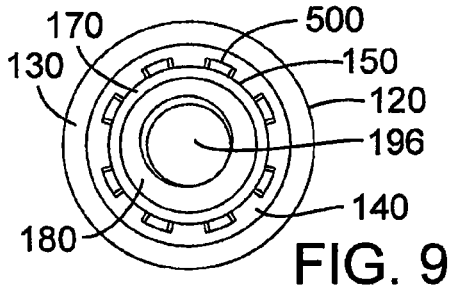
FIG. 9 is a bottom plan view of the sleeve of FIG. 5.

As shown in FIG. 7, the sleeve 100 further comprises an upper opening 192 for receiving the lower end portion 90 of the shaft 50 and an internally threaded opening 196 in the lower portion 150 for receiving the screw 400. In the illustrated embodiment, the upper opening 192 has an annular surface 194 configured to contact a corresponding surface 70 of the shaft 50 (FIG. 3). In other embodiments, the upper opening 192 can have a configuration adapted to mate with various shaft profiles (e.g., a constant inner diameter, plurality of stepped inner diameters, chamfered and/or perpendicular annular surfaces, etc.). With reference to the illustrated embodiment of FIG. 7, splines 500 are located below opening 192 (and therefore below the lower end of the shaft) to minimize the overall diameter of the sleeve. The threads in the lower opening 196 can be formed using a Spiralock® tap.

Figure 10:
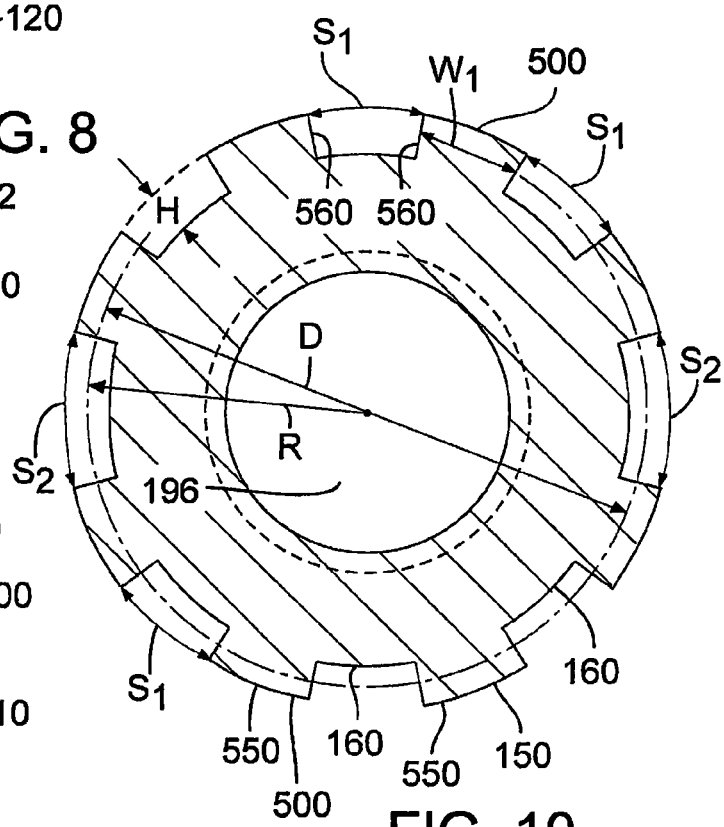
FIG. 10 is a cross-sectional view of the sleeve, taken along the line 10-10 of FIG. 7.

As noted above, the rotation prevention portion of the sleeve 100 for restricting relative rotation between the shaft and the club comprises a plurality of external splines 500 formed on an external surface of the lower portion 150 and gaps, or keyways, between adjacent splines 500. Each keyway has an outer surface 160. In the illustrated embodiment of FIGS. 5-6, 9-10, the sleeve comprises eight angularly spaced splines 500 elongated in a direction parallel to the longitudinal axis of the sleeve 100. Referring to FIGS. 6 and 10, each of the splines 500 in the illustrated configuration has a pair of sidewalls 560 extending radially outwardly from the external surface 160, beveled top and bottom edges 510, bottom chamfered corners 520 and an arcuate outer surface 550. The sidewalls 560 desirably diverge or flair moving in a radially outward direction so that the width of the spline near the outer surface 550 is greater than the width at the base of the spline (near surface 160). With reference to features depicted in FIG. 10, the splines 500 have a height H (the distance the sidewalls 550 extend radially from the external surface 160), and a width $W_1$ at the mid-span of the spline (the straight line distance extending between sidewalls 560 measured at locations of the sidewalls equidistant from the outer surface 550 and the surface 160). In other embodiments, the sleeve comprises more or fewer splines and the splines 500 can have different shapes and sizes.

Embodiments employing the spline configuration depicted in FIGS. 6-10 provide several advantages. For example, a sleeve having fewer, larger splines provides for greater interference between the sleeve and the hosel insert, which enhances resistance to stripping, increases the load-bearing area between the sleeve and the hosel insert and provides for splines that are mechanically stronger. Further, complexity of manufacturing may be reduced by avoiding the need to machine smaller spline features. For example, various Rosch-manufacturing techniques (e.g., rotary, thru-broach or blind-broach) may not be suitable for manufacturing sleeves or hosel inserts having more, smaller splines. In some embodiments, the splines 500 have a spline height H of between about 0.15 mm to about 1.0 mm with a height H of about 0.5 mm being a specific example and a spline width $W_1$ of between about 0.979 mm to about 2.87 mm, with a width $W_1$ of about 1.367 mm being a specific example.

The non-circular configuration of the sleeve lower portion 150 can be adapted to limit the manner in which the sleeve 100 is positionable within the hosel insert 200. In the illustrated embodiment of FIGS. 9-10, the splines 500 are substantially identical in shape and size. Six of the eight spaces between adjacent splines can have a spline-to-spline spacing $S_1$ and two diametrically-opposed spaces can have a spline-to-spline spacing $S_2$, where $S_2$ is a different than $S_1$ ($S_2$ is greater than $S_1$ in the illustrated embodiment). In the illustrated embodiment, the arc angle of $S_1$ is about 21 degrees and the arc angle of $S_2$ is about 33 degrees. This spline configuration allows the sleeve 100 to be dually positionable within the hosel insert 200 (i.e., the sleeve 100 can be inserted in the insert 200 at two positions, spaced 180 degrees from each other, relative to the insert). Alternatively, the splines can be equally spaced from each other around the longitudinal axis of the sleeve. In other embodiments, different non-circular configurations of the lower portion 150 (e.g., triangular, hexagonal, more of fewer splines) can provide for various degrees of positionability of the shaft sleeve.

The sleeve lower portion 150 can have a generally rougher outer surface relative to the remaining surfaces of the sleeve 100 in order to provide, for example, greater friction between the sleeve 100 and the hosel insert 200 to further restrict rotational movement between the shaft 50 and the club head 300. In particular embodiments, the external surface 160 can be roughened by sandblasting, although alternative methods or techniques can be used.

The general configuration of the sleeve 100 can vary from the configuration illustrated in FIGS. 5-10. In other embodiments, for example, the relative lengths of the upper portion 120, the middle portion 110 and the lower portion 150 can vary (e.g., the lower portion 150 could comprise a greater or lesser proportion of the overall sleeve length). In additional embodiments, additional sleeve surfaces could contact corresponding surfaces in the hosel insert 200 or hosel opening 340 when the club head 300 is attached to the shaft 50. For example, annular surface 140 of the sleeve may contact upper spline surfaces 230 of the hosel insert 200, annular surface 170 of the sleeve may contact a corresponding surface on an inner surface of the hosel insert 200, and/or a bottom face 180 of the sleeve may contact the flange upper surface 360. In additional embodiments, the lower opening 196 of the sleeve can be in communication with the upper opening 192, defining a continuous sleeve opening and reducing the weight of the sleeve 100 by removing the mass of material separating openings 196 and 192.

With reference now to FIGS. 11-14, the hosel insert 200 desirably is substantially tubular or cylindrical and can be made from a light-weight, high-strength material (e.g., grade 5 6Al-4V titanium alloy). The hosel insert 200 comprises an inner surface 250 having a non-circular configuration complementary to the non-circular configuration of the external surface of the sleeve lower portion 150. In the illustrated embodiment, the non-circulation configuration comprises splines 240 complementary in shape and size to the splines 500 of the sleeve 150. That is, there are eight splines 240 elongated in a direction parallel to the longitudinal axis of the hosel insert 200 and the splines 240 have sidewalls 260 extending radially inward from the inner surface 250, chamfered top edges 230 and an inner surface 270. The sidewalls 260 desirably taper or converge toward each other moving in a radially inward direction to mate with the flared splines 500 of the sleeve. The radially inward sidewalls 260 have at least one advantage in that full surface contact occurs between the teeth and the mating teeth of the sleeve insert. In addition, at least one advantage, is that the translational movement is more constrained within the assembly compared to other spline geometries having the same tolerance. Furthermore, the radially inward sidewalls 260 promote full sidewall engagement rather than localized contact resulting in higher stresses and lower durability.

Figure 13:
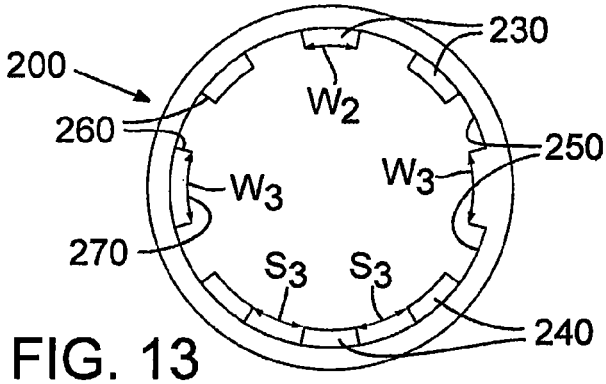
FIG. 13 is a top plan view of the hosel insert of FIG. 11.
Figure 11:
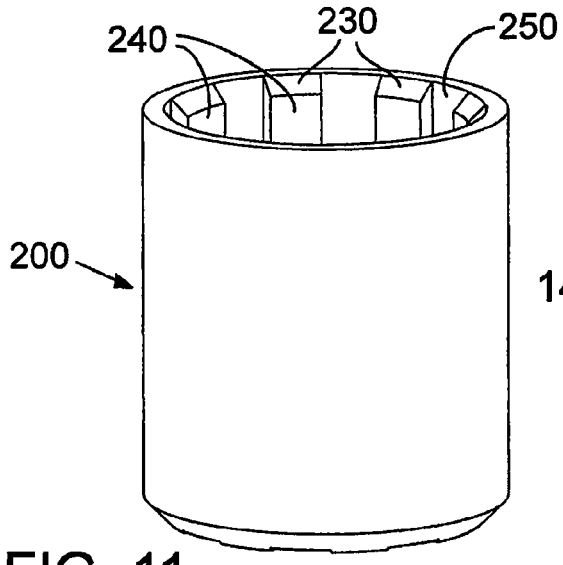
FIG. 11 is a perspective view of the hosel insert of the connection assembly shown in FIG. 2.
Figure 12:
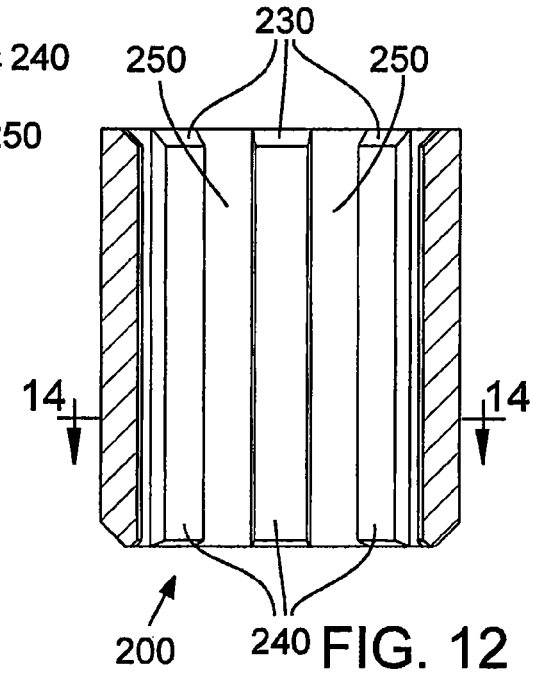
FIG. 12 is a cross-sectional view of the hosel insert of FIG. 2.
Figure 14:
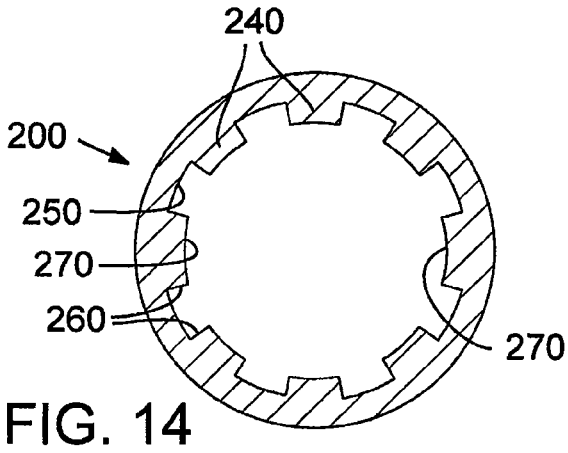
FIG. 14 is a cross-sectional view of the hosel insert of FIG. 2, taken along the line 14-14 of FIG. 12.

With reference to the features of FIG. 13, the spline configuration of the hosel insert is complementary to the spline configuration of the sleeve lower portion 150 and as such, adjacent pairs of splines 240 have a spline-to-spline spacing $S_3$ that is slightly greater than the width of the sleeve splines 500. Six of the splines 240 have a width $W_2$ slightly less than inter-spline spacing $S_1$ of the sleeve splines 500 and two diametrically-opposed splines have a width $W_3$ slightly less than inter-spline spacing $S_2$ of the sleeve splines 500, wherein $W_2$ is less than $W_3$. In additional embodiments, the hosel insert inner surface can have various non-circular configurations complementary to the non-circular configuration of the sleeve lower portion 160.

Selected surfaces of the hosel insert 200 can be roughened in a similar manner to the exterior surface 160 of the shaft. In some embodiments, the entire surface area of the insert can be provided with a roughened surface texture. In other embodiments, only the inner surface 240 of the hosel insert 200 can be roughened.

With reference now to FIGS. 2-4, the screw 400 desirably is made from a light-weight, high-strength material (e.g., T6 temper aluminum alloy 7075). In certain embodiments, the major diameter (i.e., outer diameter) of the threads 430 is less than 6 mm (e.g., ISO screws smaller than M6) and is either about 4 mm or 5 mm (e.g., M4 or M5 screws). In general, reducing the thread diameter increases the ability of the screw to elongate or stretch when placed under a load, resulting in a greater preload for a given torque. The use of relatively smaller diameter screws (e.g., M4 or M5 screws) allows a user to secure the club head to the shaft with less effort and allows the golfer to use the club for longer periods of time before having to retighten the screw.

Figure 15:
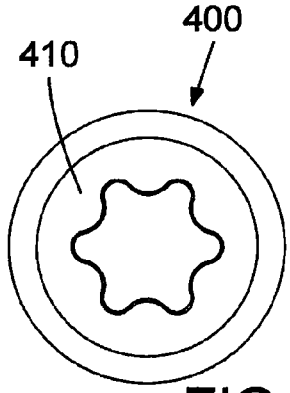
FIG. 15 is a bottom plan view of the screw of the connection assembly shown in FIG. 2.

The head 410 of the screw can be configured to be compatible with a torque wrench or other torque-limiting mechanism. In some embodiments, the screw head comprises a "hexalobular" internal driving feature (e.g., a TORX screw drive) (such as shown in FIG. 15) to facilitate application of a consistent torque to the screw and to resist cam-out of screwdrivers. Securing the club head 300 to the shaft 50 with a torque wrench can ensure that the screw 400 is placed under a substantially similar preload each time the club is assembled, ensuring that the club has substantially consistent playing characteristics each time the club is assembled. In additional embodiments, the screw head 410 can comprise various other drive designs (e.g., Phillips, Pozidriv, hexagonal, TTAP, etc.), and the user can use a conventional screwdriver rather than a torque wrench to tighten the screw.

The club head-shaft connection desirably has a low axial stiffness. The axial stiffness, k, of an element is defined as $$k = \frac{EA}{L} \quad \text{Eq. 1}$$

where E is the Young's modulus of the material of the element, A is the cross-sectional area of the element and L is the length of the element. The lower the axial stiffness of an element, the greater the element will elongate when placed in tension or shorten when placed in compression. A club head-shaft connection having low axial stiffness is desirable to maximize elongation of the screw 400 and the sleeve, allowing for greater preload to be applied to the screw 400 for better retaining the shaft to the club head. For example, with reference to FIG. 16, when the screw 400 is tightened into the sleeve lower opening 196, various surfaces of the sleeve 100, the hosel insert 200, the flange 360 and the screw 400 contact each other as previously described, which is effective to place the screw, the shaft, and the sleeve in tension and the hosel in compression.

Figure 16:
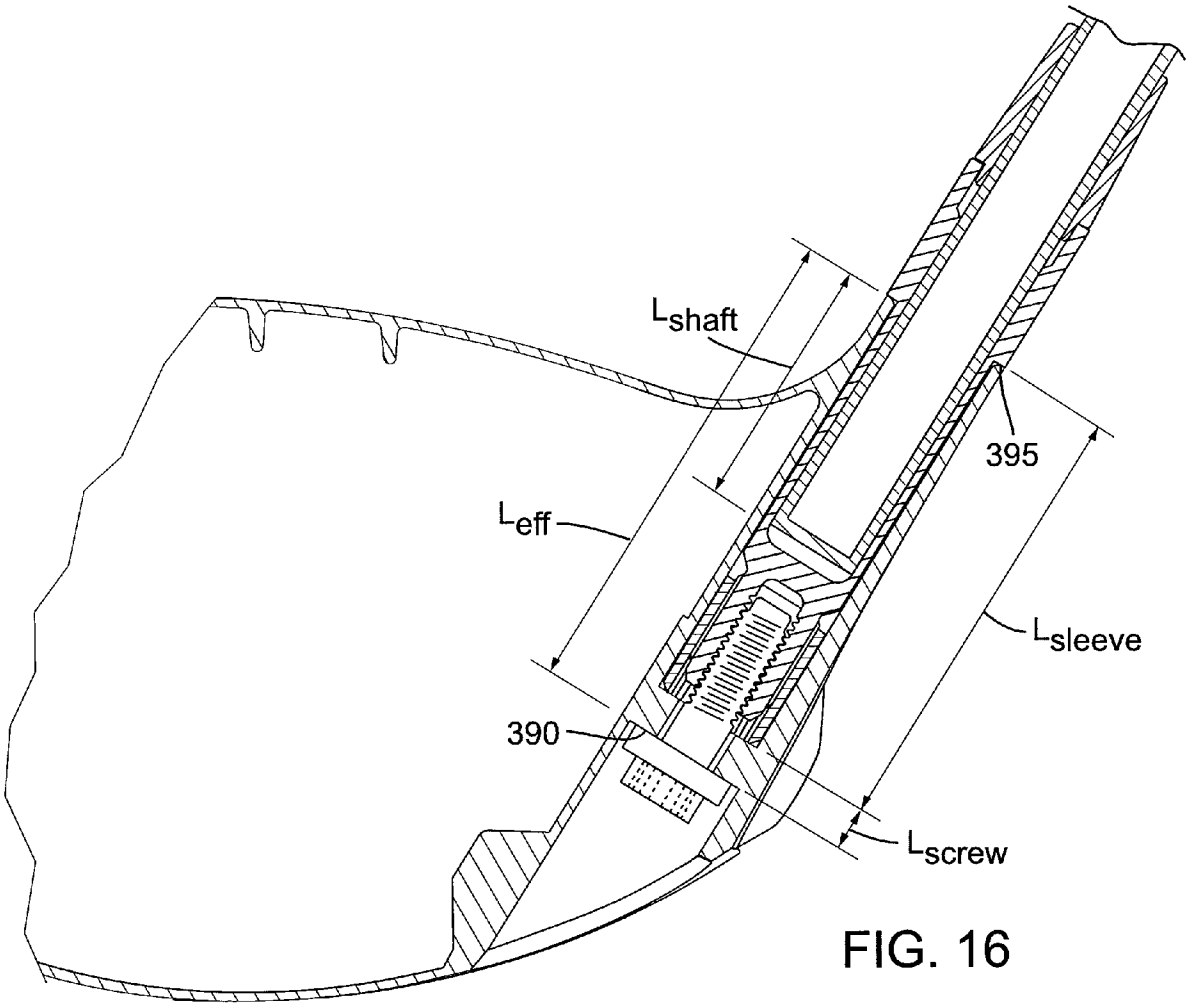
FIG. 16 is a cross-sectional view similar to FIG. 2 identifying lengths used in calculating the stiffness of components of the shaft-head connection assembly.

The axial stiffness of the club head—shaft connection, $k_{eff}$, can be determined by the equation $$\frac{1}{k_{eff}} = \frac{1}{k_{screw}} + \frac{1}{k_{sleeve} + k_{shaft}} \quad \text{Eq. 2}$$

where $k_{screw}$, $k_{shaft}$ and $L_{sleeve}$, are the stiffnesses of the screw, shaft, and sleeve, respectively, over the portions that have associated lengths $L_{screw}$, $L_{shaft}$, and $L_{sleeve}$, respectively, as shown in FIG. 16. $L_{screw}$ is the length of the portion of the screw placed in tension (measured from the flange bottom 390 to the bottom end of the shaft sleeve). $L_{shaft}$ is the length of the portion of the shaft 50 extending into the hosel opening 340 (measured from hosel upper surface 395 to the end of the shaft); and $L_{sleeve}$ is the length of the sleeve 100 placed in tension (measured from hosel upper surface 395 to the end of the sleeve), as depicted in FIG. 16.

Accordingly, $k_{screw}$, $k_{shaft}$ and $k_{sleeve}$ can be determined using the lengths in Equation 1. Table 1 shows calculated k values for certain components and combinations thereof for the connection assembly of FIGS. 2-14 and those of other commercially available connection assemblies used with removably attachable golf club heads. Also, the effective hosel stiffness, $K_{hosel}$, is also shown for comparison purposes (calculated over the portion of the hosel that is in compression during screw preload). A low $k_{eff}/k_{hosel}$ ratio indicates a small shaft connection assembly stiffness compared to the hosel stiffness, which is desirable in order to help maintain preload for a given screw torque during dynamic loading of the head. The $k_{eff}$ of the sleeve-shaft-screw combination of the connection assembly of illustrated embodiment is $9.27\times10^7$ N/m, which is the lowest among the compared connection assemblies.

TABLE 1

| Component(s) | Present technology | Nakashima (N/m) | Callaway Opti-Fit (N/m) | Versus Golf (N/m) |
|---|---|---|---|---|
| $k_{sleeve}$ (sleeve) | $5.57 \times 10^7$ | $9.65 \times 10^7$ | $9.64 \times 10^7$ | $4.03 \times 10^7$ |
| $k_{sleeve} + k_{shaft}$ (sleeve + shaft) | $1.86 \times 10^8$ | $1.87 \times 10^8$ | $2.03 \times 10^8$ | $1.24 \times 10^8$ |
| $k_{screw}$ (screw) | $1.85 \times 10^8$ | $5.03 \times 10^8$ | $2.51 \times 10^8$ | $1.88 \times 10^9$ |
| $k_{eff}$ (sleeve + shaft + screw) | $9.27 \times 10^7$ | $1.36 \times 10^8$ | $1.12 \times 10^8$ | $1.24 \times 10^8$ |
| $k_{hosel}$ | $1.27 \times 10^8$ | $1.27 \times 10^8$ | $1.27 \times 10^8$ | $1.27 \times 10^8$ |
| $k_{eff}/k_{hosel}$ (tension/compression ratio) | 0.73 | 1.07 | 0.88 | 0.98 |

Figure 17:
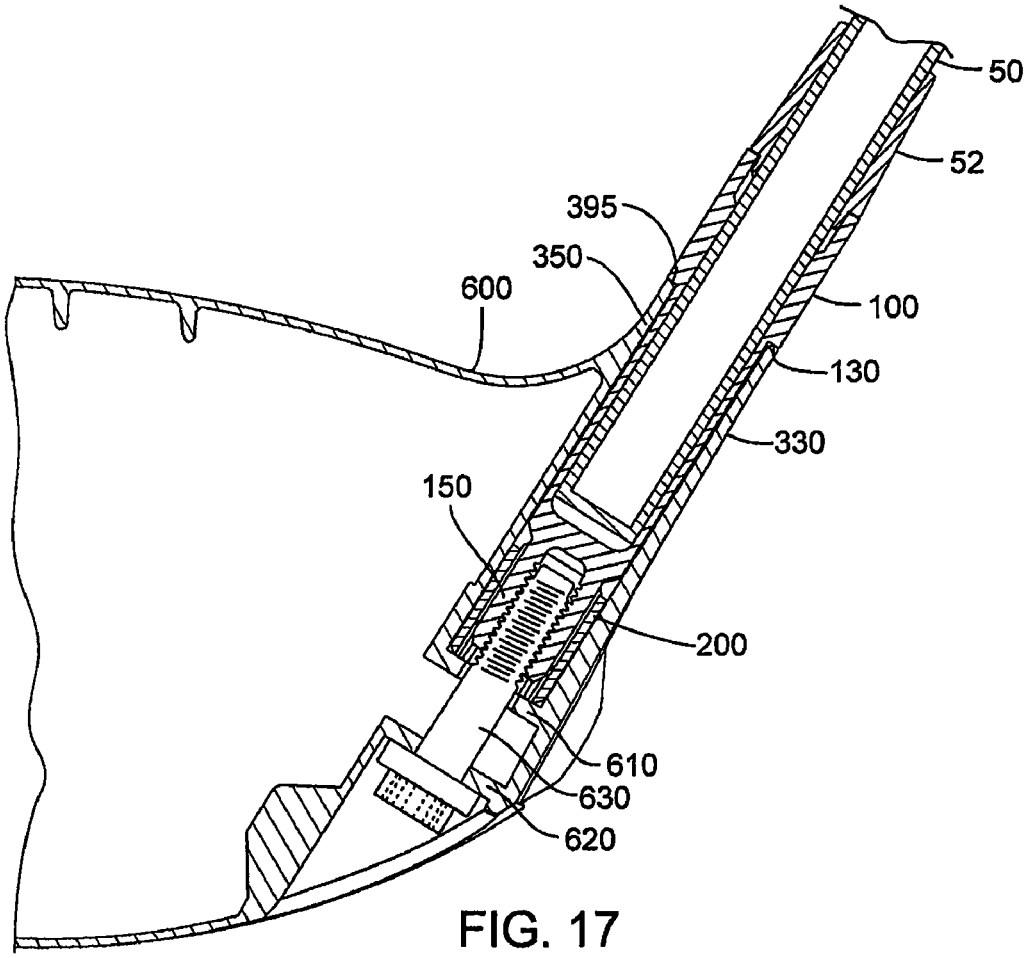
FIG. 17 is a cross-sectional view of a golf club head having a removable shaft, according to another embodiment.

The components of the connection assembly can be modified to achieve different values. For example, the screw 400 can be longer than shown in FIG. 16. In some embodiments, the length of the opening 196 can be increased along with a corresponding increase in the length of the screw 400. In additional embodiments, the construction of the hosel opening 340 can vary to accommodate a longer screw. For example, with reference to FIG. 17, a club head 600 comprises an upper flange 610 defining the bottom wall of the hosel opening and a lower flange 620 spaced from the upper flange 610 to accommodate a longer screw 630. Such a hosel construction can accommodate a longer screw, and thus can achieve a lower $k_{eff}$, while retaining compatibility with the sleeve 100 of FIGS. 5-10.

In the illustrated embodiment of FIGS. 2-10, the cross-sectional area of the sleeve 100 is minimized to minimize $k_{sleeve}$, by placing the splines 500 below the shaft, rather than around the shaft as used in prior art configurations.

EXAMPLES

In certain embodiments, a shaft sleeve can have 4, 6, 8, 10, or 12 splines. The height H of the splines of the shaft sleeve in particular embodiments can range from about 0.15 mm to about 0.95 mm, and more particularly from about 0.25 mm to about 0.75 mm, and even more particularly from about 0.5 mm to about 0.75 mm. The average diameter D of the spline portion of the shaft sleeve can range from about 6 mm to about 12 mm, with 8.45 mm being a specific example. As shown in FIG. 10, the average diameter is the diameter of the spline portion of a shaft sleeve measured between two points located at the mid-spans of two diametrically opposed splines.

The length L of the splines of the shaft sleeve in particular embodiments can range from about 2 mm to about 10 mm. For example, when the connection assembly is implemented in a driver, the splines can be relatively longer, for example, 7.5 mm or 10 mm. When the connection assembly is implemented in a fairway wood, which is typically smaller than a driver, it is desirable to use a relatively shorter shaft sleeve because less space is available inside the club head to receive the shaft sleeve. In that case, the splines can be relatively shorter, for example, 2 mm or 3 mm in length, to reduce the overall length of the shaft sleeve.

The ratio of spline width $W_1$ (at the midspan of the spline) to average diameter of the spline portion of the shaft sleeve in particular embodiments can range from about 0.1 to about 0.5, and more desirably, from about 0.15 to about 0.35, and even more desirably from about 0.16 to about 0.22. The ratio of spline width $W_1$ to spline H in particular embodiments can range from about 1.0 to about 22, and more desirably from about 2 to about 4, and even more desirably from about 2.3 to about 3.1. The ratio of spline length L to average diameter in particular embodiments can range from about 0.15 to about 1.7.

Tables 2-4 below provide dimensions for a plurality of different spline configurations for the sleeve 100 (and other shaft sleeves disclosed herein). In Table 2, the average radius R is the radius of the spline portion of a shaft sleeve measured at the mid-span of a spine, i.e., at a location equidistant from the base of the spline at surface 160 and to the outer surface 550 of the spline (see FIG. 10). The arc length in Tables 2 and 3 is the arc length of a spline at the average radius.

Table 2 shows the spline arc angle, average radius, average diameter, arc length, arc length, arc length/average radius ratio, width at midspan, width (at midspan)/average diameter ratio for different shaft sleeves having 8 splines (with two 33 degree gaps as shown in FIG. 10), 8 equally-spaced splines, 6 equally-spaced splines, 10 equally-spaced splines, 4 equally-spaced splines. Table 3 shows examples of shaft sleeves having different number of splines and spline heights. Table 4 shows examples of different combinations of lengths and average diameters for shaft sleeves apart from the number of splines, spline height H, and spline width $W_1$.

The specific dimensions provided in the present specification for the shaft sleeve 100 (as well as for other components disclosed herein) are given to illustrate the invention and not to limit it. The dimensions provided herein can be modified as needed in different applications or situations.

TABLE 2

| # Splines | Spline arc angle (deg.) | Average radius (mm) | Average diameter (mm) | Arc length (mm) | Arc length/ Average radius | Width at midspan (mm) | Width/ Average diameter |
|---|---|---|---|---|---|---|---|
| 8 (w/two 33 deg. gaps) | 21 | 4.225 | 8.45 | 1.549 | 0.367 | 1.540 | 0.182 |
| 8 (equally spaced) | 22.5 | 4.225 | 8.45 | 1.659 | 0.393 | 1.649 | 0.195 |
| 6 (equally spaced) | 30 | 4.225 | 8.45 | 2.212 | 0.524 | 2.187 | 0.259 |
| 10 (equally spaced) | 18 | 4.225 | 8.45 | 1.327 | 0.314 | 1.322 | 0.156 |
| 4 (equally spaced) | 45 | 4.225 | 8.45 | 3.318 | 0.785 | 3.234 | 0.383 |
| 12 (equally spaced) | 15 | 4.225 | 8.45 | 1.106 | 0.262 | 1.103 | 0.131 |

TABLE 3

| # Splines | Spline height (mm) | Arc length (mm) | Width at Midspan (mm) | Arc length/Height | Width/ Height |
|---|---|---|---|---|---|
| 8 (w/ two 33 deg. gaps) | 0.5 | 1.549 | 1.540 | 3.097 | 3.080 |
| 8 (w/ two 33 deg/ gaps) | 0.25 | 1.549 | 1.540 | 6.194 | 6.160 |
| 8 (w/ two 33 deg/ gaps) | 0.75 | 1.549 | 1.540 | 2.065 | 2.053 |
| 8 (equally spaced) | 0.5 | 1.659 | 1.649 | 3.318 | 3.297 |
| 6 (equally spaced) | 0.15 | 2.212 | 2.187 | 14.748 | 14.580 |
| 4 (equally spaced) | 0.95 | 1.327 | 1.321 | 1.397 | 1.391 |
| 4 (equally spaced) | 0.15 | 3.318 | 3.234 | 22.122 | 21.558 |
| 12 (equally spaced) | 0.95 | 1.106 | 1.103 | 1.164 | 1.161 |

TABLE 4

| Average sleeve diameter at splines (mm) | Spline length (mm) | Spline length/Average diameter |
|---|---|---|
| 6 | 7.5 | 1.25 |
| 6 | 3 | 0.5 |
| 6 | 10 | 1.667 |
| 6 | 2 | .333 |
| 8.45 | 7.5 | 0.888 |
| 8.45 | 3 | 0.355 |
| 8.45 | 10 | 1.183 |
| 8.45 | 2 | 0.237 |
| 12 | 7.5 | 0.625 |
| 12 | 3 | 0.25 |
| 12 | 10 | 0.833 |
| 12 | 2 | 0.167 |

Adjustable Lie/Loft Connection Assembly

Figure 18:
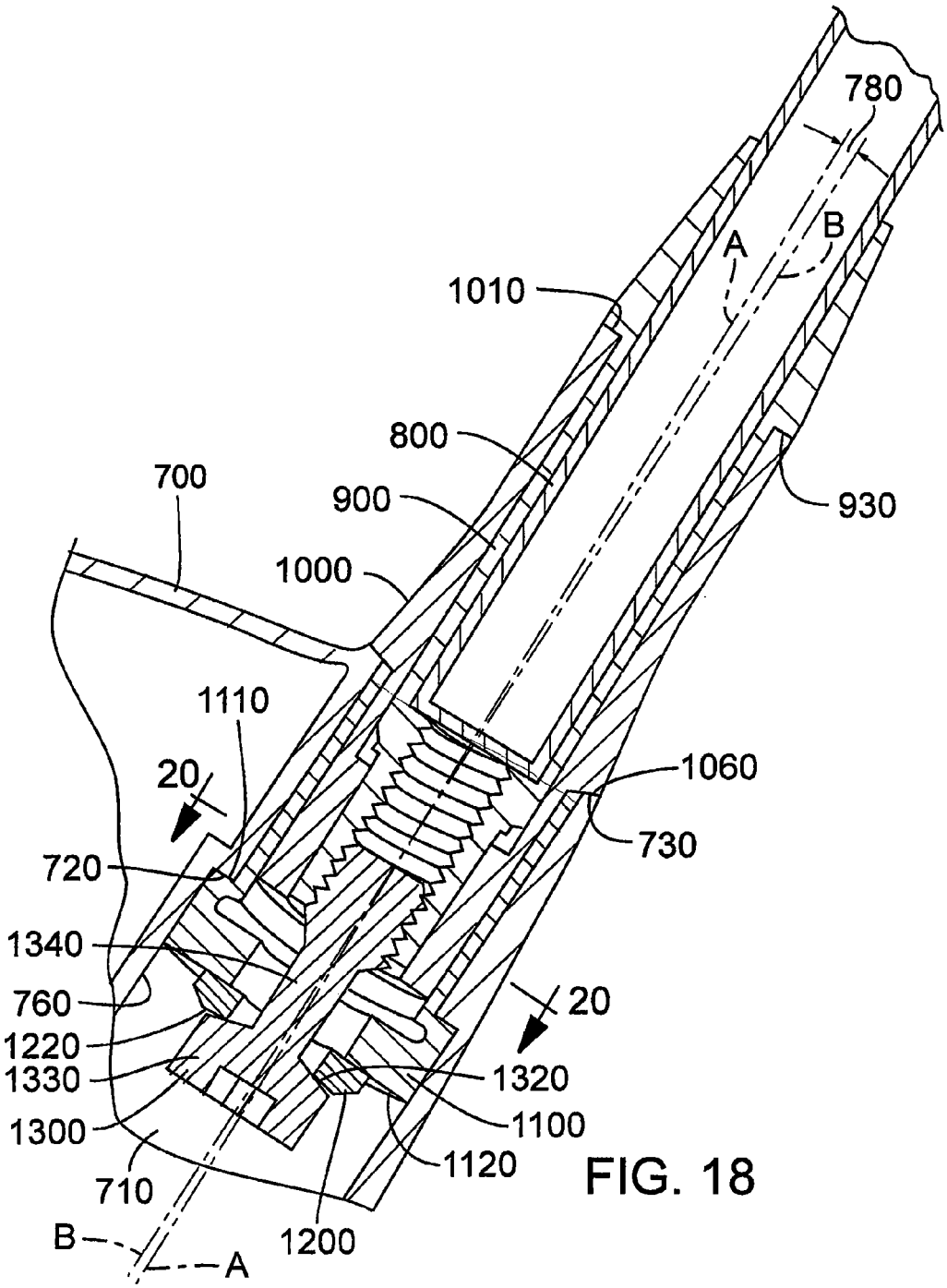
FIG. 18 is an enlarged cross-sectional view of a golf club head having a removable shaft, in accordance with another embodiment.
Figure 19:
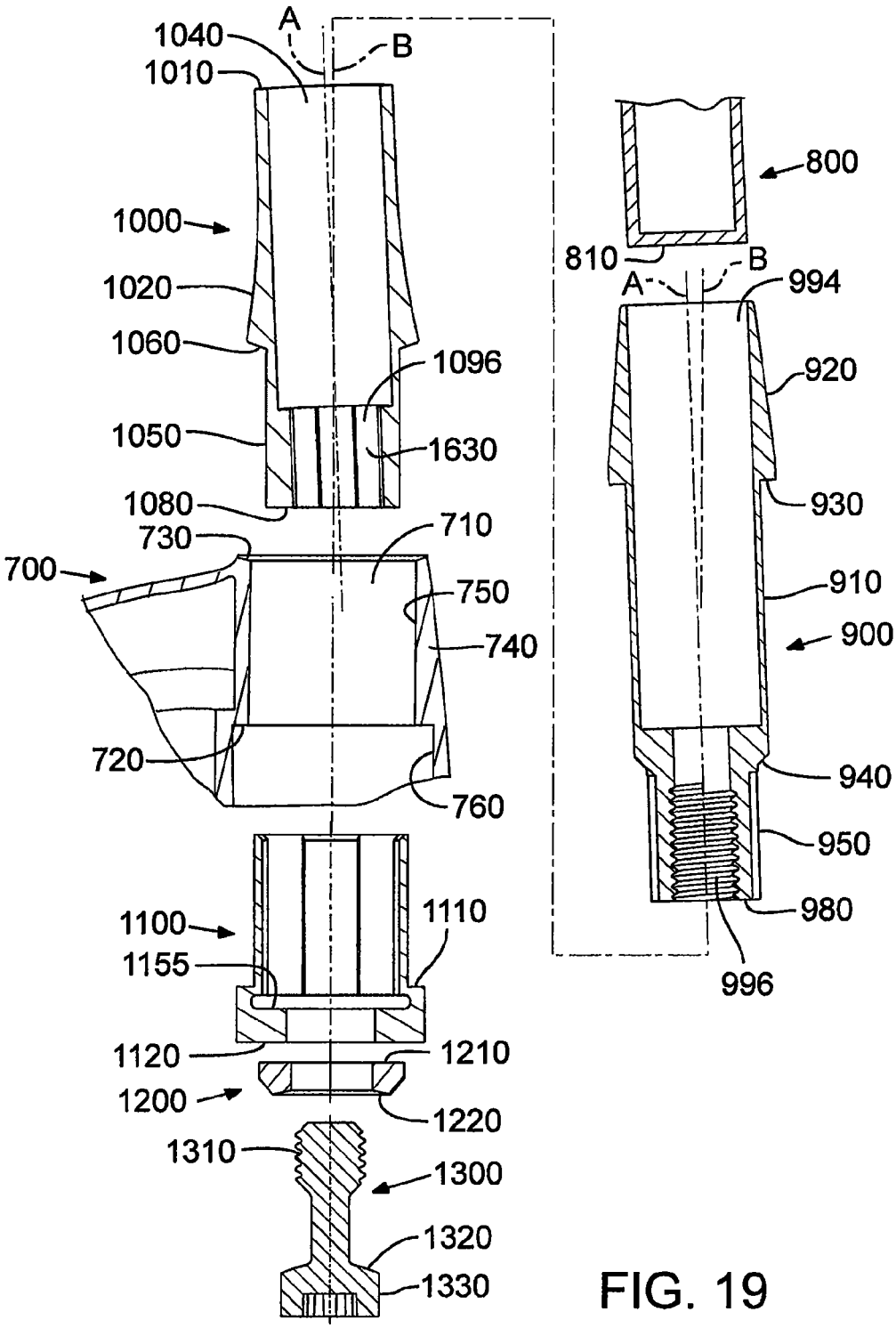
FIG. 19 is an exploded cross-sectional view of the shaft-club head connection assembly of FIG. 18.
Figure 20:
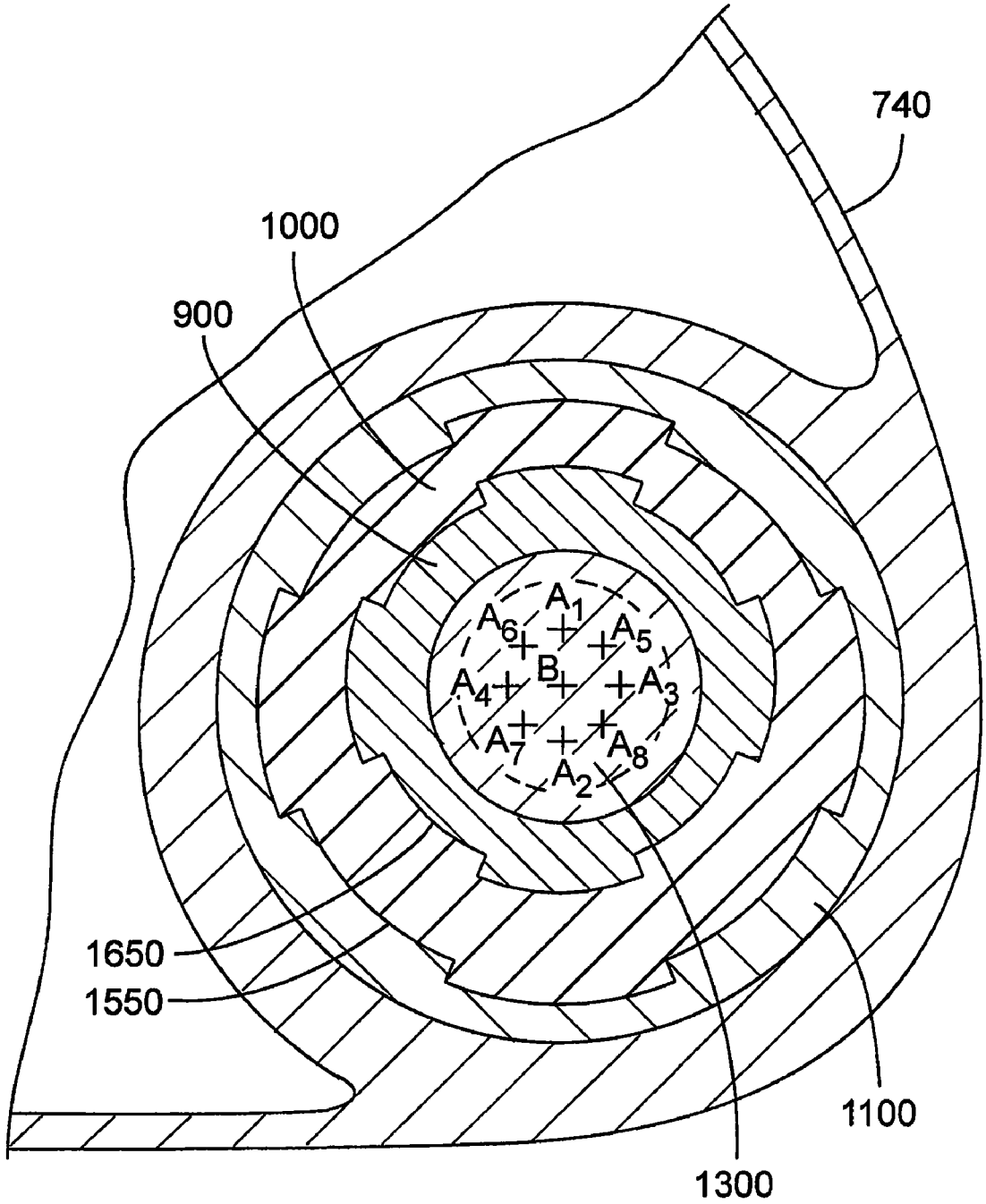
FIG. 20 is an enlarged cross-sectional view of the golf club head of FIG. 18, taken along the line 20-20 of FIG. 18.

Now with reference to FIGS. 18-20, there is shown a golf club comprising a head 700 attached to a removable shaft 800 via a removable head-shaft connection assembly. The connection assembly generally comprises a shaft sleeve 900, a hosel sleeve 1000 (also referred to herein as an adapter sleeve), a hosel insert 1100, a washer 1200 and a screw 1300. The club head 700 comprises a hosel 702 defining a hosel opening, or passageway 710. The passageway 710 in the illustrated embodiment extends through the club head and forms an opening in the sole of the club head to accept the screw 1300. Generally, the club head 700 is removably attached to the shaft 800 by the shaft sleeve 900 (which is mounted to the lower end portion of the shaft 800) being inserted into and engaging the hosel sleeve 1000. The hosel sleeve 1000 is inserted into and engages the hosel insert 1100 (which is mounted inside the hosel opening 710). The screw 1300 is tightened into a threaded opening of the shaft sleeve 900, with the washer 1200 being disposed between the screw 1300 and the hosel insert 1100, to secure the shaft to the club head.

The shaft sleeve 900 can be adhesively bonded, welded or secured in equivalent fashion to the lower end portion of the shaft 800. In other embodiments, the shaft sleeve 900 may be integrally formed with the shaft 800. As best shown in FIG. 19, the hosel opening 710 extends through the club head 700 and has hosel sidewalls 740 defining a first hosel inner surface 750 and a second hosel inner surface 760, the boundary between the first and second hosel inner surfaces defining an inner annular surface 720. The hosel sleeve 1000 is disposed between the shaft sleeve 900 and the hosel insert 1100. The hosel insert 1100 can be mounted within the hosel opening 710. The hosel insert 1100 can have an annular surface 1110 that contacts the hosel annular surface 720. The hosel insert 1100 can be adhesively bonded, welded or secured in equivalent fashion to the first hosel surface 740, the second hosel surface 750 and/or the hosel annular surface 720 to secure the hosel insert 1100 in place. In other embodiments, the hosel insert 1100 can be formed integrally with the club head 700.

Figure 31:
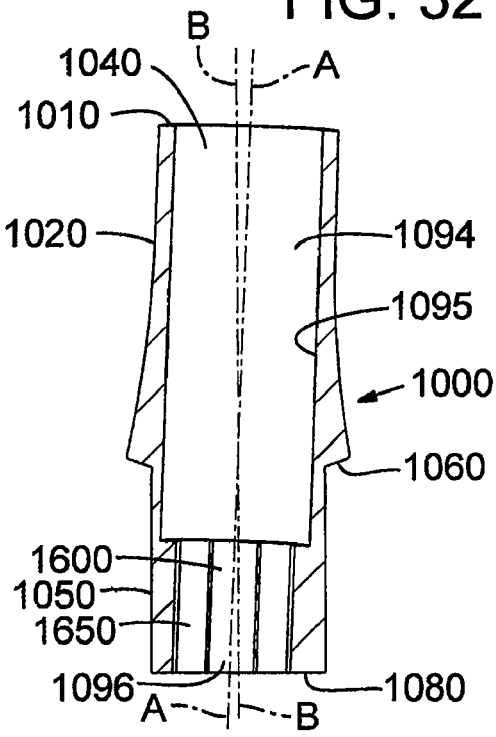
FIG. 31 is a cross-sectional view of the hosel sleeve of FIG. 27.
Figure 30:
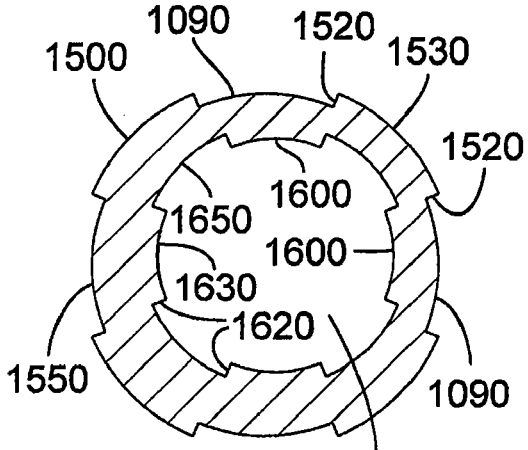
FIG. 30 is a cross-sectional view of the hosel sleeve, taken along line 30-30 of FIG. 27.
Figure 33:
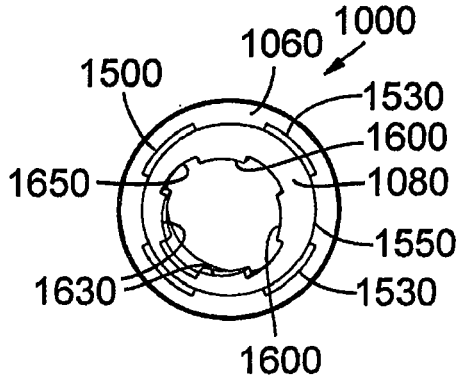
FIG. 33 is a bottom plan view of the hosel sleeve of FIG. 27.

Rotational movement of the shaft 800 relative to the club head 700 can be restricted by restricting rotational movement of the shaft sleeve 900 relative to the hosel sleeve 1000 and by restricting rotational movement of the hosel sleeve 1000 relative to the club head 700. To restrict rotational movement of the shaft sleeve 900 relative to the hosel sleeve 1000, the shaft sleeve has a lower, rotation prevention portion 950 having a non-circular configuration that mates with a complementary, non-circular configuration of a lower, rotation prevention portion 1096 inside the hosel sleeve 1000. The rotation prevention portion of the shaft sleeve 900 can comprise longitudinally extending splines 1400 formed on an external surface 960 of the lower portion 950, as best shown in FIGS. 21-22. The rotation prevention portion of the hosel sleeve can comprise complementary-configured splines 1600 formed on an inner surface 1650 of the lower portion 1096 of the hosel sleeve, as best shown in FIGS. 30-31.

Figure 29:
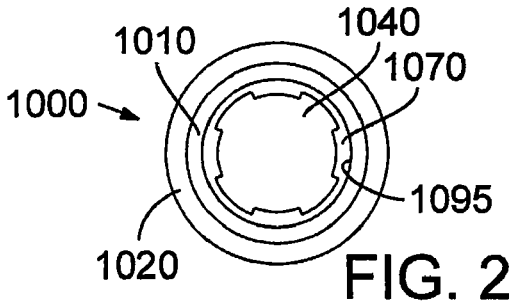
FIG. 29 is a top plan view of the hosel sleeve of FIG. 27, as viewed along longitudinal axis B defined by the outer surface of the lower portion of the hosel sleeve.
Figure 32:
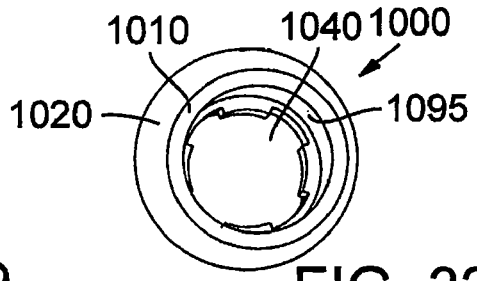
FIG. 32 is a top plan view of the hosel sleeve of FIG. 27.
Figure 27:
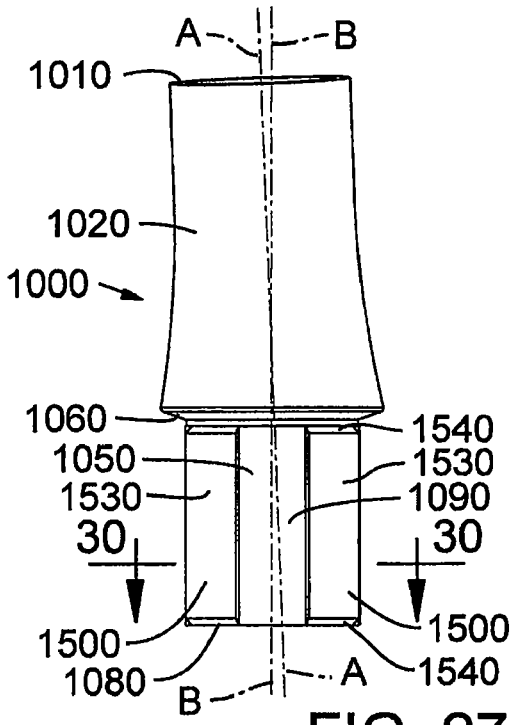
FIG. 27 is a side elevational view of the hosel sleeve of the connection assembly shown in FIG. 18.
Figure 28:
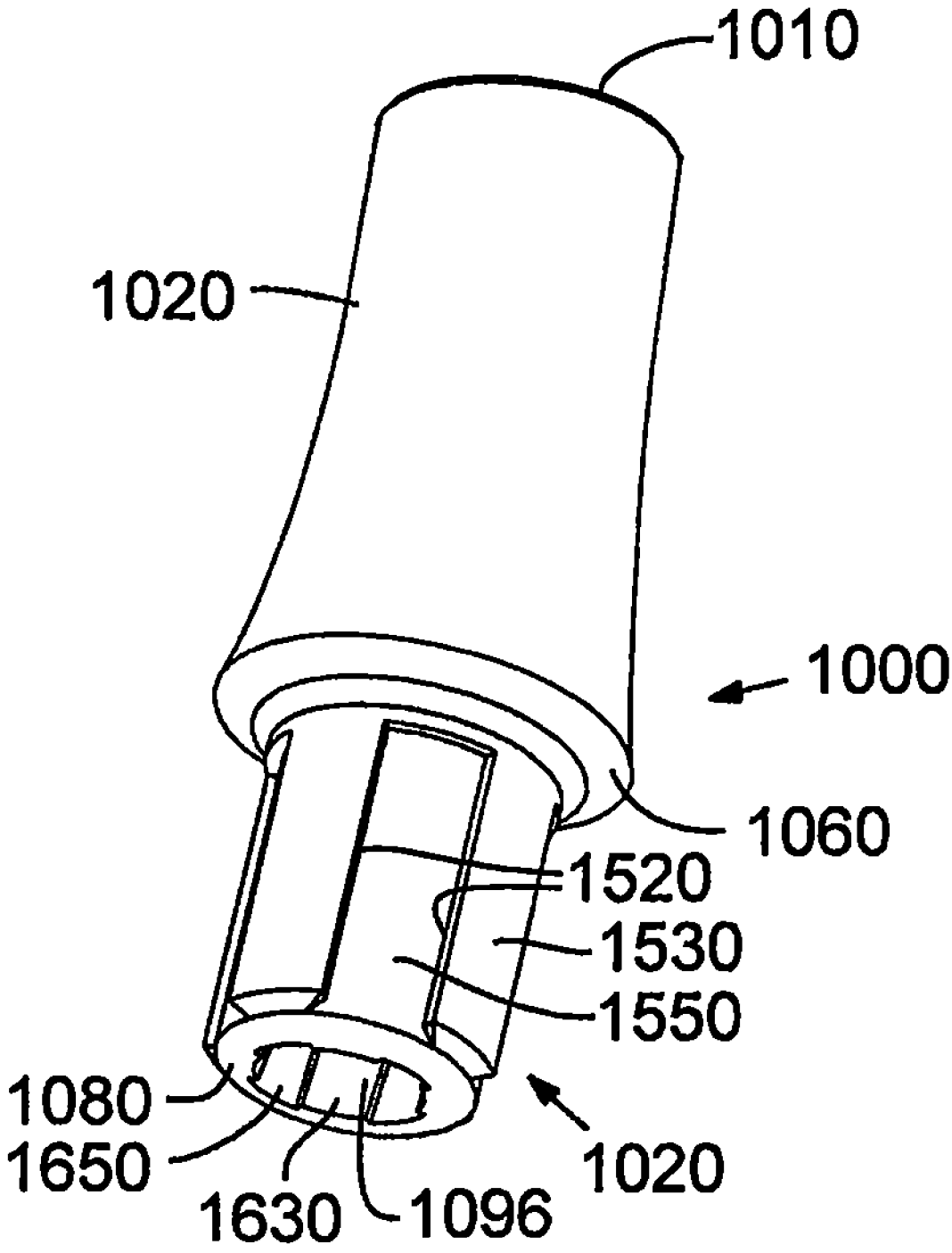
FIG. 28 is a perspective view of the hosel sleeve of FIG. 27.
Figure 36:
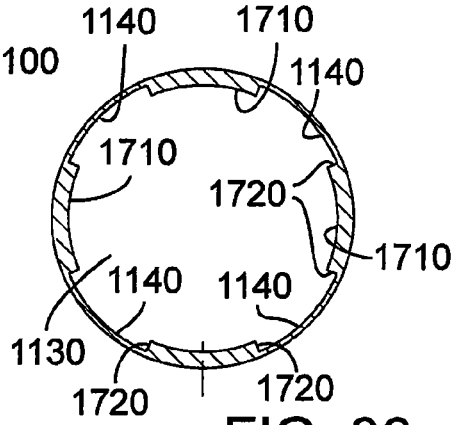
FIG. 36 is a cross-sectional view of the hosel insert, taken along line 36-36 of FIG. 34.
Figure 34:
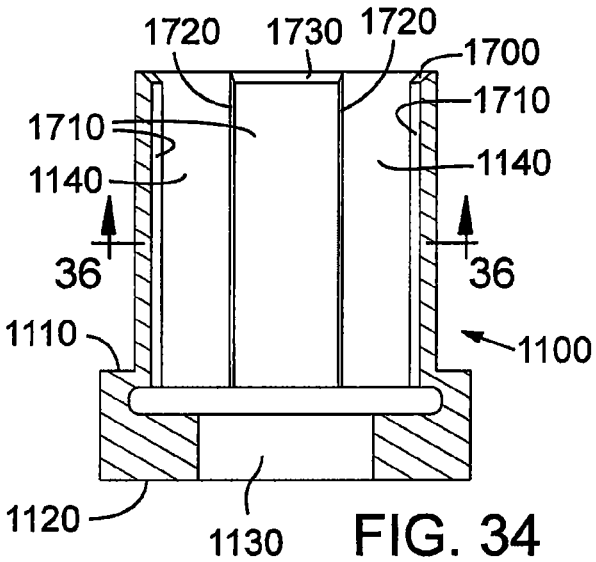
FIG. 34 is a cross-sectional view of the hosel insert of the connection usually shown in FIG. 18.
Figure 38:
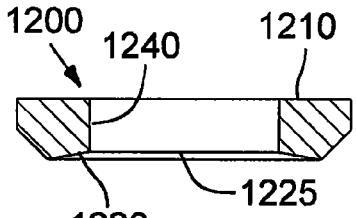
FIG. 38 is a cross-sectional view of the washer of the connection assembly shown in FIG. 18.
Figure 37:
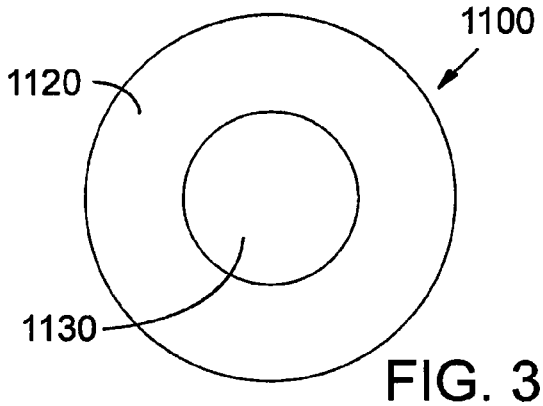
FIG. 37 is a bottom plan view of the hosel insert of FIG. 34.
Figure 39:
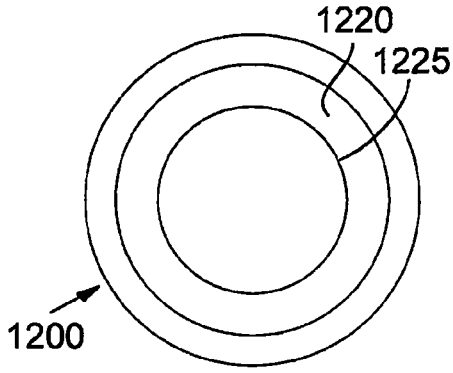
FIG. 39 is a bottom plan view of the washer of FIG. 38.
Figure 40:
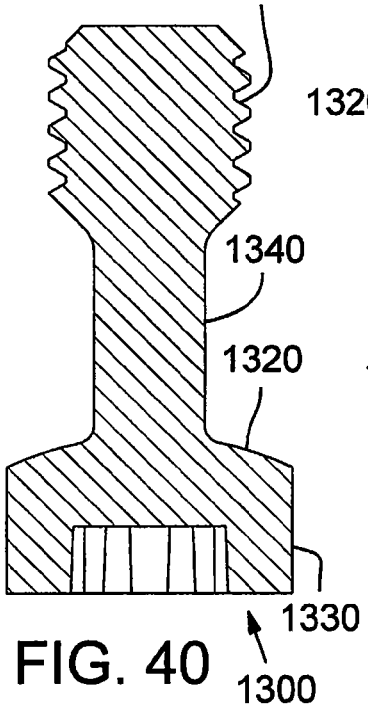
FIG. 40 is a cross-sectional view of the screw of FIG. 18.

To restrict rotational movement of the hosel sleeve 1000 relative to the club head 700, the hosel sleeve 1000 can have a lower, rotation prevention portion 1050 having a non-circular configuration that mates with a complementary, non-circular configuration of a rotation prevention portion of the hosel insert 1100. The rotation prevention portion of the hosel sleeve can comprise longitudinally extending splines 1500 formed on an external surface 1090 of a lower portion 1050 of the hosel sleeve 1000, as best shown in FIGS. 27-28 and 29. The rotation prevention portion of the hosel insert can comprise of complementary-configured splines 1700 formed on an inner surface 1140 of the hosel insert 1100, as best shown in FIGS. 34 and 36.

Accordingly, the shaft sleeve lower portion 950 defines a keyed portion that is received by a keyway defined by the hosel sleeve inner surface 1096, and hosel sleeve outer surface 1050 defines a keyed portion that is received by a keyway defined by the hosel insert inner surface 1140. In alternative embodiments, the rotation prevention portions can be elliptical, rectangular, hexagonal or other non-circular complementary configurations of the shaft sleeve lower portion 950 and the hosel sleeve inner surface 1096, and the hosel sleeve outer surface 1050 and the hosel insert inner surface 1140.

Referring to FIG. 18, the screw 1300 comprises a head 1330 having head, or bearing, surface 1320, a shaft 1340 extending from the head and external threads 1310 formed on a distal end portion of the screw shaft. The screw 1300 is used to secure the club head 700 to the shaft 800 by inserting the screw upwardly into passageway 710 via an opening in the sole of the club head. The screw is further inserted through the washer 1200 and tightened into an internally threaded bottom portion 996 of an opening 994 in the sleeve 900. In other embodiments, the club head 700 can be secured to the shaft 800 by other mechanical fasteners. With reference to FIGS. 18-19, when the screw 1300 is securely tightened into the shaft sleeve 900, the screw head surface 1320 contacts the washer 1200, the washer 1200 contacts a bottom surface 1120 of the hosel insert 1100, an annular surface 1060 of the hosel sleeve 1000 contacts an upper annular surface 730 of the club 700 and an annular surface 930 of the shaft sleeve 900 contacts an upper surface 1010 of the hosel sleeve 1000.

The hosel sleeve 1000 is configured to support the shaft 50 at a desired orientation relative to the club head to achieve a desired shaft loft and/or lie angle for the club. As best shown in FIGS. 27 and 31, the hosel sleeve 1000 comprises an upper portion 1020, a lower portion 1050, and a bore or longitudinal opening 1040 extending therethrough. The upper portion, which extends parallel the opening 1040, extends at an angle with respect to the lower portion 1050 defined as an "offset angle" 780 (FIG. 18). As best shown in FIG. 18, when the hosel insert 1040 is inserted into the hosel opening 710, the outer surface of the lower portion 1050 is co-axially aligned with the hosel insert 1100 and the hosel opening. In this manner, the outer surface of the lower portion 1050 of the hosel sleeve, the hosel insert 1100, and the hosel opening 710 collectively define a longitudinal axis B. When the shaft sleeve 900 is inserted into the hosel sleeve, the shaft sleeve and the shaft are co-axially aligned with the opening 1040 of the hosel sleeve. Accordingly, the shaft sleeve, the shaft, and the opening 1040 collectively define a longitudinal axis A of the assembly. As can be seen in FIG. 18, the hosel sleeve is effective to support the shaft 50 along longitudinal axis A, which is offset from longitudinal axis B by offset angle 780.

Consequently, the hosel sleeve 1000 can be positioned in the hosel insert 1100 in one or more positions to adjust the shaft loft and/or lie angle of the club. For example, FIG. 20 represents a connection assembly embodiment wherein the hosel sleeve can be positioned in four angularly spaced, discrete positions within the hosel insert 1100. As used herein, a sleeve having a plurality of "discrete positions" means that once the sleeve is inserted into the club head, it cannot be rotated about its longitudinal axis to an adjacent position, except for any play or tolerances between mating splines that allows for slight rotational movement of the sleeve prior to tightening the screw or other fastening mechanism that secures the shaft to the club head.

Referring to FIG. 20, crosshairs $A_1$-$A_4$ represent the position of the longitudinal axis A for each position of the hosel sleeve 1000. Positioning the hosel sleeve within the club head such that the shaft is adjusted inward towards the club head (such that the longitudinal axis A passes through crosshair $A_4$ in FIG. 20) increases the lie angle from an initial lie angle defined by longitudinal axis B; positioning the hosel sleeve such that the shaft is adjusted away from the club head (such that axis A passes through crosshair $A_3$) reduces the lie angle from an initial lie angle defined by longitudinal axis B. Similarly, positioning the hosel sleeve such that the shaft is adjusted forward toward the striking face (such that axis A passes through crosshair $A_2$) or rearward toward the rear of the club head (such that axis A passes through the crosshair $A_1$) will increase or decrease the shaft loft, respectively, from an initial shaft loft angle defined by longitudinal axis B. As noted above, adjusting the shaft loft is effective to adjust the square loft by the same amount. Similarly, the face angle is adjusted in proportion to the change in shaft loft. The amount of increase or decrease in shaft loft or lie angle in this example is equal to the offset angle 780.

Similarly, the shaft sleeve 900 can be inserted into the hosel sleeve at various angularly spaced positions around longitudinal axis A. Consequently, if the orientation of the shaft relative to the club head is adjusted by rotating the position of the hosel sleeve 1000, the position of the shaft sleeve within the hosel sleeve can be adjusted to maintain the rotational position of the shaft relative to longitudinal axis A. For example, if the hosel sleeve is rotated 90 degrees with respect to the hosel insert, the shaft sleeve can be rotated 90 degrees in the opposite direction with respect to the hosel sleeve in order to maintain the position of the shaft relative to its longitudinal axis. In this manner, the grip of the shaft and any visual indicia on the shaft can be maintained at the same position relative to the shaft axis as the shaft loft and/or lie angle is adjusted.

In another example, a connection assembly can employ a hosel sleeve that is positionable at eight angularly spaced positions within the hosel insert 1100, as represented by cross hairs $A_1$-$A_8$ in FIG. 20. Crosshairs $A_5$-$A_8$ represent hosel sleeve positions within the hosel insert 1100 that are effective to adjust both the lie angle and the shaft loft (and therefore the square loft and the face angle) relative to an initial lie angle and shaft loft defined by longitudinal axis B by adjusting the orientation of the shaft in a first direction inward or outward relative to the club head to adjust the lie angle and in a second direction forward or rearward relative to the club head to adjust the shaft loft. For example, crosshair $A_5$ represents a hosel sleeve position that adjusts the orientation of the shaft outward and rearward relative to the club head, thereby decreasing the lie angle and decreasing the shaft loft.

The connection assembly embodiment illustrated in FIGS. 18-20 provides advantages in addition to those provided by the illustrated embodiment of FIGS. 2-4 (e.g., ease of exchanging a shaft or club head) and already described above. Because the hosel sleeve can introduce a non-zero angle between the shaft and the hosel, a golfer can easily change the loft, lie and/or face angles of the club by changing the hosel sleeve. For example, the golfer can unscrew the screw 1300 from the shaft sleeve 900, remove the shaft 800 from the hosel sleeve 1000, remove the hosel sleeve 1000 from the hosel insert 1100, select another hosel sleeve having a desired offset angle, insert the shaft sleeve 900 into the replacement hosel sleeve, insert the replacement hosel sleeve into the hosel insert 1000, and tighten the screw 1300 into the shaft sleeve 900.

Thus, the use of a hosel sleeve in the shaft-head connection assembly allows the golfer to adjust the position of the shaft relative to the club head without having to resort to such traditional methods such as bending the shaft relative to the club head as described above. For example, consider a golf club utilizing the club head-shaft connection assembly of FIGS. 18-20 comprising a first hosel sleeve wherein the shaft axis is co-axially aligned with the hosel axis (i.e., the offset angle is zero, or, axis A passes through crosshair B). By exchanging the first hosel sleeve for a second hosel sleeve having a non-zero offset angle, a set of adjustments to the shaft loft, lie and/or face angles are possible, depending, in part, on the position of the hosel sleeve within the hosel insert.

In particular embodiments, the replacement hosel sleeves could be purchased individually from a retailer. In other embodiments, a kit comprising a plurality of hosel sleeves, each having a different offset angle can be provided. The number of hosel sleeves in the kit can vary depending on a desired range of offset angles and/or a desired granularity of angle adjustments. For example, a kit can comprise hosel sleeves providing offset angles from 0 degrees to 3 degrees, in 0.5 degree increments.

In particular embodiments, hosel sleeve kits that are compatible with any number of shafts and any number of club heads having the same hosel configuration and hosel insert 1100 are provided. In this manner, a pro shop or retailer need not necessarily stock a large number of shaft or club head variations with various loft, lie and/or face angles. Rather, any number of variations of club characteristic angles can be achieved by a variety of hosel sleeves, which can take up less retail shelf and storeroom space and provide the consumer with a more economic alternative to adjusting loft, lie or face angles (i.e., the golfer can adjust a loft angle by purchasing a hosel sleeve instead of a new club).

With reference now to FIGS. 21-26, there is shown the shaft sleeve 900 of the head—shaft connection assembly of FIGS. 18-20. The shaft sleeve 900 in the illustrated embodiment is substantially cylindrical and desirably is made from a light-weight, high-strength material (e.g., T6 temper aluminum alloy 7075). The shaft sleeve 900 can include a middle portion 910, an upper portion 920 and a lower portion 950. The upper portion 920 can have a greater thickness than the remainder of the shaft sleeve to provide, for example, additional mechanical integrity to the connection between the shaft 800 and the shaft sleeve 900. The upper portion 920 can have a flared or frustroconical shape as shown, to provide, for example, a more streamlined transition between the shaft 800 and club head 700. The boundary between the upper portion 920 and the middle portion 910 defines an upper annular thrust surface 930 and the boundary between the middle portion 910 and the lower portion 950 defines a lower annular surface 940. The shaft sleeve 900 has a bottom surface 980. In the illustrated embodiment, the annular surface 930 is perpendicular to the external surface of the middle portion 910. In other embodiments, the annular surface 930 may be frustroconical or otherwise taper from the upper portion 920 to the middle portion 910. The annular surface 930 bears against the upper surface 1010 of the hosel insert 1000 when the shaft 800 is secured to the club head 700 (FIG. 18).

The shaft sleeve 900 further comprises an opening 994 extending the length of the shaft sleeve 900, as depicted in FIG. 23. The opening 994 has an upper portion 998 for receiving the shaft 800 and an internally threaded bottom portion 996 for receiving the screw 1300. In the illustrated embodiment, the opening upper portion 998 has an internal sidewall having a constant diameter that is complementary to the configuration of the lower end portion of the shaft 800. In other embodiments, the opening upper portion 998 can have a configuration adapted to mate with various shaft profiles (e.g., the opening upper portion 998 can have more than one inner diameter, chamfered and/or perpendicular annular surfaces, etc.). With reference to the illustrated embodiment of FIG. 23, splines 1400 are located below the opening upper portion 998 and therefore below the shaft to minimize the overall diameter of the shaft sleeve. In certain embodiments, the internal threads of the lower opening 996 are created using a Spiralock® tap.

In particular embodiments, the rotation prevention portion of the shaft sleeve comprises a plurality of splines 1400 on an external surface 960 of the lower portion 950 that are elongated in the direction of the longitudinal axis of the shaft sleeve 900, as shown in FIGS. 21-22 and 26. The splines 1400 have sidewalls 1420 extending radially outwardly from the external surface 960, bottom edges 1410, bottom corners 1422 and arcuate outer surfaces 1450. In other embodiments, the external surface 960 can comprise more splines (such as up to 12) or fewer than four splines and the splines 1400 can have different shapes and sizes.

With reference now to FIGS. 27-33, there is shown the hosel sleeve 1000 of the head—shaft connection assembly of FIGS. 18-20. The hosel sleeve 1000 in the illustrated embodiment is substantially cylindrical and desirably is made from a light-weight, high-strength material (e.g., T6 temper aluminum alloy 7075). As noted above, the hosel sleeve 1000 includes an upper portion 1020 and a lower portion 1050. As shown in the illustrated embodiment of FIG. 27, the upper portion 1020 can have a flared or frustroconical shape, with the boundary between the upper portion 1020 and the lower portion 1050 defining an annular thrust surface 1060. In the illustrated embodiment, the annular surface 1060 tapers from the upper portion 1020 to the lower portion 1050. In other embodiments, the annular surface 1060 can be perpendicular to the external surface 1090 of the lower portion 1050. As best shown in FIG. 18, the annular surface 1060 bears against the upper annular surface 730 of the hosel when the shaft 800 is secured to the club head 700.

The hosel sleeve 1000 further comprises an opening 1040 extending the length of the hosel sleeve 1000. The hosel sleeve opening 1040 has an upper portion 1094 with internal sidewalls 1095 that are complementary configured to the configuration of the shaft sleeve middle portion 910, and a lower portion 1096 defining a rotation prevention portion having a non-circular configuration complementary to the configuration of shaft sleeve lower portion 950.

The non-circular configuration of the hosel sleeve lower portion 1096 comprises a plurality of splines 1600 formed on an inner surface 1650 of the opening lower portion 1096. With reference to FIGS. 30-31, the inner surface 1650 comprises four splines 1600 elongated in the direction of the longitudinal axis (axis A) of the hosel sleeve opening. The splines 1600 in the illustrated embodiment have sidewalls 1620 extending radially inwardly from the inner surface 1650 and arcuate inner surfaces 1630.

The external surface of the lower portion 1050 defines a rotation prevention portion comprising four splines 1500 elongated in the direction of and are parallel to longitudinal axis B defined by the external surface of the lower portion, as depicted in FIGS. 27 and 31. The splines 1500 have sidewalls 1520 extending radially outwardly from the surface 1550, top and bottom edges 1540 and accurate outer surfaces 1530.

The splined configuration of the shaft sleeve 900 dictates the degree to which the shaft sleeve 900 is positionable within the hosel sleeve 1000. In the illustrated embodiment of FIGS. 26 and 30, the splines 1400 and 1600 are substantially identical in shape and size and adjacent pairs of splines 1400 and 1600 have substantially similar spline-to-spline spacings. This spline configuration allows the shaft sleeve 900 to be positioned within the hosel sleeve 1000 at four angularly spaced positions relative to the hosel sleeve 1000. Similarly, the hosel sleeve 1000 can be positioned within the club head 700 at four angularly spaced positions. In other embodiments, different non-circular configurations (e.g., triangular, hexagonal, more or fewer splines, variable spline-to-spline spacings or spline widths) of the shaft sleeve lower portion 950, the hosel opening lower portion 1096, the hosel lower portion 1050 and the hosel insert inner surface 1140 could provide for various degrees of positionability.

The external surface of the shaft sleeve lower portion 950, the internal surface of the hosel sleeve opening lower portion 1096, the external surface of the hosel sleeve lower portion 1050, and the internal surface of the hosel insert can have generally rougher surfaces relative to the remaining surfaces of the shaft sleeve 900, the hosel sleeve 1000 and the hosel insert. The enhanced surface roughness provides, for example, greater friction between the shaft sleeve 900 and the hosel sleeve 1000 and between the hosel sleeve 1000 and the hosel insert 1100 to further restrict relative rotational movement between these components. The contacting surfaces of shaft sleeve, the hosel sleeve and the hosel insert can be roughened by sandblasting, although alternative methods or techniques can be used.

Figure 35:
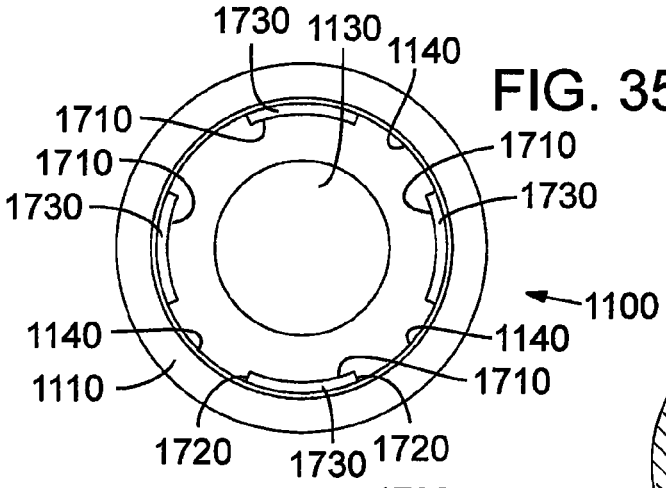
FIG. 35 is a top plan view of the hosel insert of FIG. 34.

With reference now to FIGS. 34-36, the hosel insert 1100 desirably is substantially tubular or cylindrical and can be made from a light-weight, high-strength material (e.g., grade 5 6Al-4V titanium alloy). The hosel insert 1100 comprises an inner surface 1140 defining a rotation prevention portion having a non-circular configuration that is complementary to the non-circular configuration of the hosel sleeve outer surface 1090. In the illustrated embodiment, the non-circulation configuration of inner surface 1140 comprises internal splines 1700 that are complementary in shape and size to the external splines 1500 of the hosel sleeve 1000. That is, there are four splines 1700 elongated in the direction of the longitudinal axis of the hosel insert 1100, and the splines 1700 have sidewalls 1720 extending radially inwardly from the inner surface 1140, chamfered top edges 1730 and inner surfaces 1710. The hosel insert 1100 can comprises an annular surface 1110 that contacts hosel annual surface 720 when the insert 1100 is mounted in the hosel opening 710 as depicted in FIG. 18. Additionally, the hosel opening 710 can have an annular shoulder (similar to shoulder 360 in FIG. 3). The insert 1100 can be welded or otherwise secured to the shoulder.

With reference now to FIGS. 18-20, the screw 1300 desirably is made from a lightweight, high-strength material (e.g., T6 temper aluminum alloy 7075). In certain embodiments, the major diameter (i.e., outer diameter) of the threads 1310 is about 4 mm (e.g., ISO screw size) but may be smaller or larger in alternative embodiments. The benefits of using a screw 1300 having a reduced thread diameter (about 4 mm or less) include the benefits described above with respect to screw 400 (e.g., the ability to place the screw under a greater preload for a given torque).

The head 1330 of the screw 1300 can be similar to the head 410 of the screw 400 (FIG. 15) and can comprise a hexalobular internal driving feature as described above. In additional embodiments, the screw head 1330 can comprise various other drive designs (e.g., Phillips, Pozidriv, hexagonal, TTAP, etc.), and the user can use a conventional screwdriver to tighten the screw.

As best shown in FIGS. 38-42, the screw 1300 desirably has an inclined, spherical bottom surface 1320. The washer 1200 desirably comprises a tapered bottom surface 1220, an upper surface 1210, an inner surface 1240 and an inner circumferential edge 1225 defined by the boundary between the tapered surface 1220 and the inner surface 1240. As discussed above and as shown in FIG. 18, a hosel sleeve 1000 can be selected to support the shaft at a non-zero angle with respect to the longitudinal axis of the hosel opening. In such a case, the shaft sleeve 900 and the screw 1300 extend at a non-zero angle with respect to the longitudinal axis of the hosel insert 1100 and the washer 1200. Because of the inclined surfaces 1320 and 1220 of the screw and the washer, the screw head can make complete contact with the washer through 360 degrees to better secure the shaft sleeve in the hosel insert. In certain embodiments, the screw head can make complete contact with the washer regardless of the position of the screw relative to the longitudinal axis of the hosel opening.

Figure 41:
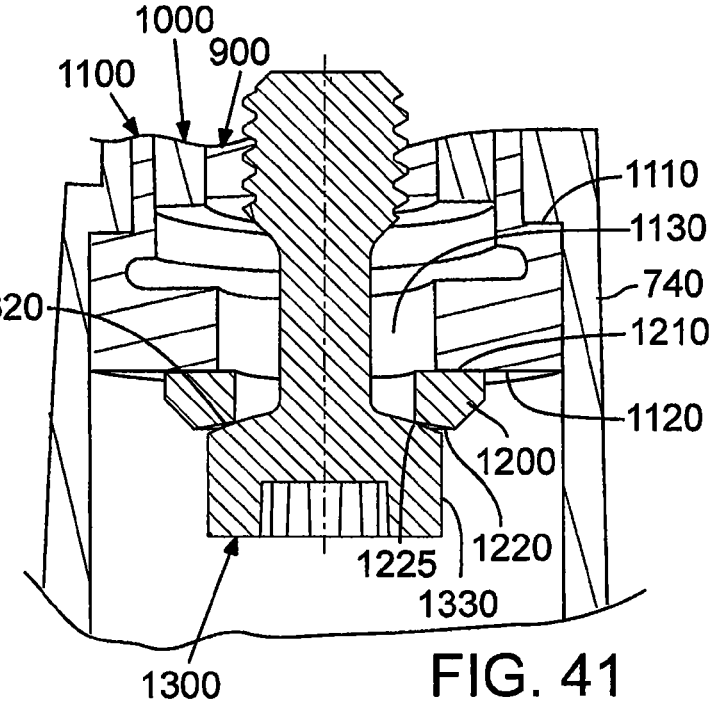
FIG. 41 is a cross-sectional view depicting the screw-washer interface of a connection assembly where the hosel sleeve longitudinal axis is aligned with the longitudinal axis of the hosel opening.
Figure 42:
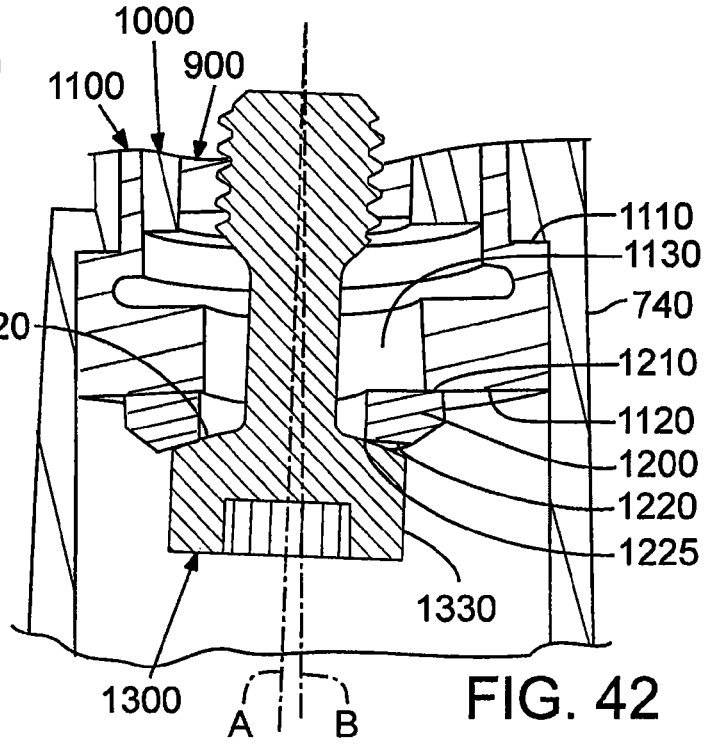
FIG. 42 is a cross-sectional view depicting a screw-washer interface of a connection assembly where the hosel sleeve longitudinal axis is offset from the longitudinal axis of the hosel opening.

For example, in the illustrated embodiment of FIG. 41, the head-shaft connection assembly employs a first hosel sleeve having a longitudinal axis that is co-axially aligned with the hosel sleeve opening longitudinal axis (i.e., the offset angle between the two longitudinal axes A and B is zero). The screw 1300 contacts the washer 1200 along the entire circumferential edge 1225 of the washer 1200. When the first hosel sleeve is exchanged for a second hosel sleeve having a non-zero offset angle, as depicted in FIG. 42, the tapered washer surface 1220 and the tapered screw head surface 1320 allow for the screw 1300 to maintain contact with the entire circumferential edge 1225 of the washer 1200. Such a washer-screw connection allows the bolt to be loaded in pure axial tension without being subjected to any bending moments for a greater preload at a given installation torque, resulting in the club head 700 being more reliably and securely attached to the shaft 800. Additionally, this configuration allows for the compressive force of the screw head to be more evenly distributed across the washer upper surface 1210 and hosel insert bottom surface 1120 interface.

Figure 43A:
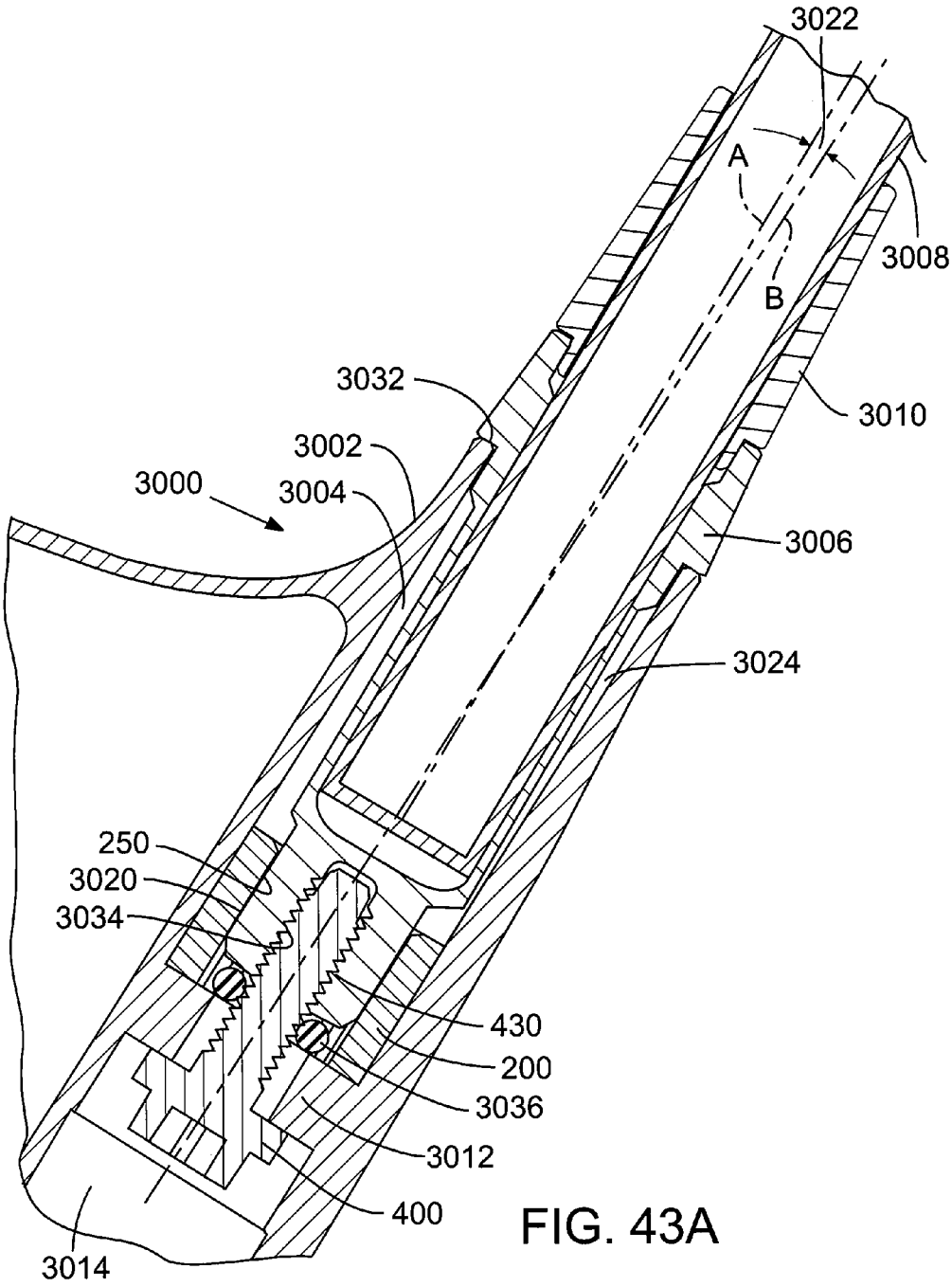
FIG. 43A is an enlarged cross-sectional view of a golf club head having a removable shaft, in accordance with another embodiment.

FIG. 43A shows another embodiment of a gold club assembly that has a removable shaft that can be supported at various positions relative to the head to vary the shaft loft and/or the lie angle of the club. The assembly comprises a club head 3000 having a hosel 3002 defining a hosel opening 3004. The hosel opening 3004 is dimensioned to receive a shaft sleeve 3006, which in turn is secured to the lower end portion of a shaft 3008. The shaft sleeve 3006 can be adhesively bonded, welded or secured in equivalent fashion to the lower end portion of the shaft 3008. In other embodiments, the shaft sleeve 3006 can be integrally formed with the shaft 3008. As shown, a ferrule 3010 can be disposed on the shaft just above the shaft sleeve 3006 to provide a transition piece between the shaft sleeve and the outer surface of the shaft 3008.

The hosel opening 3004 is also adapted to receive a hosel insert 200 (described in detail above), which can be positioned on an annular shoulder 3012 inside the club head. The hosel insert 200 can be secured in place by welding, an adhesive, or other suitable techniques. Alternatively, the insert can be integrally formed in the hosel opening. The club head 3000 further includes an opening 3014 in the bottom or sole of the club head that is sized to receive a screw 400. Much like the embodiment shown in FIG. 2, the screw 400 is inserted into the opening 3014, through the opening in shoulder 3012, and is tightened into the shaft sleeve 3006 to secure the shaft to the club head. However, unlike the embodiment shown in FIG. 2, the shaft sleeve 3006 is configured to support the shaft at different positions relative to the club head to achieve a desired shaft loft and/or lie angle.

Figure 43B:
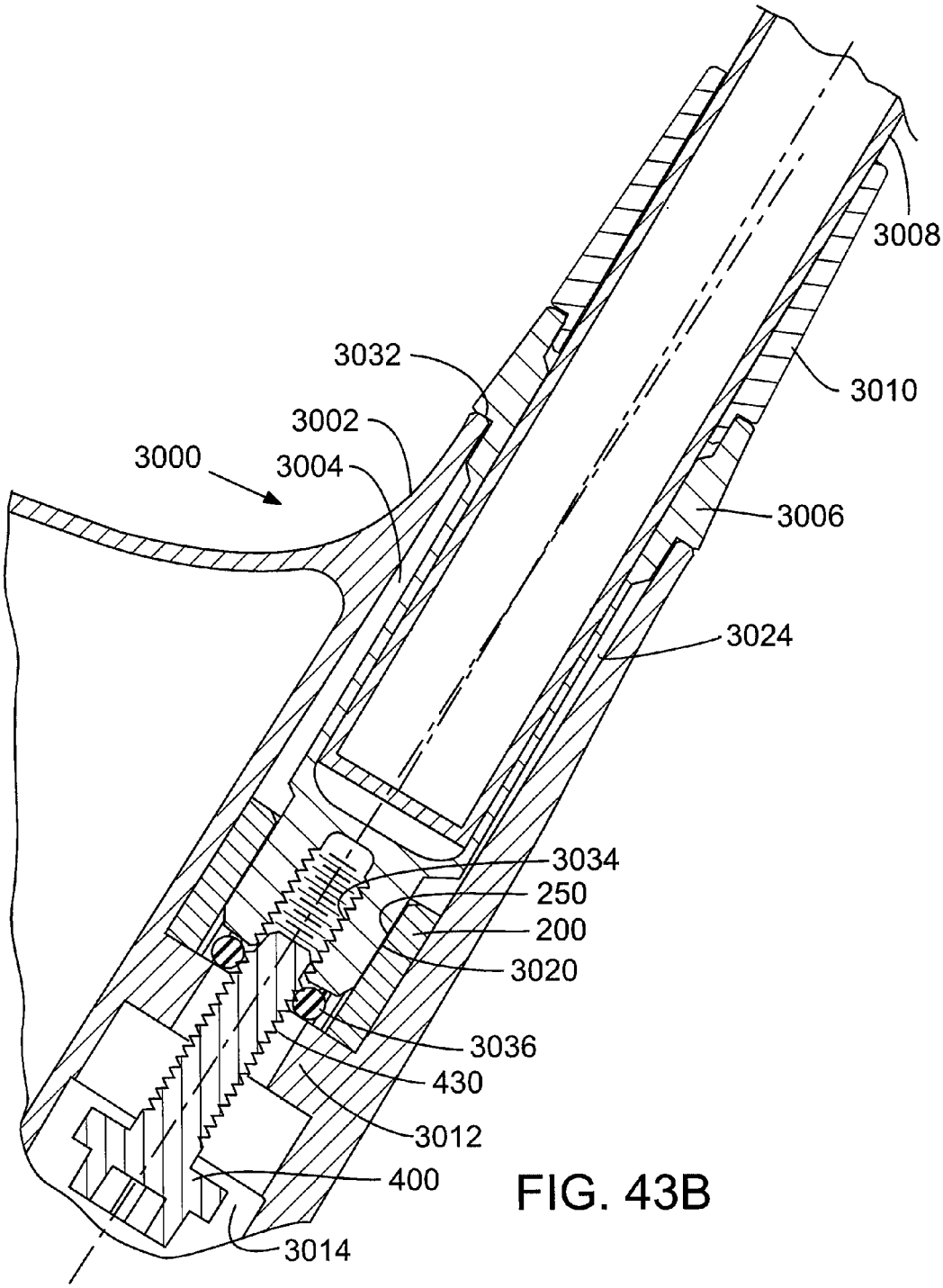
FIG. 43B shows the golf club head of FIG. 43A with the screw loosened to permit removal of the shaft from the club head.
Figure 44:
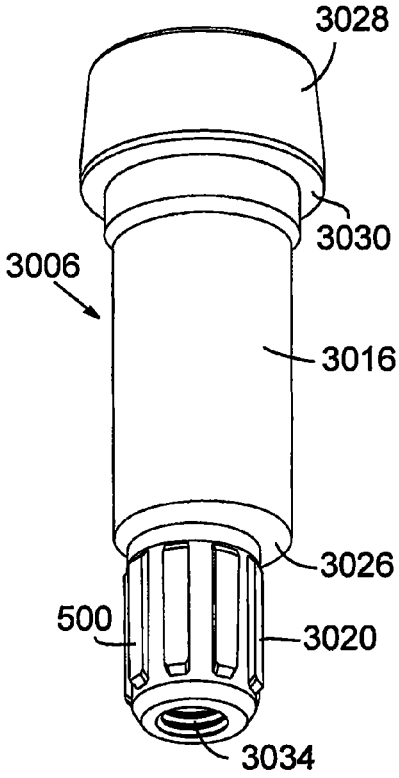
FIG. 44 is a perspective view of the shaft sleeve of the assembly shown in FIG. 43.
Figure 45:
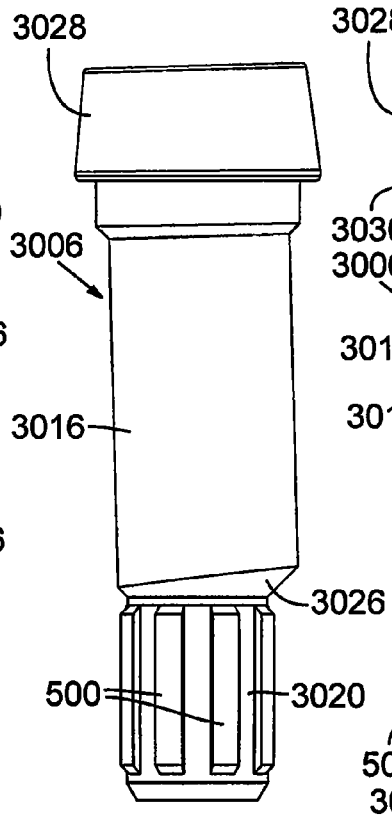
FIG. 45 is a side elevation view of the shaft sleeve of FIG. 44.

If desired, a screw capturing device, such as in the form of an o-ring or washer 3036, can be placed on the shaft of the screw 400 above shoulder 3012 to retain the screw in place within the club head when the screw is loosened to permit removal of the shaft from the club head. The ring 3036 desirably is dimensioned to frictionally engage the threads of the screw and has a outer diameter that is greater than the central opening in shoulder 3012 so that the ring 3036 cannot fall through the opening. When the screw 400 is tightened to secure the shaft to the club head, as depicted in FIG. 43A, the ring 3036 desirably is not compressed between the shoulder 3012 and the adjacent lower surface of the shaft sleeve 3006. FIG. 43B shows the screw 400 removed from the shaft sleeve 3006 to permit removal of the shaft from the club head. As shown, in the disassembled state, the ring 3036 captures the distal end of the screw to retain the screw within the club head to prevent loss of the screw. The ring 3036 desirably comprises a polymeric or elastomeric material, such as rubber, Viton, Neoprene, silicone, or similar materials. The ring 3036 can be an o-ring having a circular cross-sectional shape as depicted in the illustrated embodiment. Alternatively, the ring 3036 can be a flat washer having a square or rectangular cross-sectional shape. In other embodiments, the ring 3036 can various other cross-sectional profiles.

The shaft sleeve 3006 is shown in greater detail in FIGS. 44-47. The shaft sleeve 3006 in the illustrated embodiment comprises an upper portion 3016 having an upper opening 3018 for receiving and a lower portion 3020 located below the lower end of the shaft. The lower portion 3020 can have a threaded opening 3034 for receiving the threaded shaft of the screw 400. The lower portion 3020 of the sleeve can comprise a rotation prevention portion configured to mate with a rotation prevention portion of the hosel insert 200 to restrict relative rotation between the shaft and the club head. As shown, the rotation prevention portion can comprise a plurality of longitudinally extending external splines 500 that are adapted to mate with corresponding internal splines 240 of the hosel insert 200 (FIGS. 11-14). The lower portion 3020 and the external splines 500 formed thereon can have the same configuration as the shaft lower portion 150 and splines 500 shown in FIGS. 5-7 and 9-10 and described in detail above. Thus, the details of splines 500 are not repeated here.

Unlike the embodiment shown in FIGS. 5-7 and 9-10, the upper portion 3016 of the sleeve extends at an offset angle 3022 relative to the lower portion 3020. As shown in FIG. 43, when inserted in the club head, the lower portion 3020 is co-axially aligned with the hosel insert 200 and the hosel opening 3004, which collectively define a longitudinal axis B. The upper portion 3016 of the shaft sleeve 3006 defines a longitudinal axis A and is effective to support the shaft 3008 along axis A, which is offset from longitudinal axis B by offset angle 3022. Inserting the shaft sleeve at different angular positions relative to the hosel insert is effective to adjust the shaft loft and/or the lie angle, as further described below.

Figure 47:
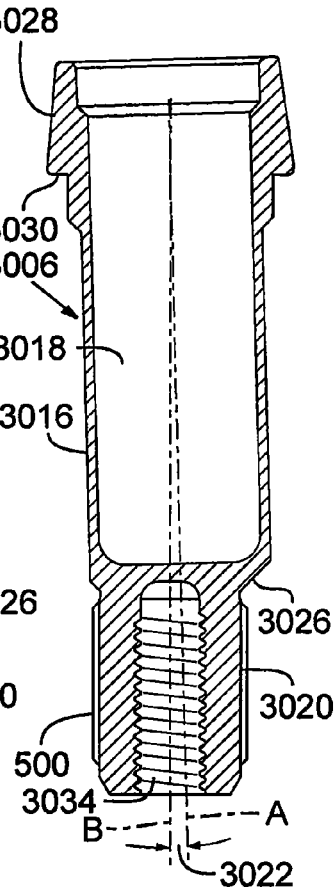
FIG. 47 is a cross-sectional view of the shaft sleeve taken along line 47-47 of FIG. 46.
Figure 46:
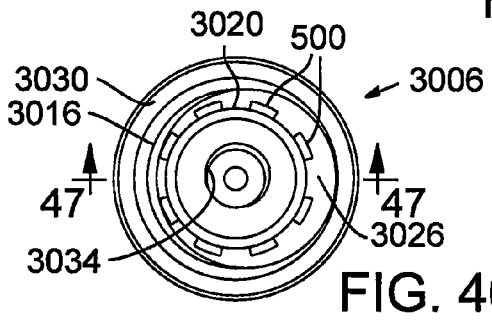
FIG. 46 is a bottom plan view of the shaft sleeve of FIG. 44.

As best shown in FIG. 47, the upper portion 3016 of the shaft sleeve desirably has a constant wall thickness from the lower end of opening 3018 to the upper end of the shaft sleeve. A tapered surface portion 3026 extends between the upper portion 3016 and the lower portion 3020. The upper portion 3016 of the shaft sleeve has an enlarged head portion 3028 that defines an annular bearing surface 3030 that contacts an upper surface 3032 of the hosel 3002 (FIG. 43). The bearing surface 3030 desirably is oriented at a 90-degree angle with respect to longitudinal axis B so that when the shaft sleeve is inserted in to the hosel, the bearing surface 3030 can make complete contact with the opposing surface 3032 of the hosel through 360 degrees.

As further shown in FIG. 43, the hosel opening 3004 desirably is dimensioned to form a gap 3024 between the outer surface of the upper portion 3016 of the sleeve and the opposing internal surface of the club head. Because the upper portion 3016 is not co-axially aligned with the surrounding inner surface of the hosel opening, the gap 3024 desirably is large enough to permit the shaft sleeve to be inserted into the hosel opening with the lower portion extending into the hosel insert at each possible angular position relative to longitudinal axis B. For example, in the illustrated embodiment, the shaft sleeve has eight external splines 500 that are received between eight internal splines 240 of the hosel insert 200. The shaft sleeve and the hosel insert can have the configurations shown in FIGS. 10 and 13, respectively. This allows the sleeve to be positioned within the hosel insert at two positions spaced 180 degrees from each other, as previously described.

Figure 48:
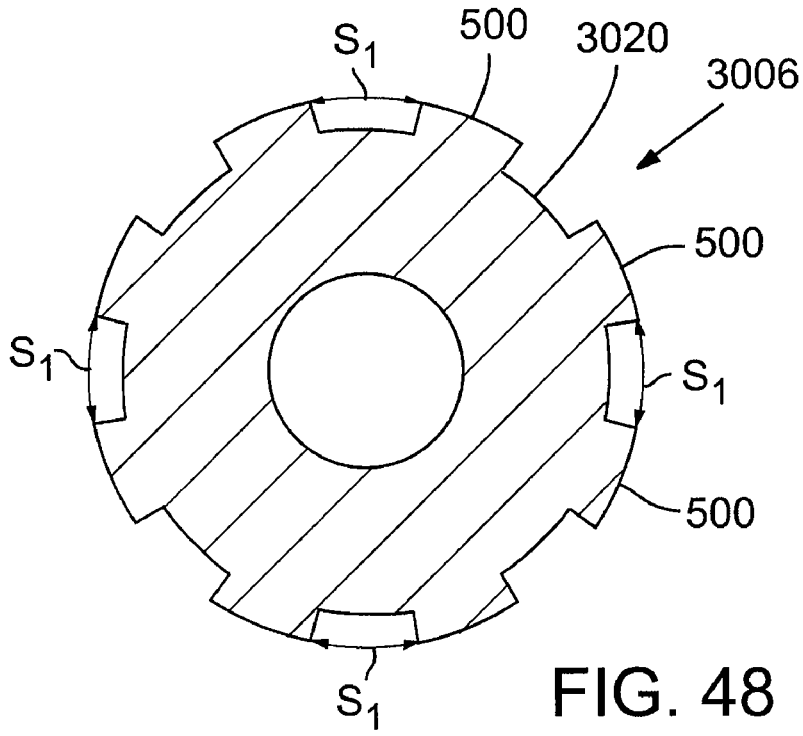
FIG. 48 is a cross-sectional view of another embodiment of a shaft sleeve and FIG. 49 is a top plan view of a hosel insert that is adapted to receive the shaft sleeve.
Figure 49:
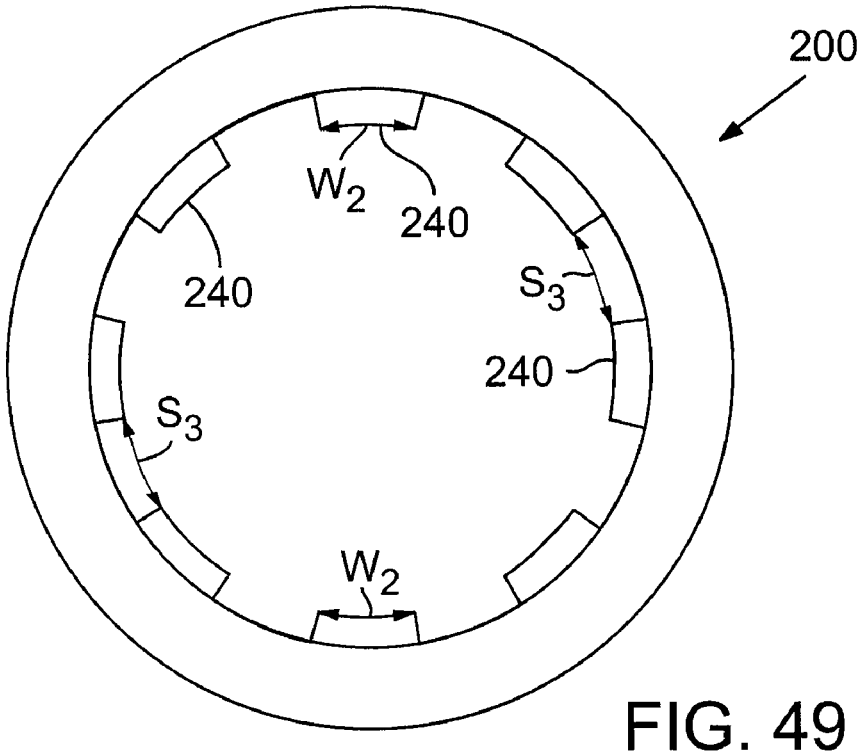

Other shaft sleeve and hosel insert configurations can be used to vary the number of possible angular positions for the shaft sleeve relative to the longitudinal axis B. FIGS. 48 and 49, for example, show an alternative shaft sleeve and hosel insert configuration in which the shaft sleeve 3006 has eight equally spaced splines 500 with radial sidewalls 502 that are received between eight equally spaced splines 240 of the hosel insert 200. Each spline 500 is spaced from an adjacent spline by spacing $S_1$ dimensioned to receive a spline 240 of the hosel insert having a width $W_2$. This allows the lower portion 3020 of the shaft sleeve to be inserted into the hosel insert 200 at eight angularly spaced positions around longitudinal axis B (similar to locations $A_1$-$A_8$ shown in FIG. 20). In a specific embodiment, the spacing $S_1$ is about 23 degrees, the arc angle of each spline 500 is about 22 degrees, and the width $W_2$ is about 22.5 degrees.

Figure 50:
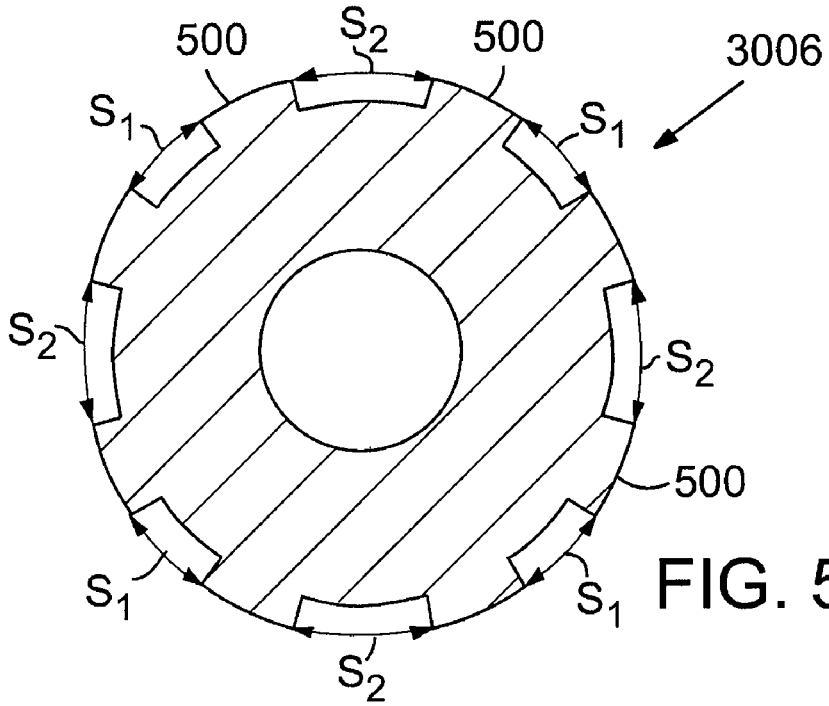
FIG. 50 is a cross-sectional view of another embodiment of a shaft sleeve and FIG. 51 is a top plan view of a hosel insert that is adapted to receive the shaft sleeve.
Figure 51:
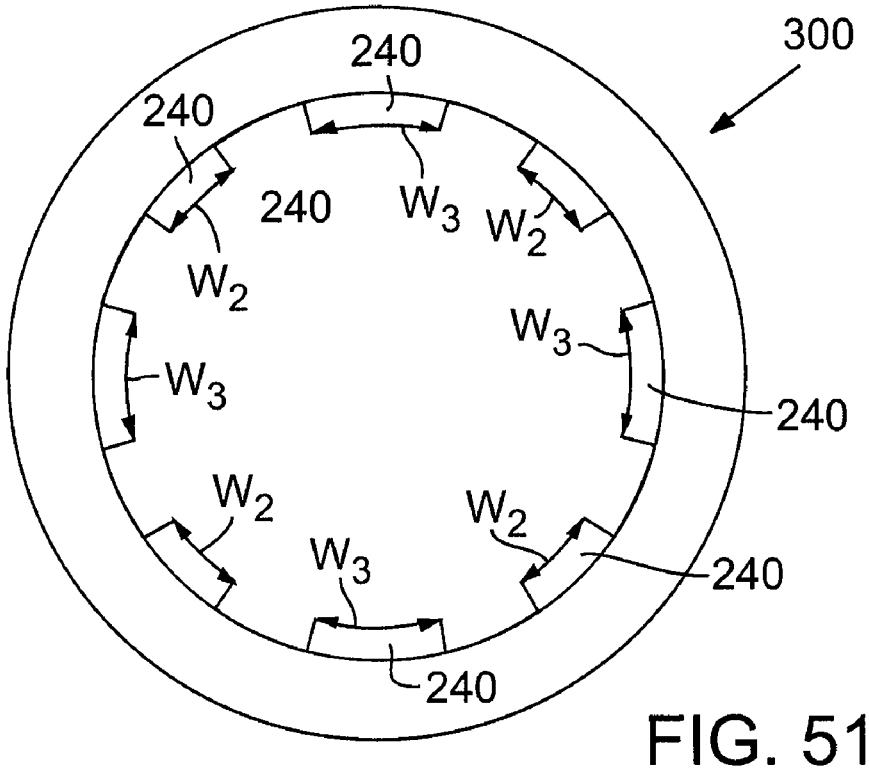

FIGS. 50 and 51 show another embodiment of a shaft sleeve and hosel insert configuration. In the embodiment of FIGS. 50 and 51, the shaft sleeve 3006 (FIG. 50) has eight splines 500 that are alternately spaced by spline-to-spline spacing $S_1$ and $S_2$, where $S_2$ is greater than $S_1$. Each spline has radial sidewalls 502 providing the same advantages previously described with respect to radial sidewalls. Similarly, the hosel insert 200 (FIG. 51) has eight splines 240 having alternating widths $W_2$ and $W_3$ that are slightly less than spline spacing $S_1$ and $S_2$, respectively, to allow each spline 240 of width $W_2$ to be received within spacing $S_1$ of the shaft sleeve and each spline 240 of width $W_3$ to be received within spacing $S_2$ of the shaft sleeve. This allows the lower portion 3020 of the shaft sleeve to be inserted into the hosel insert 200 at four angularly spaced positions around longitudinal axis B. In a particular embodiment, the spacing $S_1$ is about 19.5 degrees, the spacing $S_2$ is about 29.5 degrees, the arc angle of each spline 500 is about 20.5 degrees, the width $W_2$ is about 19 degrees, and the width $W_3$ is about 29 degrees. In addition, using a greater or fewer number of splines on the shaft sleeve and mating splines on the hosel insert increases and decreases, respectively, the number of possible positions for shaft sleeve.

As can be appreciated, the assembly shown in FIGS. 43-51 is similar to the embodiment shown in FIGS. 18-20 in that both permit a shaft to be supported at different orientations relative to the club head to vary the shaft loft and/or lie angle. An advantage of the assembly of FIGS. 43-51 is that it includes less pieces than the assembly of FIGS. 18-20, and therefore is less expensive to manufacture and has less mass (which allows for a reduction in overall weight).

Figure 60:
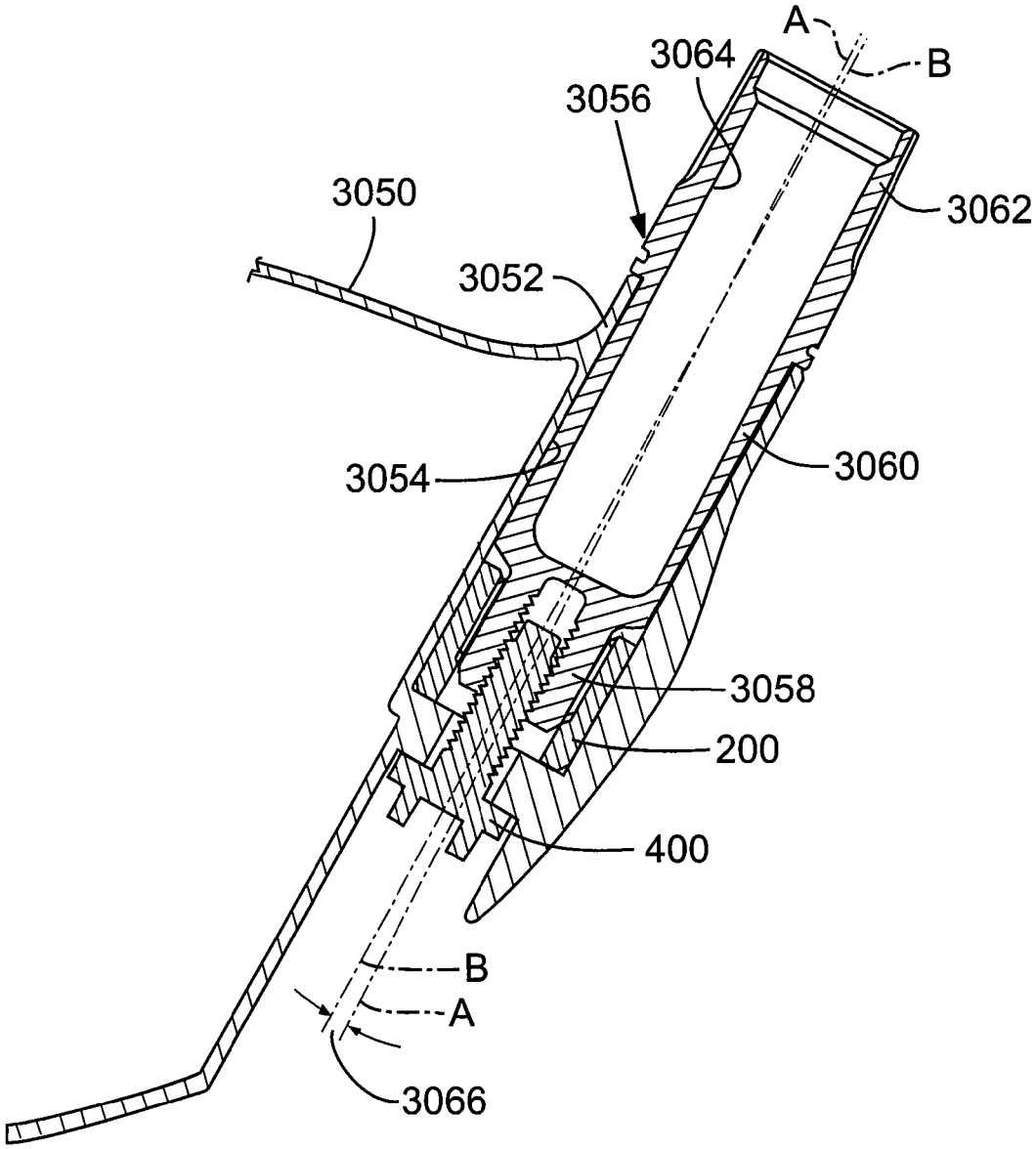
FIG. 60 is an enlarged cross-sectional view of a golf club head having a removable shaft, in accordance with another embodiment.

FIG. 60 shows an another embodiment of a golf club assembly that is similar to the embodiment shown in FIG. 43A. The embodiment of FIG. 60 includes a club head 3050 having a hosel 3052 defining a hosel opening 3054, which in turn is adapted to receive a hosel insert 200. The hosel opening 3054 is also adapted to receive a shaft sleeve 3056 mounted on the lower end portion of a shaft (not shown in FIG. 60) as described herein.

The shaft sleeve 3056 has a lower portion 3058 including splines that mate with the splines of the hosel insert 200, an intermediate portion 3060 and an upper head portion 3062. The intermediate portion 3060 and the head portion 3062 define an internal bore 3064 for receiving the tip end portion of the shaft. In the illustrated embodiment, the intermediate portion 3060 of the shaft sleeve has a cylindrical external surface that is concentric with the inner cylindrical surface of the hosel opening 3054. In this manner, the lower and intermediate portions 3058, 3060 of the shaft sleeve and the hosel opening 3054 define a longitudinal axis B. The bore 3064 in the shaft sleeve defines a longitudinal axis A to support the shaft along axis A, which is offset from axis B by a predetermined angle 3066 determined by the bore 3064. As described above, inserting the shaft sleeve 3056 at different angular positions relative to the hosel insert 200 is effective to adjust the shaft loft and/or the lie angle.

Figure 61:
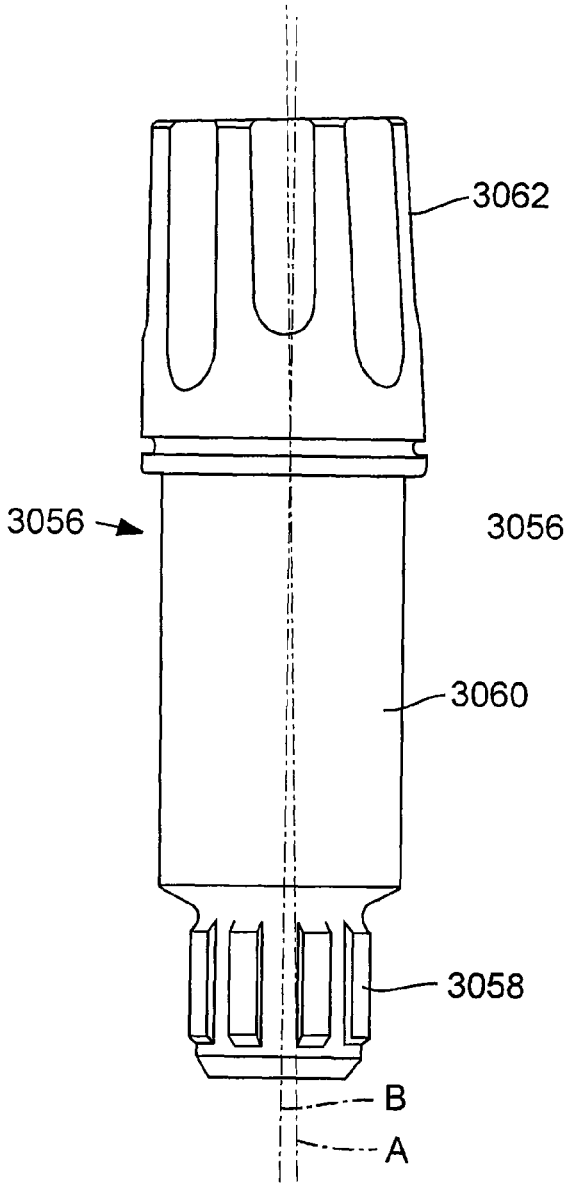
FIGS. 61 and 62 are front elevation and cross-sectional views, respectively, of the shaft sleeve of the assembly shown in FIG. 60.
Figure 62:
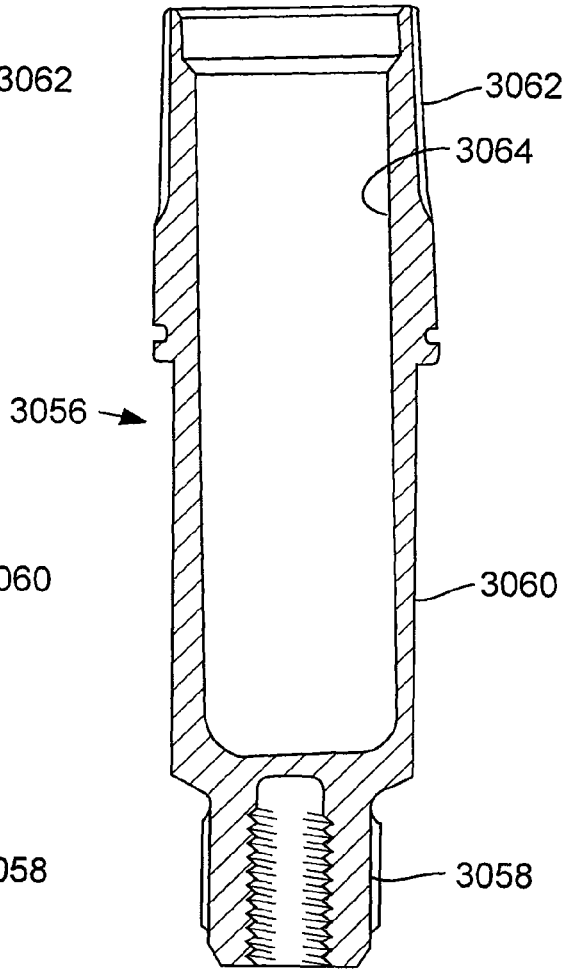

In this embodiment, because the intermediate portion 3060 is concentric with the hosel opening 3054, the outer surface of the intermediate portion 3060 can contact the adjacent surface of the hosel opening, as depicted in FIG. 60. This allows easier alignment of the mating features of the assembly during installation of the shaft and further improves the manufacturing process and efficiency. FIGS. 61 and 62 are enlarged views of the shaft sleeve 3056. As shown, the head portion 3062 of the shaft sleeve (which extends above the hosel 3052) can be angled relative to the intermediate portion 3060 by the angle 3066 so that the shaft and the head portion 3062 are both aligned along axis A. In alternative embodiments, the head portion 3062 can be aligned along axis B so that it is parallel to the intermediate portion 3060 and the lower portion 3058.

Adjustable Sole

As discussed above, the grounded loft 80 of a club head is the vertical angle of the centerface normal vector when the club is in the address position (i.e., when the sole is resting on the ground), or stated differently, the angle between the club face and a vertical plane when the club is in the address position. When the shaft loft of a club is adjusted, such as by employing the system disclosed in FIGS. 18-42 or the system shown in FIGS. 43-51 or by traditional bending of the shaft, the grounded loft does not change because the orientation of the club face relative to the sole of the club head does not change. On the other hand, adjusting the shaft loft is effective to adjust the square loft of the club by the same amount. Similarly, when shaft loft is adjusted and the club head is placed in the address position, the face angle of the club head increases or decreases in proportion to the change in shaft loft. For example, for a club having a 60-degree lie angle, decreasing the shaft loft by approximately 0.6 degree increases the face angle by +1.0 degree, resulting in the club face being more "open" or turned out. Conversely, increasing the shaft loft by approximately 0.6 degree decreases the face angle by −1.0 degree, resulting in the club face being more "closed" or turned in.

Figure 52:
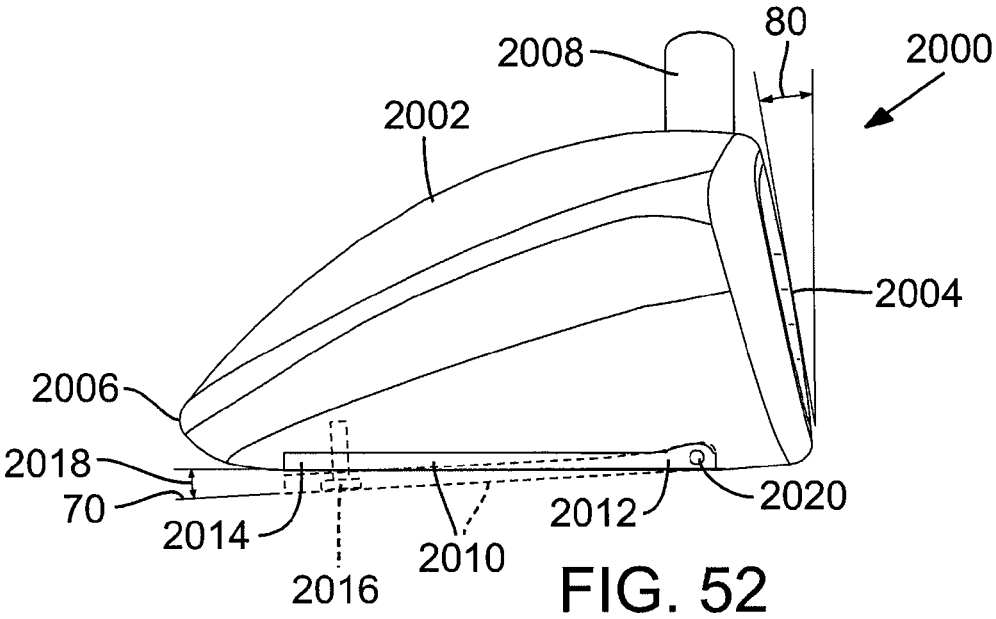
FIG. 52 is a side elevational view of a golf club head having an adjustable sole plate, in accordance with one embodiment.
Figure 53:
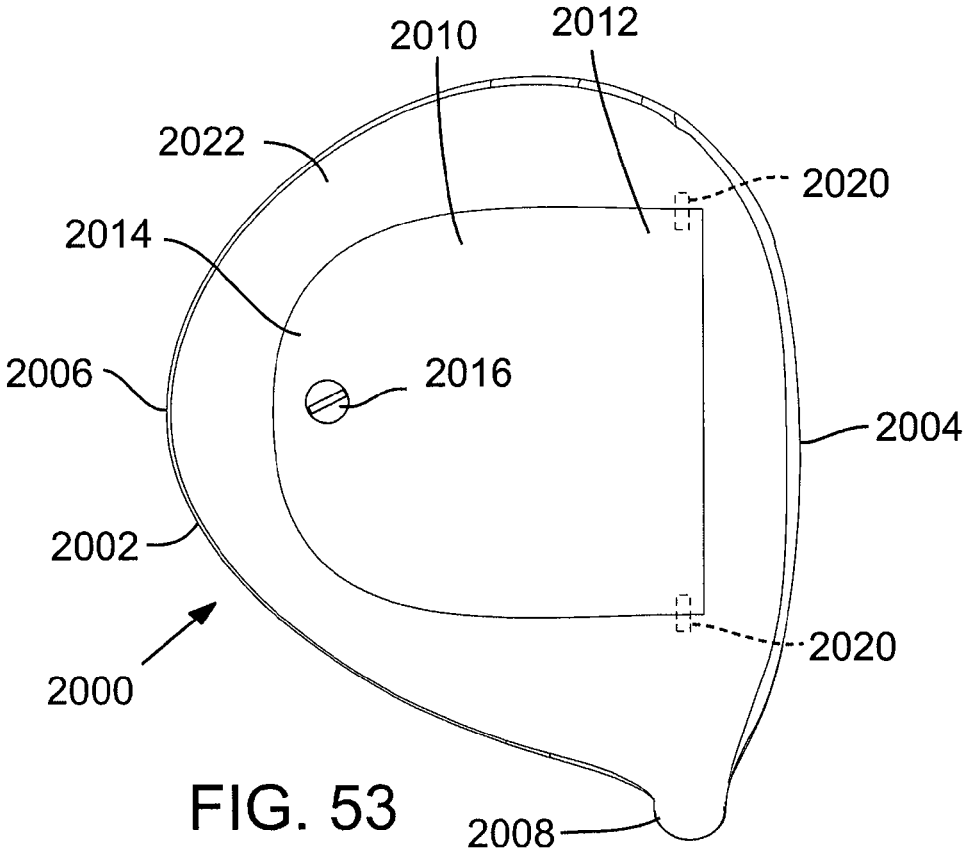
FIG. 53 is a bottom plan view of the golf club head of FIG. 48.
Figure 54:
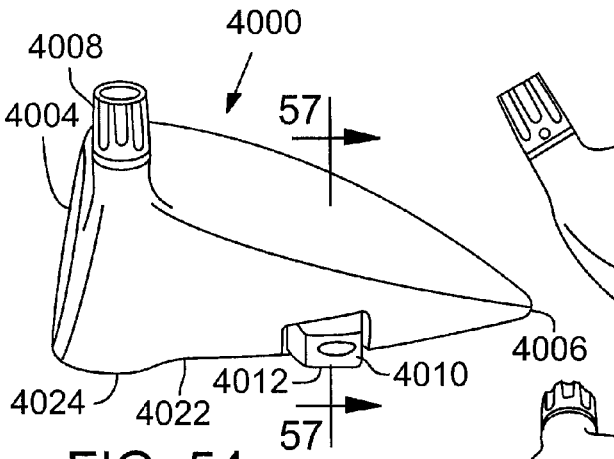
FIG. 54 is a side elevation view of a golf club head having an adjustable sole portion, according to another embodiment.
Figure 55:
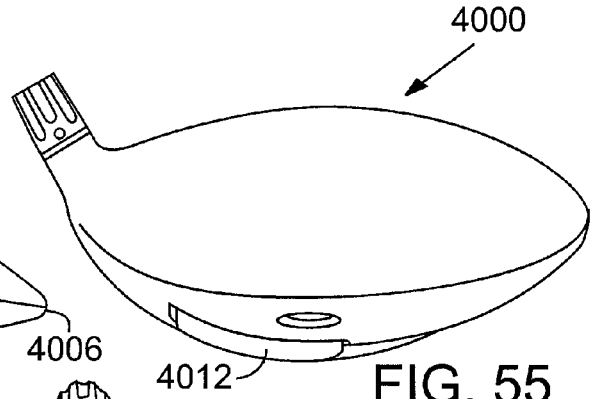
FIG. 55 is a rear elevation view of the golf club head of FIG. 54.

Conventional clubs do not allow for adjustment of the hosel/shaft loft without causing a corresponding change in the face angle. FIGS. 52-53 illustrates a club head 2000, according to one embodiment, configured to "decouple" the relationship between face angle and hosel/shaft loft (and therefore square loft), that is, allow for separate adjustment of square loft and face angle. The club head 2000 in the illustrated embodiment comprises a club head body 2002 having a rear end 2006, a striking face 2004 defining a forward end of the body, and a bottom portion 2022. The body also has a hosel 2008 for supporting a shaft (not shown).

The bottom portion 2022 comprises an adjustable sole 2010 (also referred to as an adjustable "sole portion") that can be adjusted relative to the club head body 2002 to raise and lower at least the rear end of the club head relative to the ground. As shown, the sole 2010 has a forward end portion 2012 and a rear end portion 2014. The sole 2010 can be a flat or curved plate that can be curved to conform to the overall curvature of the bottom 2022 of the club head. The forward end portion 2012 is pivotably connected to the body 2002 at a pivot axis defined by pivot pins 2020 to permit pivoting of the sole relative to the pivot axis. The rear end portion 2014 of the sole therefore can be adjusted upwardly or downwardly relative to the club head body so as to adjust the "sole angle" 2018 of the club (FIG. 52), which is defined as the angle between the bottom of the adjustable sole 2010 and the non-adjustable bottom surface 2022 of the club head body. As can be seen, varying the sole angle 2018 causes a corresponding change in the grounded loft 80. By pivotably connecting the forward end portion of the adjustable sole, the lower leading edge of the club head at the junction of the striking face and the lower surface can be positioned just off the ground at contact between the club head and a ball. This is desirable to help avoid so-called "thin" shots (when the club head strikes the ball too high, resulting in a low shot) and to allow a golfer to hit a ball "off the deck" without a tee if necessary.

The club head can have an adjustment mechanism that is configured to permit manual adjustment of the sole 2010. In the illustrated embodiment, for example, an adjustment screw 2016 extends through the rear end portion 2014 and into a threaded opening in the body (not shown). The axial position of the screw relative to the sole 2010 is fixed so that adjustment of the screw causes corresponding pivoting of the sole 2010. For example, turning the screw in a first direction lowers the sole 2010 from the position shown in solid lines to the position shown in dashed lines in FIG. 52. Turning the screw in the opposite direction raises the sole relative to the club head body. Various other techniques and mechanisms can be used to affect raising and lowering of the sole 2010.

Moreover, other techniques or mechanisms can be implemented in the club head 2000 to permit raising and lowering of the sole angle of the club. For example, the club head can comprise one or more lifts that are located near the rear end of the club head, such as shown in the embodiment of FIGS. 54-58, discussed below. The lifts can be configured to be manually extended downwardly through openings in the bottom portion 2022 of the club head to increase the sole angle and retracted upwardly into the club head to decrease the sole angle. In a specific implementation, a club head can have a telescoping protrusion near the aft end of the head which can be telescopingly extended and retracted relative to the club head to vary the sole angle.

In particular embodiments, the hosel 2008 of the club head can be configured to support a removable shaft at different predetermined orientations to permit adjustment of the shaft loft and/or lie angle of the club. For example, the club head 2000 can be configured to receive the assembly described above and shown in FIG. 19 (shaft sleeve 900, adapter sleeve 1000, and insert 1100) to permit a user to vary the shaft loft and/or lie angle of the club by selecting an adapter sleeve 1000 that supports the club shaft at the desired orientation. Alternatively, the club head can be adapted to receive the assembly shown in FIGS. 43-47 to permit adjustment of the shaft loft and/or lie angle of the club. In other embodiments, a club shaft can be connected to the hosel 2008 in a conventional manner, such as by adhesively bonding the shaft to the hosel, and the shaft loft can be adjusted by bending the shaft and hosel relative to the club head in a conventional manner. The club head 2000 also can be configured for use with the removable shaft assembly described above and disclosed in FIGS. 1-16.

Varying the sole angle of the club head changes the address position of the club head, and therefore the face angle of the club head. By adjusting the position of the sole and by adjusting the shaft loft (either by conventional bending or using a removable shaft system as described herein), it is possible to achieve various combinations of square loft and face angle with one club. Moreover, it is possible to adjust the shaft loft (to adjust square loft) while maintaining the face angle of club by adjusting the sole a predetermined amount.

As an example, Table 5 below shows various combinations of square loft, grounded loft, face angle, sole angle, and hosel loft that can be achieved with a club head that has a nominal or initial square loft of 10.4 degrees and a nominal or initial face angle of 6.0 degrees and a nominal or initial grounded loft of 14 degrees at a 60-degree lie angle. The nominal condition in Table 5 has no change in sole angle or hosel loft angle (i.e., Δ sole angle=0.0 and Δ hosel loft angle=0.0). The parameters in the other rows of Table 5 are deviations to this nominal state (i.e., either the sole angle and/or the hosel loft angle has been changed relative to the nominal state). In this example, the hosel loft angle is increased by 2 degrees, decreased by 2 degrees or is unchanged, and the sole angle is varied in 2-degree increments. As can be seen in the table, these changes in hosel loft angle and sole angle allows the square loft to vary from 8.4, 10.4, and 12.4 with face angles of −4.0, −0.67, 2.67, −7.33, 6.00, and 9.33. In other examples, smaller increments and/or larger ranges for varying the sole angle and the hosel loft angle can be used to achieve different values for square loft and face angle.

Also, it is possible to decrease the hosel loft angle and maintain the nominal face angle of 6.0 degrees by increasing the sole angle as necessary to achieve a 6.0-degree face angle at the adjusted hosel loft angle. For example, decreasing the hosel loft angle by 2 degrees of the club head represented in Table 5 will increase the face angle to 9.33 degrees. Increasing the sole angle to about 2.0 degrees will readjust the face angle to 6.0 degrees.

TABLE 5

| Square loft (deg) | Grounded loft (deg) | Face angle (deg) "+" = open "−" = closed | Δ Sole angle (deg) | Δ Hosel loft angle (deg) "+" = weaker "−" = stronger |
|---|---|---|---|---|
| 12.4 | 10.0 | −4.00 | 4.0 | 2.0 |
| 10.4 | 8.0 | −4.00 | 6.0 | 0.0 |
| 8.4 | 6.0 | −4.00 | 8.0 | −2.0 |
| 12.4 | 12.0 | −0.67 | 2.0 | 2.0 |
| 10.4 | 10.0 | −0.67 | 4.0 | 0.0 |
| 8.4 | 8.0 | −0.67 | 6.0 | −2.0 |
| 12.4 | 14.0 | 2.67 | 0.0 | 2.0 |
| 10.4 | 12.0 | 2.67 | 2.0 | 0.0 |
| 8.4 | 10.0 | 2.67 | 4.0 | −2.0 |
| 12.4 | 8.0 | −7.33 | 6.0 | 2.0 |
| 10.4 | 14.0 | 6.00 | 0.0 | 0.0 |
| 8.4 | 14.0 | 9.33 | 0.0 | −2.0 |
| 8.4 | 6.0 | −4.00 | 8.0 | −2.0 |

FIGS. 54-58 illustrates a golf club head 4000, according to another embodiment, that has an adjustable sole. The club head 4000 comprises a club head body 4002 having a rear end 4006, a striking face 4004 defining a forward end of the body, and a bottom portion 4022. The body also has a hosel 4008 for supporting a shaft (not shown). The bottom portion 4022 defines a leading edge surface portion 4024 adjacent the lower edge of the striking face that extends transversely across the bottom portion 4022 (i.e., the leading edge surface portion 4024 extends in a direction from the heel to the toe of the club head body).

Figure 56:
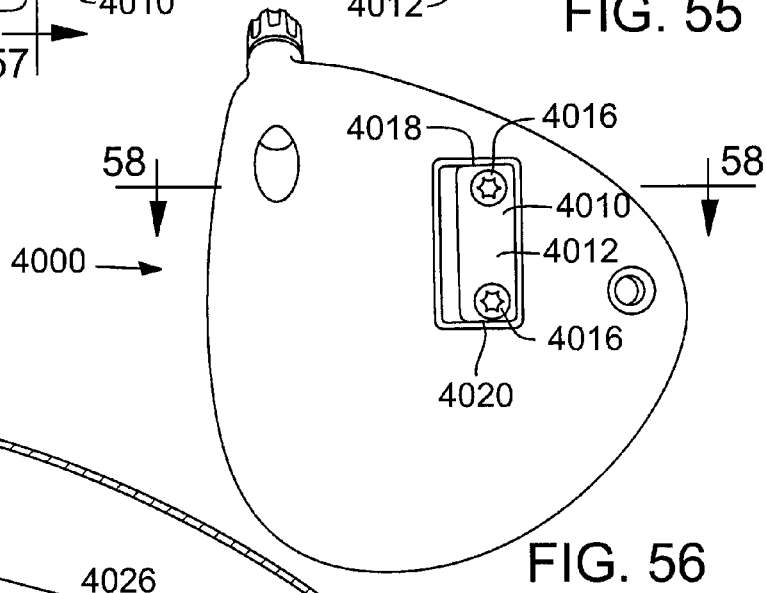
FIG. 56 is a bottom plan view of the golf club head of FIG. 54.

The bottom portion 4022 further includes an adjustable sole portion 4010 that can be adjusted relative to the club head body 4002 to raise and lower the rear end of the club head relative to the ground. As best shown in FIG. 56, the adjustable sole portion 4010 is elongated in the heel-to-toe direction of the club head and has a lower surface 4012 that desirably is curved to match the curvature of the leading edge surface portion 4024. In the illustrated embodiment, both the leading edge surface 4024 and the bottom surface 4012 of the sole portion 4010 are concave surfaces. In other embodiments, surfaces 4012 and 4024 are not necessarily curved surfaces but they desirably still have the same profile extending in the heel-to-toe direction. In this manner, if the club head deviates from the grounded address position (e.g., the club is held at a lower or flatter lie angle), the effective face angle of the club head does not change substantially, as further described below. The crown to face transition or top-line would stay relatively stable when viewed from the address position as the club is adjusted between the lie ranges described herein. Therefore, the golfer is better able to align the club with the desired direction of the target line. In some embodiments, the top-line transition is clearly delineated by a masking line between the painted crown and the unpainted face.

The sole portion 4010 has a first edge 4018 located toward the heel of the club head and a second edge 4020 located at about the middle of the width of the club head. In this manner, the sole portion 4010 (from edge 4018 to edge 4020) has a length that extends transversely across the club head less than half the width of the club head. As noted above, studies have shown that most golfers address the ball with a lie angle between 10 and 20 degrees less than the intended scoreline lie angle of the club head (the lie angle when the club head is in the address position). The length of the sole portion 4010 in the illustrated embodiment is selected to support the club head on the ground at the grounded address position or any lie angle between 0 and 20 degrees less than the lie angle at the grounded address position. In alternative embodiments, the sole portion 4010 can have a length that is longer or shorter than that of the illustrated embodiment to support the club head at a greater or smaller range of lie angles. For example, the sole portion 4010 can extend past the middle of the club head to support the club head at lie angles that are greater than the scoreline lie angle (the lie angle at the grounded address position).

Figure 58:
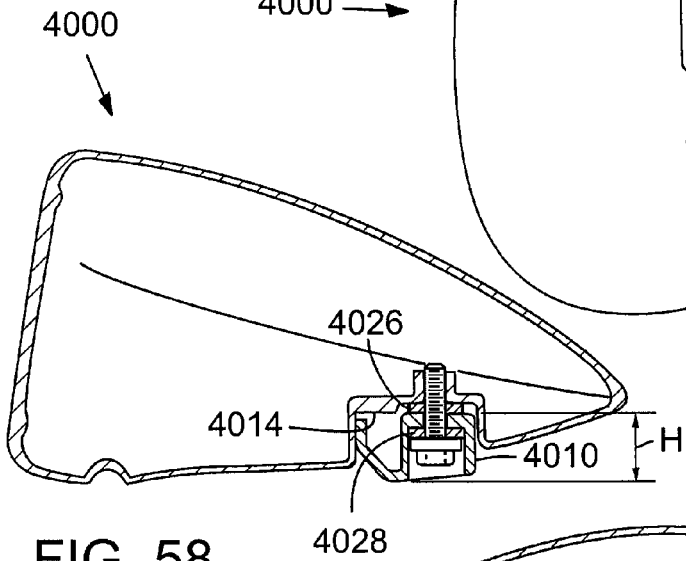
FIG. 58 is a cross-sectional view of the golf club head taken along line 58-58 of FIG. 56.
Figure 57:
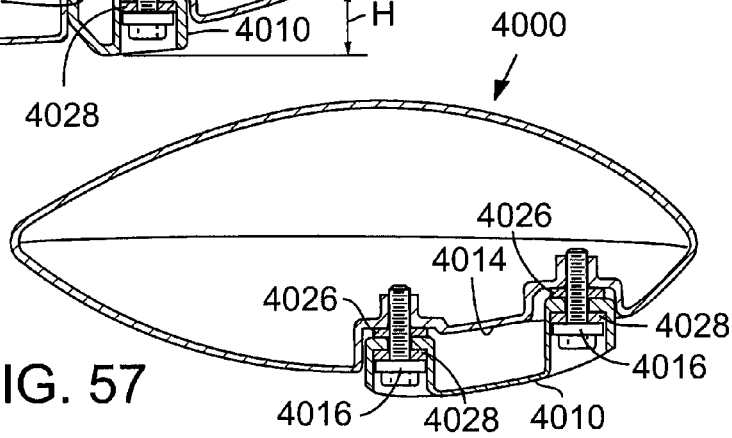
FIG. 57 is a cross-sectional view of the golf club head taken along line 57-57 of FIG. 54.

As best shown in FIGS. 57 and 58, the bottom portion of the club head body can be formed with a recess 4014 that is shaped to receive the adjustable sole portion 4010. One or more screws 4016 (two are shown in the illustrated embodiment) can extend through respective washers 4028, corresponding openings in the adjustable sole portion 4010, one or more shims 4026 and into threaded openings in the bottom portion 4022 of the club head body. The sole angle of the club head can be adjusted by increasing or decreasing the number of shims 4026, which changes the distance the sole portion 4010 extends from the bottom of the club head. The sole portion 4010 can also be removed and replaced with a shorter or taller sole portion 4010 to change the sole angle of the club. In one implementation, the club head is provided with a plurality of sole portions 4010, each having a different height H (FIG. 58) (e.g., the club head can be provided with a small, medium and large sole portion 4010). Removing the existing sole portion 4010 and replacing it with one having a greater height H increases the sole angle while replacing the existing sole portion 4010 with one having a smaller height H will decrease the sole angle.

In an alternative embodiment, the axial position of each of the screws 4016 relative to the sole portion 4010 is fixed so that adjustment of the screws causes the sole portion 4010 to move away from or closer to the club head. Adjusting the sole portion 4010 downwardly increases the sole angle of the club head while adjusting the sole portion upwardly decreases the sole angle of the club head.

When a golfer changes the actual lie angle of the club by tilting the club toward or away from the body so that the club head deviates from the grounded address position, there is a slight corresponding change in face angle due to the loft of the club head. The effective face angle, eFA, of the club head is a measure of the face angle with the loft component removed (i.e. the angle between the horizontal component of the face normal vector and the target line vector), and can be determined by the following equation:

$$eFA = -\arctan\left[\frac{(\sin\Delta lie \cdot \sin GL \cdot \cos MFA) - (\cos\Delta lie \cdot \sin MFA)}{\cos GL \cdot \cos MFA}\right] \quad \text{Eq. 3}$$

where Δlie=measured lie angle−scoreline lie angle,
GL is the grounded loft angle of the club head, and
MFA is the measured face angle.

As noted above, the adjustable sole portion 4010 has a lower surface 4012 that matches the curvature of the leading edge surface portion 4024 of the club head. Consequently, the effective face angle remains substantially constant as the golfer holds the club with the club head on the playing surface and the club is tilted toward and away from the golfer so as to adjust the actual lie angle of the club. In particular embodiments, the effective face angle of the club head 4000 is held constant within a tolerance of +/−0.2 degrees as the lie angle is adjusted through a range of 0 degrees to about 20 degrees less than the scoreline lie angle. In a specific implementation, for example, the scoreline lie angle of the club head is 60 degrees and the effective face angle is held constant within a tolerance of +/−0.2 degrees for lie angles between 60 degrees and 40 degrees. In another example, the scoreline lie angle of the club head is 60 degrees and the effective face angle is held constant within a tolerance of +/−0.1 degrees for lie angles between 60 degrees and 40 degrees.

Figure 59:
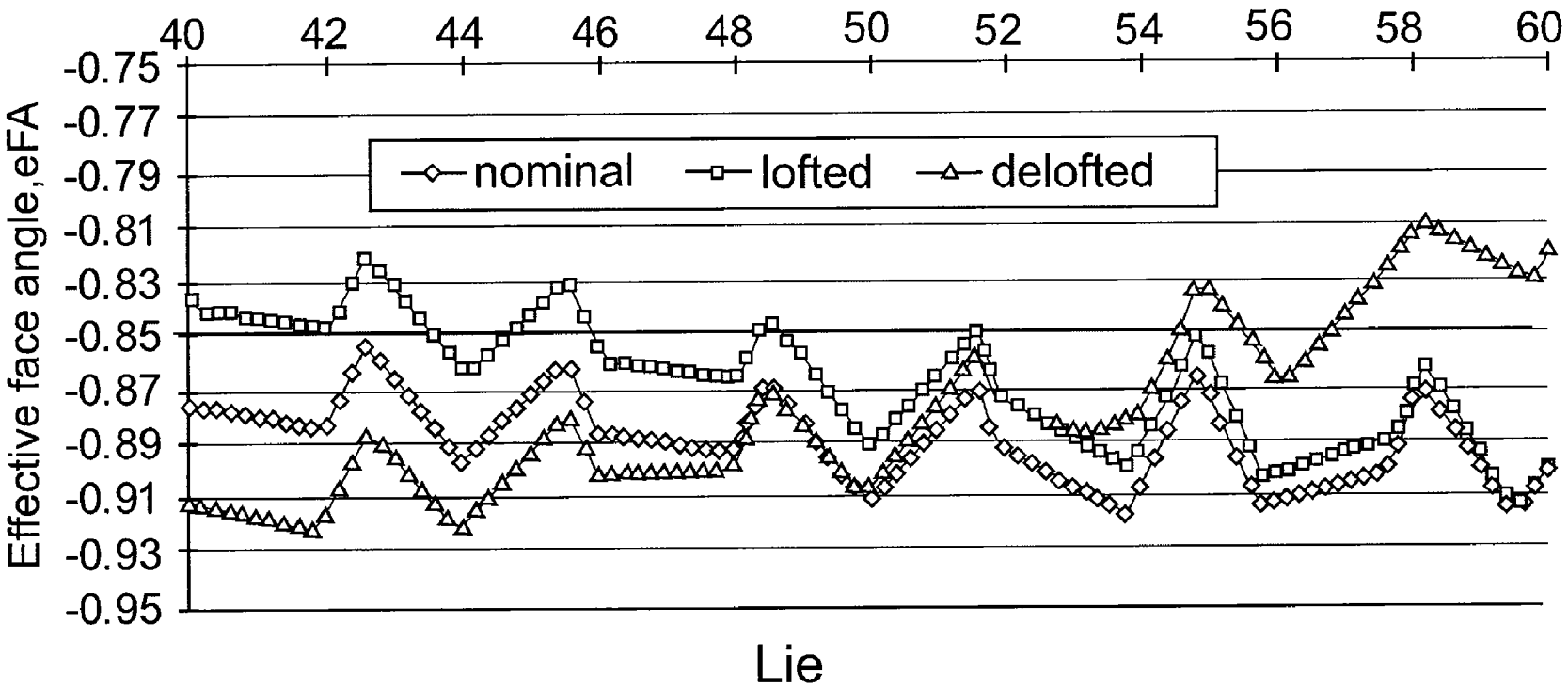
FIG. 59 is a graph showing the effective face angle through a range of lie angles for a shaft positioned at a nominal position, a lofted position and a delofted position.

FIG. 59 illustrates the effective face angle of a club head through a range of lie angles for a nominal state (the shaft loft is unchanged), a lofted state (the shaft loft is increased by 1.5 degrees), and a delofted state (the shaft loft is decreased by 1.5 degrees). In the lofted state, the sole portion 4010 was removed and replaced with a sole portion 4010 having a smaller height H to decrease the sole angle of the club head. In the delofted state, the sole portion was removed and replaced with a sole portion 4010 having a greater height H to increase the sole angle of the club head. As shown in FIG. 59, the effective face angle of the club head in the nominal, lofted and delofted state remained substantially constant through a lie angle range of about 40 degrees to about 60 degrees.

Materials

The components of the head-shaft connection assemblies disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Whereas the invention has been described in connection with representative embodiments, it will be understood that the invention is not limited to those embodiments. On the contrary, the invention is intended to encompass all modifications, alternatives, and equivalents as may fall within the spirit and scope of the invention, as defined by the appended claims.

We claim:

1. A golf club shaft assembly for attaching to a club head, the assembly comprising:

a shaft having a lower end portion; and a sleeve mounted on the lower end portion of the shaft and configured to be inserted into a hosel opening of the club head, the sleeve having an upper portion defining an upper opening that receives the lower end portion of the shaft and a lower portion having a plurality of longitudinally extending, angularly spaced external splines located below the shaft and adapted to mate with complimentary splines in the hosel opening, the lower portion defining a longitudinally extending, internally threaded opening adapted to receive a screw having a nominal diameter of about 4 mm for securing the shaft assembly to the club head when the sleeve is inserted in the hosel opening, wherein each spline has two radially extending sidewalls that diverge from each other moving in a direction from the base of the spline to its outer surface, and each spline has a mid-span width to height ratio of about 1 to about 22, and a mid-span width to average diameter ratio of about 0.1 to about 0.5; and wherein the upper portion of the sleeve has an upper flange surface that is adapted to engage a hosel of the club head when the sleeve is inserted into the hosel opening, and the sleeve and the shaft have a combined axial stiffness from the upper flange surface to a lower end of the sleeve of about $1.86\times10^8$ N/m or less.

2. The assembly according to claim 1 in combination with the screw, wherein the sleeve, the shaft, and the screw have a combined axial stiffness from the upper flange surface to a head of the screw of about $9.27\times10^7$ N/m or less.

3. A removable shaft assembly for a golf club having a hosel defining a hosel opening, the assembly comprising:

a shaft having a lower end portion; and a sleeve mounted on the lower end portion of the shaft and configured to be inserted into the hosel opening of the club head, the sleeve having an upper portion defining an upper opening that receives the lower end portion of the shaft and a lower portion having a plurality of longitudinally extending, angularly spaced external splines located below the shaft and adapted to mate with complimentary splines in the hosel opening, the lower portion defining a longitudinally extending, internally threaded opening adapted to receive a screw for securing the shaft assembly to the club head when the sleeve is inserted in the hosel opening;

wherein the upper portion of the sleeve has an upper thrust surface that is adapted to engage the hosel of the club head when the sleeve is inserted into the hosel opening, and the sleeve and the shaft have a combined axial stiffness from the upper thrust surface to a lower end of the sleeve of less than about $1.87\times10^8$ N/m.

4. The assembly according to claim 3, wherein each spline has two radially extending sidewalls that diverge from each other moving in a direction from the base of the spline to its outer surface, and each spline has a mid-span width to height ratio of about 1 to about 22, and a mid-span width to average diameter ratio of about 0.1 to about 0.5.

5. The assembly according to claim 3 in combination with the screw, wherein a head of the screw has a bearing surface that contacts a surface in the club head when the screw is tightened into the threaded opening of the sleeve, and wherein the sleeve, the shaft, and the screw have a combined axial stiffness from the upper thrust surface to the bearing surface of the screw head of less than about $1.12\times10^8$ N/m.

6. The assembly according to claim 5, wherein the sleeve, the shaft, and the screw have a combined axial stiffness from the upper thrust surface to the bearing surface of the screw head of about $9.27\times10^7$ N/m or less.

7. The assembly according to claim 5 in further combination with the club head, wherein the ratio of the combined axial stiffness of the sleeve, the shaft, and the screw to the axial stiffness of the hosel from the upper thrust surface to the bearing surface of the screw head is less than 0.88.

8. The assembly according to claim 7, wherein the ratio of the combined axial stiffness of the sleeve, the shaft, and the screw to the axial stiffness of the hosel from the upper thrust surface to the bearing surface of the screw head is about 0.73 or less.

9. The assembly according to claim 3, wherein the external splines have sidewalls having a height between about 0.5 mm to about 1.0 mm and a width between about 1.0 mm to about 2.0 mm.

* * * * *